US006169363B1

(12) United States Patent
Mori et al.

(10) Patent No.: US 6,169,363 B1
(45) Date of Patent: Jan. 2, 2001

(54) DISPLAY APPARATUS

(75) Inventors: Hiroshi Mori; Suehiro Nakamura, both of Kanagawa (JP)

(73) Assignee: Sony Corporation, Tokyo (JP)

( * ) Notice: Under 35 U.S.C. 154(b), the term of this patent shall be extended for 0 days.

(21) Appl. No.: 09/040,528

(22) Filed: Mar. 18, 1998

(30) Foreign Application Priority Data

Mar. 19, 1997 (JP) ..... 9-066638
Feb. 16, 1998 (JP) ..... 10-032974

(51) Int. Cl.[7] ..... H01J 17/49

(52) U.S. Cl. ..... 313/582; 313/584; 313/585; 313/586; 313/587

(58) Field of Search ..... 313/582, 583, 313/584, 585, 586, 587, 590, 567, 605, 606

(56) References Cited

U.S. PATENT DOCUMENTS 5,789,862 * 8/1998 Makino ..... 313/585 X
5,841,232 * 11/1998 Hirao et al. ..... 313/585
5,932,967 * 8/1999 Chikazawa ..... 313/587 X

* cited by examiner

*Primary Examiner*—Nimeshkumar D. Patel
*Assistant Examiner*—Mack Haynes
(74) *Attorney, Agent, or Firm*—Ronald P. Kananen; Rader, Fishman & Grauer

(57) ABSTRACT

A display apparatus utilizing plasma discharge and having pixels of high definition can be obtained. An AC drive type display apparatus utilizing plasma discharge has a discharge sustain electrode group formed of a plurality of discharge sustain electrodes on one substrate, and an address electrode group formed of a plurality of address electrodes thereon. Dielectric layers are formed at least on the discharge sustain electrode group and a discharge start address electrode group formed of a plurality of discharge start address electrodes forming a part of the address electrode group.

41 Claims, 43 Drawing Sheets

DISPLAY APPARATUS

BACKGROUND

1. Field of the Invention

The present invention relates to an AC drive type display apparatus utilizing a so-called plasma discharge such as an AC type plasma display panel (hereinafter referred to as an AC type PDP).

2. Background of the Invention

There has been an AC type PDP for accumulating charges in a charge accumulation layer provided between a discharge sustain electrode group and an address electrode group to carry out display by utilizing discharge characteristics resulting from a high-frequency discharge phenomenon. The AC type PDP includes that for presenting a color of emitted light of discharge gas and that in which a phosphor emits visible light by utilizing ultraviolet rays generated from discharge.

Various kinds of methods of arranging the AC type PDP have been known. In order to reduce a thickness of the PDP, many PDPs employ an arrangement in which peripheries of a front surface glass panel and a rear surface glass panel opposed to each other are sealed and discharge gas is filled into a tightly sealed vessel.

A discharge display cell is usually formed at a position where a stripe first electrode group and a stripe second electrode group. A barrier rib is formed around the discharge display cell in order to prevent erroneous discharge from being carried out between adjacent cells and prevent color from blurring on adjacent cells and to keep the difference between pressures inside and outside the panel and keep the distance between electrodes.

A color AC type PDP will hereinafter be described. A display discharge electrode is arranged as that of a so-called plane discharge type in order to locate it away from a phosphor formed portion. It is known that a conventional color AC type PDP includes those driven by a two-phase electrode and a three-phase electrode.

FIG. 1 shows an arrangement of a two-phase electrode color AC type PDP. FIG. 2 is a cross-sectional view of the two-phase color AC type PDP shown in FIG. 1 cut along a line A—A'.

FIG. 1 is a diagram showing an arrangement of a part, corresponding to one pixel, of the three-phase color AC type PDP. A PDP 1 has, in its matrix-display unit light emitting region, a two-electrode structure in which a display electrode 2 and an address electrode 6 opposed to each other and a phosphor 8 is formed on the side of the address electrode 6.

The display electrode 2 for the plane discharge is provided on a front-surface glass substrate on the display surface side, and covered with a dielectric layer 4 for AC drive so as not to be exposed to the discharge space. A black matrix 5 for setting a unit light emitting region is provided at a position, corresponding to a barrier rib 9 described later on, on a surface of the dielectric layer 4.

The address electrodes 6 used for selectively making the unit light emitting regions emitting light are arranged on a rear-surface side glass substrate 7 at every predetermined pitch so as to be perpendicular to the display electrode 2.

Stripe barrier ribs 9 having a predetermined width for keeping a length of the discharge space are provided through a white dielectric layer 8 between the adjacent address electrodes 6, and thereby divides the discharge space into the unit light emitting regions in the line direction (i.e., the direction in which the display electrode 2 is extended). Phosphors 10 of three primary colors, i.e., red, green and blue are provided on the rear surface glass substrate 7 so as to cover a rear-surface-side inner surface including an upper surface of the address electrode 2 and a side surface of the barrier rib 9. Penning gas obtained by mixing neon or argon with xenon is filled as discharge gas used for emitting ultraviolet rays for the phosphor 10 by excitation in the discharge space.

FIG. 3 is a diagram showing an arrangement of a three-phase AC type PDP. FIG. 4 is a cross-sectional view of the three-phase AC type PDP shown in FIG. 3 cut along a line B—B'which is in parallel to the direction where an address electrode is extended. FIG. 5 is a cross-sectional view of the three-phase AC type PDP shown in FIG. 3 cut along a line C—C' which is in parallel to the direction where an address electrode is extended.

FIG. 3 is a perspective view showing a part, corresponding to one pixel, of the three-phase color AC type PDP. A PDP 11 has, in its matrix display unit light emitting region, a three-electrode structure in which a pair of display electrodes 13, 13 and an address electrode 18 are opposed to each other and a phosphor 21 is formed on the side of the address electrode 18. This three-phase color AC type PDP is called a plane discharge type PDP.

The display electrodes 13, 13 used for the plane discharge are provided on a display-surface-side front surface glass substrate 12, and covered with a dielectric layer 15 for AC drive so as not to be exposed to the discharge space. On a surface of the dielectric film 15, an MgO film having a thickness of about several thousand Å is provided as a protective layer 16 for the dielectric layer 15. Bus electrodes 14, 14 having low resistance are formed on the display electrodes 13, 13.

The address electrodes 18 used for selectively making the unit light emitting regions emitting light are arranged on a rear-surface-side glass substrate 17 at a pitch of about 200 $\mu$m so as to be perpendicular to the display electrodes 13, 13.

Stripe barrier ribs 20 having a width of about 100 $\mu$m for keeping a length of the discharge space are provided between the adjacent address electrodes 18, 18, and thus divides the discharge space into the unit light emitting regions in the line direction (i.e., in the direction in which the display electrodes 13, 13 are extended). On a rear-surface glass substrate 17, a phosphor layer 21 (i.e., phosphors 21R, 21B, 21G for three primary colors, i.e., red, green and blue) is provided so as to cover a rear-surface-side inner surface including an upper surface of the address electrode 18 and a side surface of the barrier rib 20. Penning gas obtained by mixing neon with xenon is filled as discharge gas used for emitting ultraviolet rays for the phosphors 21R, 21B, 21G by excitation in the discharge space.

Three red (R), green (G) and blue (B) unit light emitting regions having the same area and arranged in the line direction correspond to one pixel forming the display screen. A plane discharge cell (a main discharge cell used for display) is determined by a pair of display electrodes 13, 13 and an address discharge cell used for selecting whether it is used for display or not is determined by one of the display electrode 13, 13 and the address electrode 18. Thus, it is possible to selectively permit the portion corresponding to each of the unit light emitting regions of the phosphors 21R, 21G and 21B continuously arranged in the lateral direction in FIG. 40 to emit light, thereby a full color display being capable to be carried out by utilizing combination of red (R), green (G) and blue (B).

However, in order to obtain high=definition display pixels in such color AC type PDP 11, a distance between the display electrodes 13, 13 must be set shorter. In connection therewith, a distance between the address electrode 18 and the display electrodes 13, 13 must be set equal to the distance between the display electrodes 13, 13. At this time, if the distance between the display electrodes 13, 13 does not exceed 20 $\mu$m and the phosphor layers 21 having a thickness of 20 to 40 $\mu$m is formed, then there is no space for the plasma discharge space 22 and puncture may disadvantageously occur between the electrodes. Even if the space for the plasma discharge space 22 is secured, the phosphor layer 21 is formed only on a limited portion. Moreover, if an amount of the phosphor layer 21 is reduced, then the luminance becomes lower and further the phosphor layer 21 is deteriorated by ion which impinges on the phosphor layer 21.

SUMMARY OF THE INVENTION

In view of such aspects, it is an object of the present invention to provide a display apparatus in which even if a distance between electrodes is set shorter, a plasma discharge space is secured and phosphor is prevented from being deteriorated.

It is another object of the present invention to provide a high-definition display apparatus.

According to an aspect of the present invention, a display apparatus is an AC drive type display apparatus utilizing plasma discharge. A discharge sustain electrode group and an address electrode group are formed on the same substrate.

According to the display apparatus of the present invention, since the discharge sustain electrode group and the address electrode group are formed on the same substrate, even if a distance between the discharge sustain electrode and the address electrode becomes smaller, then a sufficient plasma discharge space is kept by barrier ribs. Therefore, high-definition display pixels can be obtained.

If a phosphor layer on a substrate on the opposite side is excited by ultraviolet rays generated by plasma to emit light, then sufficient ultraviolet rays generated by the plasma can be kept, and the phosphor layer can emit light with high luminance. Moreover, since the phosphor layer can be provided out of the plasma and hence is prevented from being in contact with the plasma, it is possible to prevent the phosphor from being deteriorated by ions of the plasma impinging on the phosphor.

Since the address electrode group and the discharge sustain electrode group are formed on the same substrate, it is possible to achieve a precise positional relationship between the electrodes in a process of forming electrodes, and consequently, in a process of sealing an electrode side substrate and a substrate opposed thereto, tolerance in positioning and a space interval becomes larger, which facilitates the sealing process. Therefore, the yield can be improved, which leads to reduction of the manufacturing costs.

BRIEF DESCRIPTION OF THE DRAWINGS

FIGS. 14A and 14B are diagrams showing processes of manufacturing an electrode substrate of the display apparatus according to the first embodiment of the present invention, wherein FIG. 14A is a plan view thereof and FIG. 14B is a cross-sectional view thereof cut along a line E—E shown in FIG. 14A;

FIGS. 15A and 15B are diagrams showing processes of manufacturing an electrode substrate of the display apparatus according to the first embodiment of the present invention, wherein FIG. 15A is a plan view thereof and FIG. 15B is a cross-sectional view thereof cut along a line E—E shown in FIG. 15A;

FIGS. 16A and 16B are diagrams showing processes of manufacturing an electrode substrate of the display apparatus according to the first embodiment of the present invention, wherein FIG. 16A is a plan view thereof and FIG. 16B is a cross-sectional view thereof cut along a line E—E shown in FIG. 16A;

FIGS. 17A and 17B are diagrams showing processes of manufacturing an electrode substrate of the display apparatus according to the first embodiment of the present invention, wherein FIG. 17A is a plan view thereof and FIG. 17B is a cross-sectional view thereof cut along a line E—E shown in FIG. 17A;

FIGS. 18A and 18B are diagrams showing processes of manufacturing an electrode substrate of the display apparatus according to the first embodiment of the present invention, wherein FIG. 18A is a plan view thereof and FIG. 18B is a cross-sectional view thereof cut along a line E—E shown in FIG. 18A;

FIGS. 19A and 19B are diagrams showing processes of manufacturing an electrode substrate of the display apparatus according to the first embodiment of the present invention, wherein FIG. 19A is a plan view thereof and FIG. 19B is a cross-sectional view thereof cut along a line E—E shown in FIG. 19A;

FIGS. 22A to 22C are diagrams showing processes of manufacturing an electrode substrate of the display apparatus shown in FIG. 21 according to the second embodiment of the present invention, wherein FIG. 22A is a plan view thereof, FIG. 22B is a cross-sectional view thereof cut along a line F—F shown in FIG. 22A and FIG. 22C is a cross-sectional view thereof cut along a line G—G shown in FIG. 22A;

FIGS. 23A to 23C are diagrams showing processes of manufacturing an electrode substrate of the display apparatus shown in FIG. 21 according to the second embodiment of the present invention, wherein FIG. 23A is a plan view thereof, FIG. 23B is a cross-sectional view thereof cut along a line F—F shown in FIG. 23A and FIG. 23C is a cross-sectional view thereof cut along a line G—G shown in FIG. 23A;

FIGS. 24A to 24C are diagrams showing processes of manufacturing an electrode substrate of the display apparatus shown in FIG. 21 according to the second embodiment of the present invention, wherein FIG. 24A is a plan view thereof, FIG. 24B is a cross-sectional view thereof cut along a line F—F shown in FIG. 24A and FIG. 24C is a cross-sectional view thereof cut along a line G—G shown in FIG. 24A;

FIGS. 29A to 29C are diagrams showing processes of manufacturing an electrode substrate of a display apparatus according to a fifth embodiment of the present invention, wherein FIG. 29A is a plan view thereof, FIG. 29B is a cross-sectional view thereof cut along a line H—H shown in FIG. 29A and FIG. 29C is a cross-sectional view thereof cut along a line I—I shown in FIG. 29A;

FIGS. 30A to 30C are diagrams showing processes of manufacturing the electrode substrate of the display apparatus shown in FIGS. 29A to 29C according to the fifth embodiment of the present invention, wherein FIG. 30A is a plan view thereof, FIG. 30B is a cross-sectional view thereof cut along a line H—H shown in FIG. 30A and FIG. 30C is a cross-sectional view thereof cut along a line I—I shown in FIG. 30A;

FIGS. 31A to 31C are diagrams showing processes of manufacturing the electrode substrate of the display apparatus shown in FIGS. 29A to 29C according to the fifth embodiment of the present invention, wherein FIG. 31A is a plan view thereof, FIG. 31B is a cross-sectional view thereof cut along a line H—H shown in FIG. 31A and FIG. 31C is a cross-sectional view thereof cut along a line I—I shown in FIG. 31A;

FIGS. 32A to 32C are diagrams showing processes of manufacturing the electrode substrate of the display apparatus shown in FIGS. 29A to 29C according to the fifth embodiment of the present invention, wherein FIG. 32A is a plan view thereof, FIG. 32B is a cross-sectional view thereof cut along a line H—H shown in FIG. 32A and FIG. 32C is a cross-sectional view thereof cut along a line I—I shown in FIG. 32A;

FIGS. 34A to 34D are diagrams showing processes of manufacturing an electrode substrate of a display apparatus according to a sixth embodiment of the present invention, wherein FIG. 34A is a plan view thereof, FIG. 34B is a cross-sectional view thereof cut along a line J—J shown in FIG. 34A, FIG. 34C is a cross-sectional view thereof cut along a line K—K shown in FIG. 34A and FIG. 34D is a cross-sectional view thereof cut along a line L—L shown in FIG. 34A;

FIGS. 35A to 35D are diagrams showing processes of manufacturing the electrode substrate of the display apparatus shown in FIGS. 34A to 34D according to the sixth embodiment of the present invention, wherein FIG. 35A is a plan view thereof, FIG. 35B is a cross-sectional view thereof cut along a line J—J shown in FIG. 35A, FIG. 35C is a cross-sectional view thereof cut along a line K—K shown in FIG. 35A and FIG. 35D is a cross-sectional view thereof cut along a line L—L shown in FIG. 35A;

FIGS. 36A to 36D are diagrams showing processes of manufacturing the electrode substrate of the display apparatus shown in FIGS. 34A to 34D according to the sixth embodiment of the present invention, wherein FIG. 36A is a plan view thereof, FIG. 36B is a cross-sectional view thereof cut along a line J—J shown in FIG. 36A, FIG. 36C is a cross-sectional view thereof cut along a line K—K shown in FIG. 36A and FIG. 36D is a cross-sectional view thereof cut along a line L—L shown in FIG. 36A;

FIGS. 37A to 37D are diagrams showing processes of manufacturing the electrode substrate of the display apparatus shown in FIGS. 34A to 34D according to the sixth embodiment of the present invention, wherein FIG. 37A is a plan view thereof, FIG. 37B is a cross-sectional view thereof cut along a line J—J shown in FIG. 37A, FIG. 37C is a cross-sectional view thereof cut along a line K—K shown in FIG. 37A and FIG. 37D is a cross-sectional view thereof cut along a line L—L shown in FIG. 37A;

FIGS. 39A and 39B are diagrams showing processes of manufacturing an electrode substrate of a display apparatus according to a seventh embodiment of the present invention, wherein FIG. 39A is a plan view thereof and FIG. 39B is a cross-sectional view thereof cut along a line M—M shown in FIG. 39A;

FIGS. 40A and 40B are diagrams showing processes of manufacturing the electrode substrate of the display apparatus shown in FIGS. 39A and 39B according to the seventh embodiment of the present invention, wherein FIG. 40A is a plan view thereof and FIG. 40B is a cross-sectional view thereof cut along a line N—N shown in FIG. 40A;

FIGS. 41A and 41B are diagrams showing processes of manufacturing the electrode substrate of the display apparatus shown in FIGS. 39A and 39B according to the seventh embodiment of the present invention, wherein FIG. 41A is a plan view thereof and FIG. 41B is a cross-sectional view thereof cut along a line N—N shown in FIG. 41A.

DESCRIPTION OF THE PREFERRED EMBODIMENTS

Figure 1:
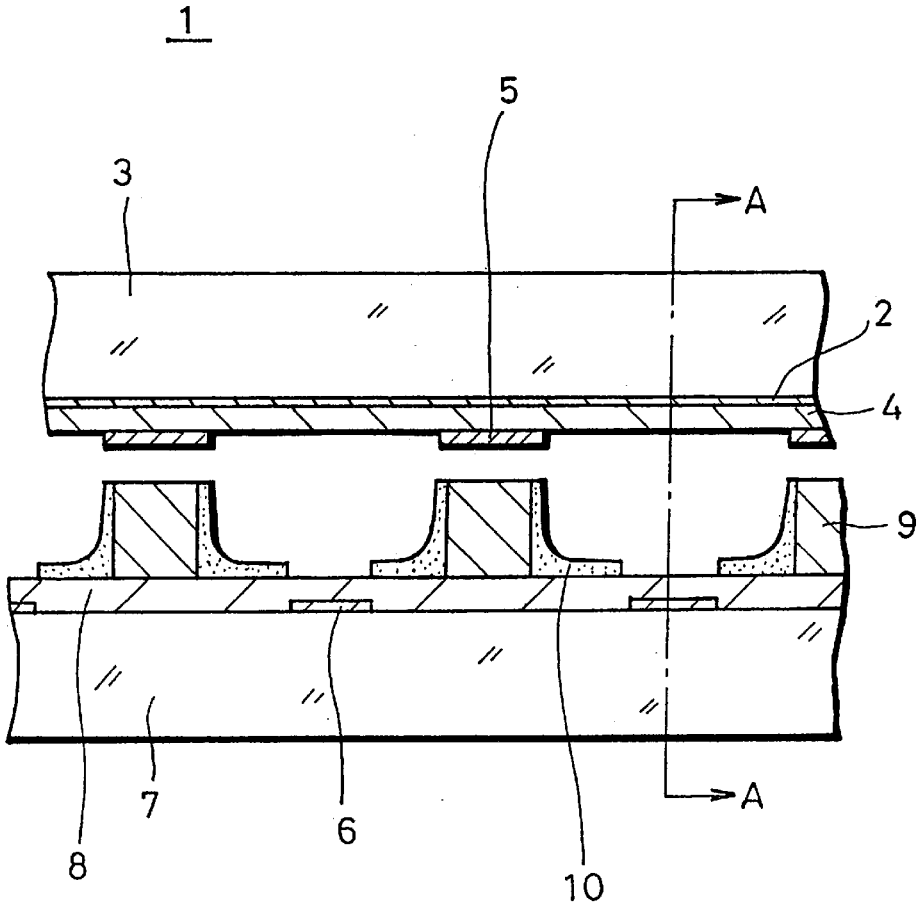
FIG. 1 PRIOR ART
FIG. 1 is a diagram showing an arrangement of a main part of an AC type two-phase electrode PDP.
Figure 2:
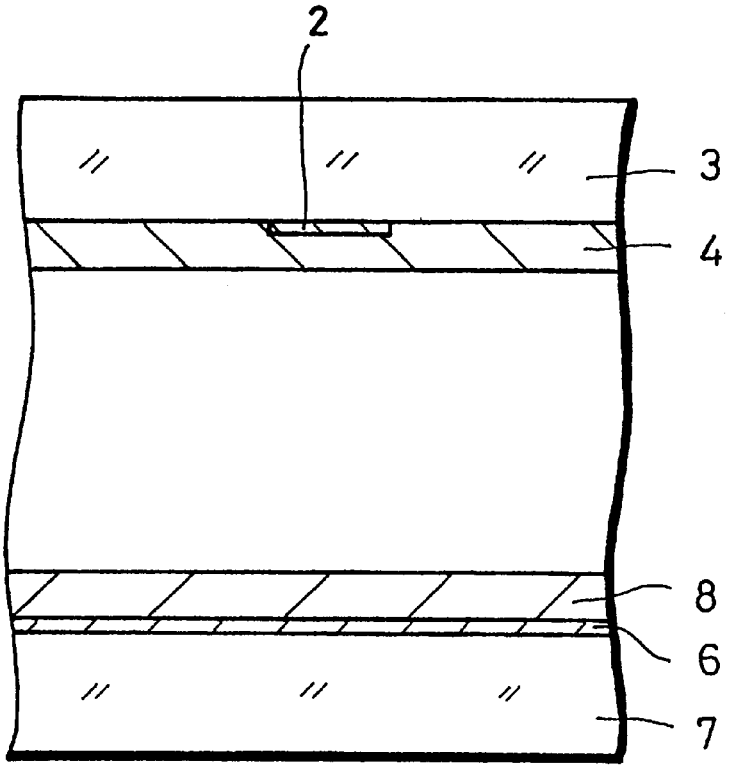
FIG. 2 PRIOR ART
FIG. 2 is a cross-sectional view of the PDP shown in FIG. 1 cut along a line A—A'.
Figure 3:
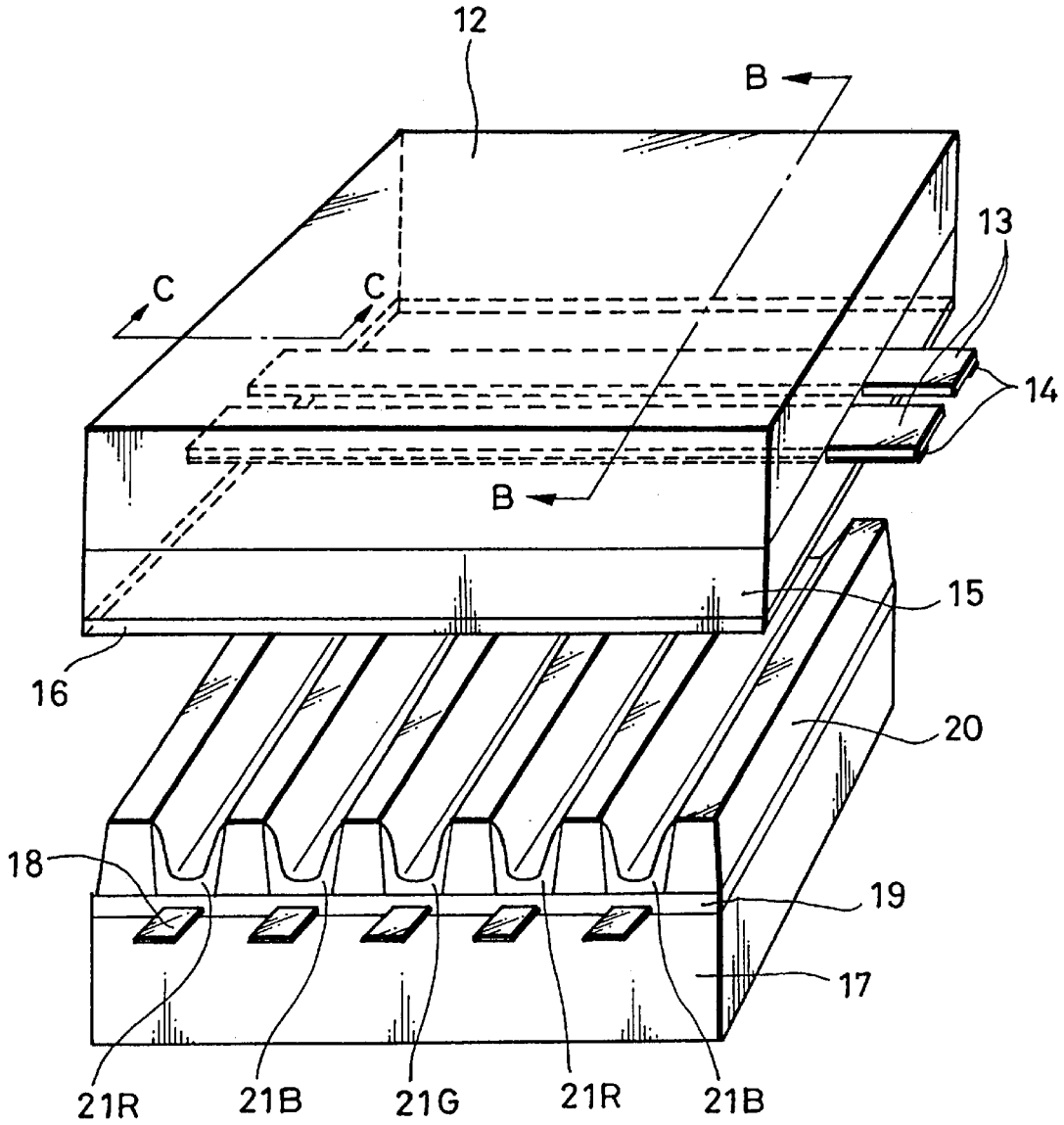
FIG. 3 PRIOR ART
FIG. 3 is a diagram showing an arrangement of a main part of an AC type three-phase electrode PDP.
Figure 4:
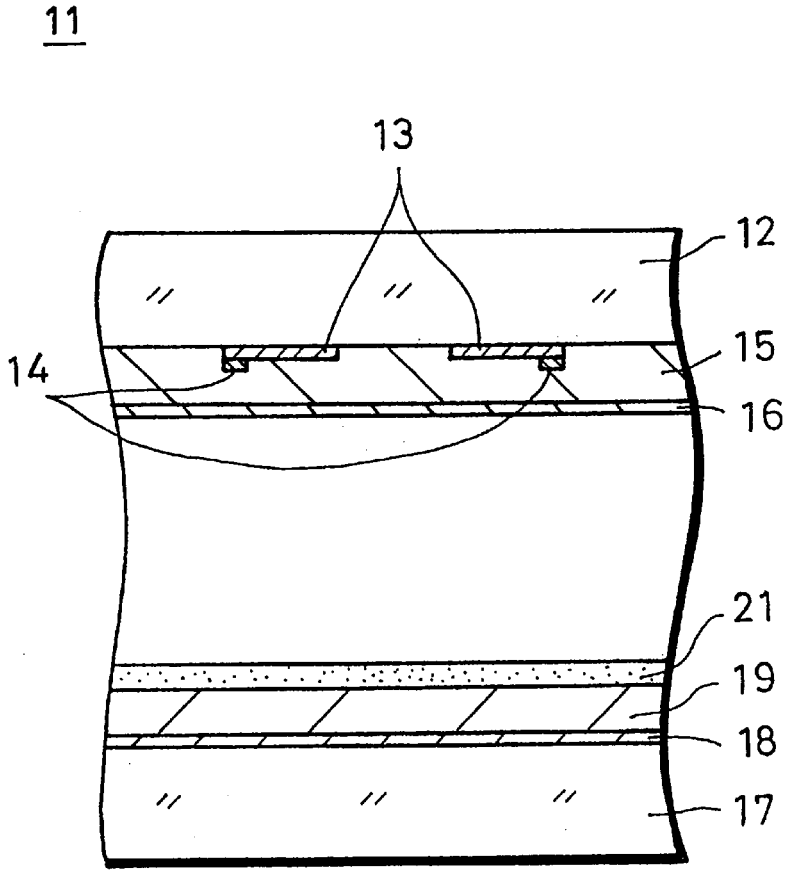
FIG. 4 PRIOR ART
FIG. 4 is a cross-sectional view of the PDP shown in FIG. 3 cut along a line B—B'.
Figure 5:
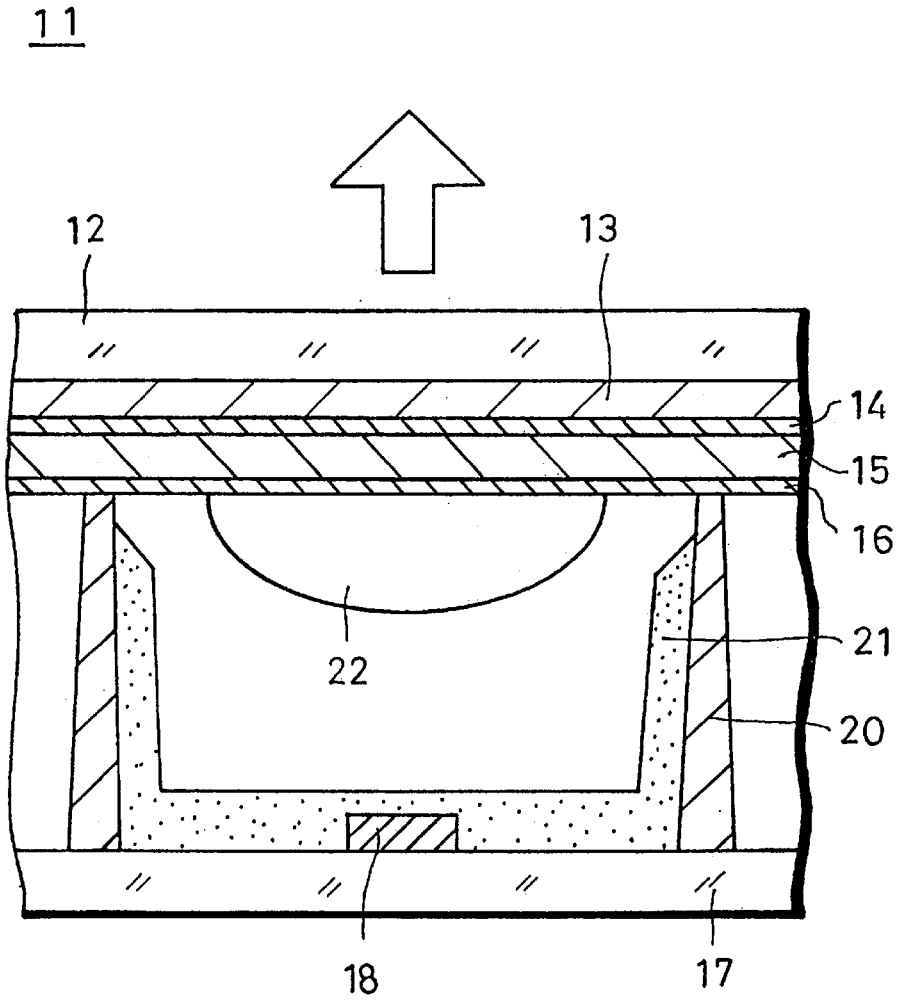
FIG. 5 PRIOR ART
FIG. 5 is a cross-sectional view of the PDP shown in FIG. 3 cut along a line C—C'.

A display apparatus according to the present invention is an AC drive type display apparatus utilizing plasma discharge. A discharge sustain electrode group formed of a plurality of discharge sustain electrodes and an address electrode group formed of a plurality of address electrodes are formed on one substrate. A dielectric layer is formed on at least the discharge sustain electrode group and a discharge start address electrode group formed of a plurality of discharge start address electrodes forming a part of the address electrode group.

A phosphor layer which emits light by ultraviolet rays generated by plasma discharge can be formed on the other substrate opposed to the one substrate.

The discharge sustain electrode group and the address electrode group are formed so as to cross each other, and an insulating layer is formed between the discharge sustain electrode group and the address electrode group.

This insulating layer can be formed by extending the dielectric layer or can be formed independently of the dielectric layer.

The discharge sustain electrode and the discharge start address electrode can be formed on the same surface, the address electrode and the discharge start address electrode being connected to each other through an aperture provided through the insulating layer under the address electrode.

The discharge sustain electrode and the discharge start address electrode can be formed on the same surface, the address electrode crossing the discharge start address electrode being formed through the insulating layer between the address electrode and the discharge sustain electrode and the extended portion of each of the address electrode being connected directly to the discharge start address electrode along a side surface of the insulating layer.

In this case, the dielectric layer can be formed on the entire surface of the discharge sustain electrode group, the discharge start address electrode group and the address electrode group.

According to the present invention, the discharge sustain electrode and a terminal portion of the discharge sustain electrode are covered directly with the insulating film. In this case, the dielectric layer can be separately formed on the discharge sustain electrode and the discharge start address electrode.

The discharge sustain electrode, the terminal portion thereof and the discharge start address electrode forming a part of the address electrode can be covered with the insulating film.

In this arrangement, the insulating film can be employed as the dielectric layer. When the insulating film is utilized as the dielectric layer, an MgO film serving as a protective film can be formed on the insulating film. It is needless to say that the dielectric layer can be formed independently on the entire surface including that of the insulating film.

A film thickness of the insulating film can be set within the range from 10 $\mu$m to 100 $\mu$m.

According to the present invention, the address electrode group crossing the discharge sustain electrode group through the insulating layer and the discharge start address electrode group can be continuously and simultaneously formed.

In this display apparatus, the insulating film can be formed so as to cover the discharge sustain electrode group or the entire surface of the substrate including the discharge sustain electrode group, the address electrode group crossing the discharge sustain electrode group and the discharge start address electrode group being continuously and simultaneously formed.

In this case, the address electrode group can be formed on the insulating film further through an insulating layer.

A reflective film is formed on the other substrate side, thereby making it possible to improve luminance of emitted light of a display seen from the one substrate side.

For example, the reflective film can be formed between the other substrate and the phosphor layer.

A reflective film is formed on the one substrate side, thereby making it possible to improve luminance of emitted light of a display seen from the other substrate side.

For example, the discharge sustain electrode group, the discharge start address electrode group and the address electrode group can be formed through the reflective film and the insulating film on the one substrate.

A high-reflectivity material such as aluminum (Al), nickel (Ni), silver (Ag), other metal film or the like can be employed as the reflective film.

According to the present invention, it is possible that the discharge start address on the one substrate side is formed in every discharge region, the barrier ribs are formed on the other substrate to form the phosphor layer between the adjacent barrier ribs, and the one substrate and the other substrate are sealed so that the barrier ribs and the address electrodes should respectively correspond to each other.

A distance between a pair of first and second discharge sustain electrodes of the discharge sustain electrode group can be set to 50 $\mu$m or smaller or 30 $\mu$m or smaller, e.g., 5 $\mu$m to 20 $\mu$m and set further to 5 $\mu$m or smaller or 1 $\mu$m or smaller.

A distance between the pair of first and second discharge sustain electrodes of the discharge sustain electrode group and a distance between the discharge start address electrode and the discharge sustain electrode (i.e., one of the pair of discharge sustain electrodes) can be set substantially equal to each other, i.e., set equal to each other or approximately equal to each other.

The distance between the discharge start address electrode and the discharge sustain electrode (i.e., one of the pair of discharge sustain electrodes) can be set within the range of ±30% of the distance between the pair of first and second discharge sustain electrodes of the discharge sustain electrode group.

If a discharge start voltage is selected to a minimum value of a Paschen curve, for example, the distance between a pair of the first and second discharge sustain electrodes of the discharge sustain electrode group and the distance between the one discharge sustain electrode and the discharge start address electrode can be fluctuated within the tolerance range of ± several tens % of the distance between the electrode determined by the above selection. Even if the discharge start voltage is set to a value other than the minimum value of the Paschen curve, both of the distances between the electrodes can have tolerance of ±30% of the distance between the electrode determined by the above selection.

Gas of one kind or more of He, Ne, Ar, Xe and Kr can be filled in a tightly sealed vessel formed by sealing the one substrate and the other substrate, i.e., in a discharge space thereof so that a pressure of the filled gas should be 0.8 to 3.0 atmosphere.

The discharge start address electrode can be formed so as to be L-shaped.

A magnesium oxide layer serving as a protective film and serving to lower a work function can be formed on a surface of the dielectric layer on the discharge start address electrode and the discharge sustain electrode except the address electrode.

It is preferable to set the thickness of the dielectric layer on the discharge sustain electrode and the discharge start address electrode thinner as compared with the distances between the electrodes, i.e., the distance between the pair of first and second discharge sustain electrodes and the distance between one of the pair of discharge sustain electrodes and the discharge start address electrodes.

The discharge sustain electrode can be formed of a transparent and conductive film or a metal film of Al, Cr, Au or Ag, a metal film having a dilayer structure of AL/Cr, a metal film having a trilayer structure of Cr/Al/Cr, and so on. If the discharge start address electrode group is formed simultaneously with the discharge sustain electrode group, the discharge start address electrode group can be formed of the same material as the discharge sustain electrode group. The address electrode group can be formed of a metal material such as Al, Au or the like.

The display apparatus according to the present invention can be applied to both of the color display apparatus and a monochrome display apparatus.

In the color display apparatus, one pixel is formed of a combination of the unit discharge regions )i.e., so-called dots) for red, green and blue. In the monochrome display apparatus, one pixel is formed of one unit discharge region (i.e., a so-called dot).

A display apparatus according to the present invention can be applied to both of a color display apparatus and a monochrome display apparatus.

In the color display apparatus, a set of red, green and blue unit discharge regions (i.e., so-called dots) form one pixel. In the monochrome display apparatus, one unit discharge region (i.e., a so-called dot) forms one pixel.

Figure 6:
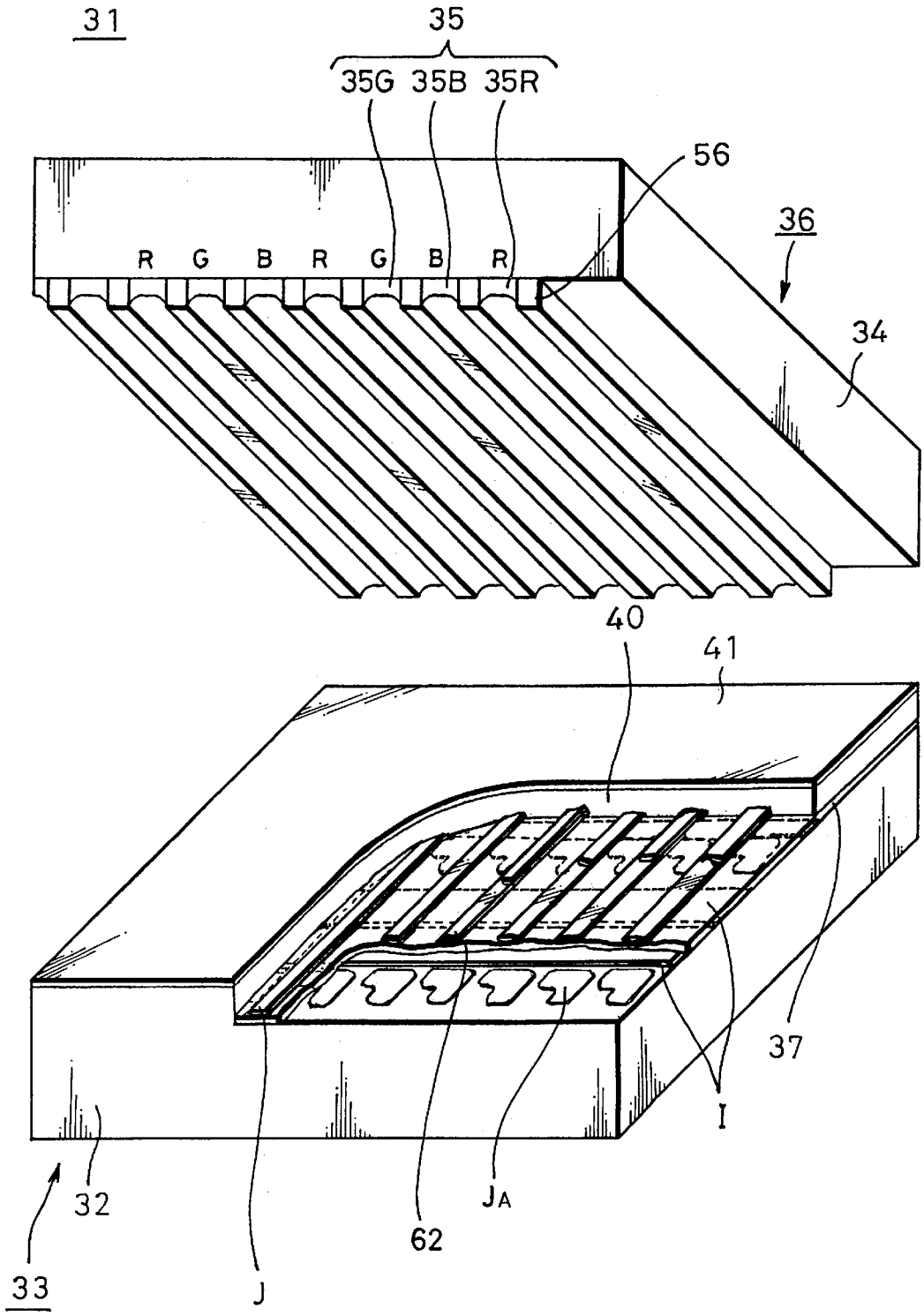
FIG. 6 is a diagram showing an arrangement of a display apparatus according to a first embodiment of the present invention.
Figure 7:
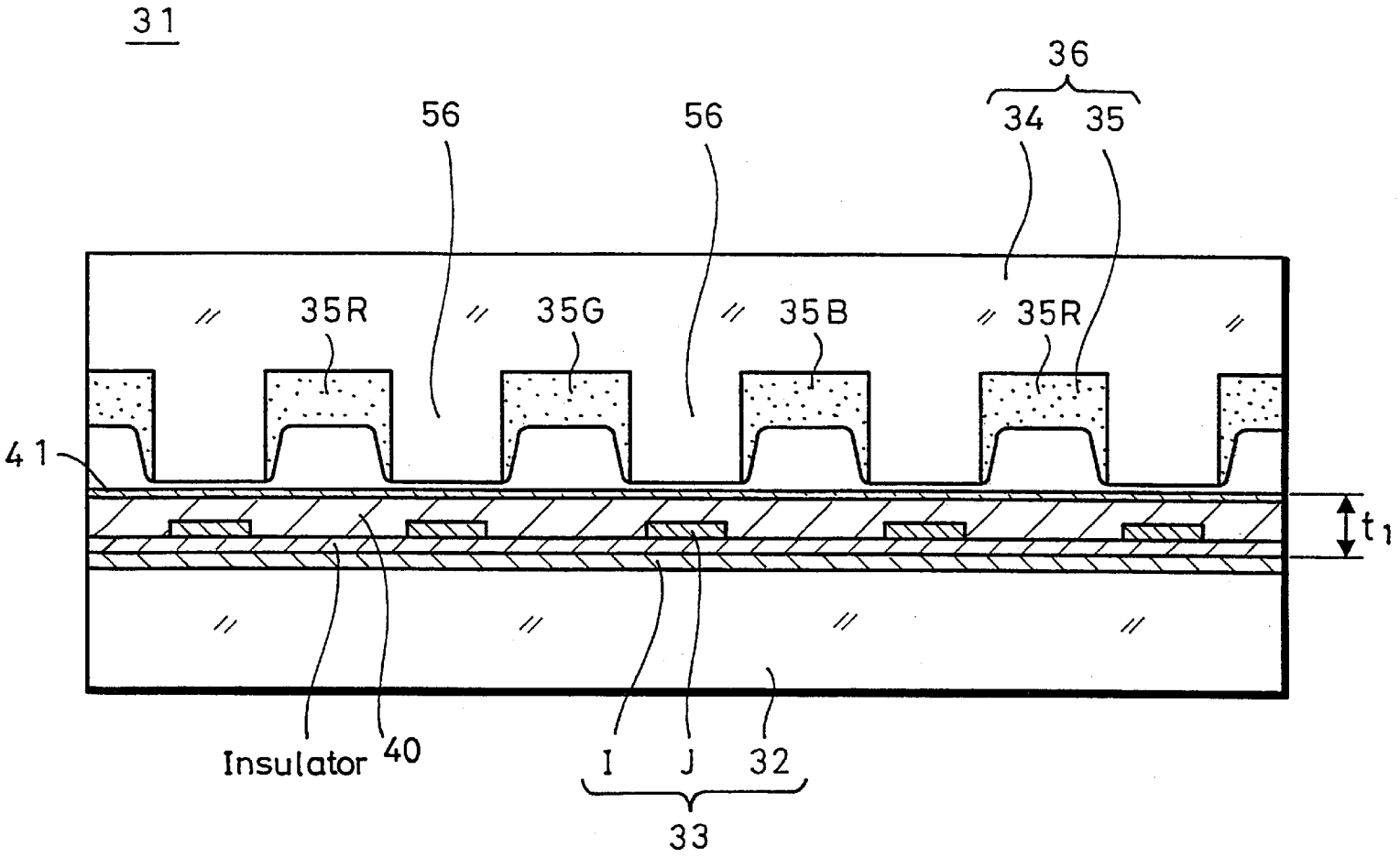
FIG. 7 is a cross-sectional view showing the arrangement of the display apparatus according to the first embodiment of the present invention.
Figure 8:
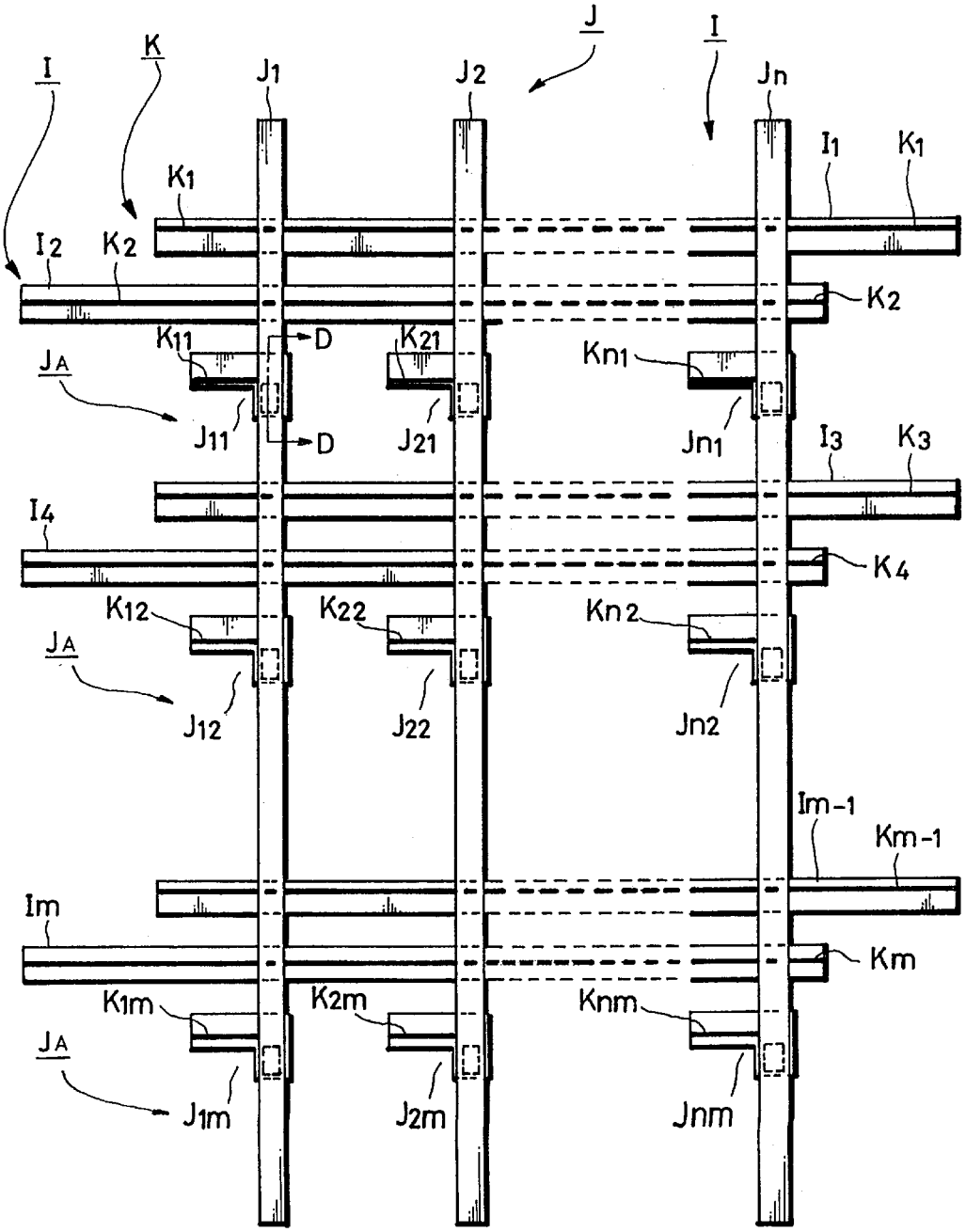
FIG. 8 is a plan view showing an electrode structure of the display apparatus according to the first embodiment of the present invention.

FIGS. 6 to 8 shows a display apparatus according to a first embodiment of the present invention. In this first embodiment, the present invention is applied to a color AC type PDP.

A display apparatus 31 has a so-called electrode substrate 33 formed of a first substrate serving as one substrate, e.g., a lower-surface glass substrate 32, and of a so-called a discharge sustain electrode group formed thereon of a plurality of stripe discharge sustain electrodes I ($I_1, I_2, \ldots, I_m$) an address electrode group formed of a plurality of address electrodes J ($J_1, J_2, \ldots, J_n$), and a discharge start address electrode group formed of a plurality of discharge start address electrodes $J_A$ ($J_{11}, \ldots, J_{n1}, J_{12}, \ldots J_{n2}, J_{1m}, \ldots J_{nm}$) The display apparatus 31 has a so-called phosphor substrate 36 formed so as to be opposed to the electrode substrate 33 and formed of a second substrate serving as the other substrate, e.g., an upper surface glass substrate 34 and a phosphor layer 35 provided thereon. The display apparatus 31 is formed by tightly sealing the electrode substrate 33 and the phosphor substrate 36.

As shown in FIG. 8, the discharge sustain electrode group is arranged such that pairs of discharge sustain electrodes $I_1$ and $I_2$, $I_3$ and $I_4$, . . . , $I_{m-1}$ and $I_m$, each of which sustains discharge after commencement of the discharge are formed.

Each of the address electrodes $J_1$. . . $J_n$ of the address electrode group is an electrode used for designating a display address and is arranged at a predetermined interval in the longitudinal direction of the discharge sustain electrodes I ($I_1, I_2, \ldots, I_m$) so as to cross the discharge sustain electrode group.

Each of the discharge start address electrodes $J_A$ ($J_{11}, \ldots, J_{nm}$) of the discharge start address electrode group is an electrode for commencing discharge between it and each of one electrode of a pair of the discharge sustain electrodes ($I_1$ and $I_2$), ($I_3$ and $I_4$), , ($I_{m-1}$ and $I_m$) i e.g., the discharge sustain electrodes $I_2, I_4, \ldots, I_m$, and arranged so as to correspond to each of the unit light emitting regions.

Each of the discharge start address electrodes $J_{11}, \ldots, J_{nm}$ is formed of one piece portion in parallel to the discharge sustain electrodes I and the other piece portion located along the address electrodes J so as to be L-shaped.

The discharge sustain electrodes $I_1, \ldots, I_m$ and the discharge start address electrodes $J_{11}, \ldots, J_{nm}$ are formed on the same surface of the lower-surface glass substrate 32, and a dielectric layer 37 is formed on the discharge sustain electrodes $I_1, \ldots, I_m$ and the discharge start address electrodes $J_{11}, \ldots, J_{nm}$.

The address electrodes $J_1, \ldots, J_n$ is formed on the dielectric layer 37 so as to lie on a part of the discharge start address electrodes $J_{11}, \ldots, J_{nm}$ and to cross the discharge sustain electrodes $I_1, \ldots, I_m$ at a right angle, for example.

The dielectric layer 37 provided immediately below the stripe address electrodes $J_1, \ldots, J_n$ serves as a so-called insulating layer. The insulating layer formed of the dielectric layer 37 insulates the address electrodes $J_1, \ldots, J_n$ and the discharge start address electrodes $J_{11}, \ldots$, m $J_{nm}$ from each other so as to prevent them from being short-circuited.

Figure 9:
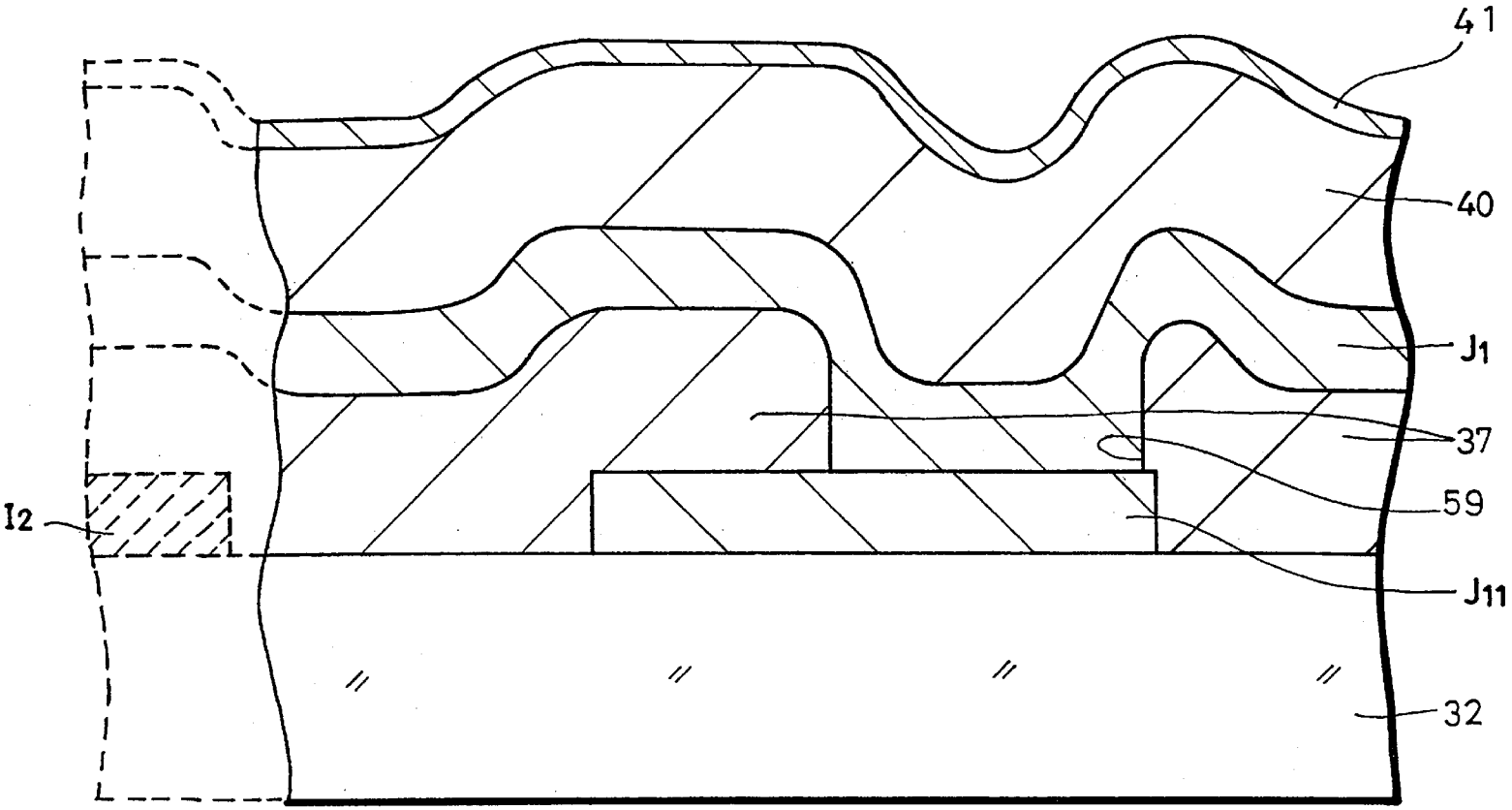
FIG. 9 is a cross-sectional view of the display apparatus according to the first embodiment of the present invention cut along a line D—D' in FIG. 8.

As shown in FIGS. 8 and 9, each of the address electrodes $J_1, \ldots, J_n$ is connected to the each column of the discharge start address electrodes $J_{11}, \ldots, J_{nm}$ through a contact aperture 59 provided through the insulating layer formed of the dielectric layer 37 at each of the portions where the address electrodes $I_1, \ldots, I_n$ and the discharge start address electrodes $J_{11}, \ldots, J_{nm}$ cross each other. Specifically, the discharge start address electrodes $J_{11}, \ldots, J_{12}, \ldots, J_{1m}$ are connected to the common address electrode $J_1$, the discharge start address electrodes $J_{21}, J_{22}, \ldots, J_{2m}$ are connected to the common address electrode $J_2$, and the discharge start address electrodes $J_{1n}, J_{n2}, \ldots, J_{nm}$ are connected to the common address electrode $J_n$.

Each of the discharge sustain electrode $I_1, I_2, I_3, I_4, \ldots, I_{m-1}, \ldots, I_{nm}$ and the discharge start address electrodes $J_{11}, J_{21}, \ldots, J_{n1}, \ldots, J_{nm}$ can be formed of a desired conductive film, e.g., a transparent film described later on such as an ITO film. In this case, since the ITO film has a high resistance value, in order to reduce the resistance value, the discharge sustain electrode $I_1, I_2, I_3, I_4, \ldots, I_{m-1}, I_m$ and the discharge start address electrodes $J_{11}, J_{21}, \ldots, J_{n1}, \ldots, J_{nm}$ are formed on the discharge sustain electrodes $I_1, I_2, I_3, I_4, \ldots, I_m$ corresponding to bus electrodes $K_1$, K2, $K_3$, $K_4$, . . ., Km for reducing the resistance value and the discharge start address electrodes $J_{11}, J_{21}, \ldots, J_{n1}, \ldots, J_{nm}$ corresponding to bus electrodes $K_{11}, K_{21}, \ldots, K_{n1}, \ldots, K_{nm}$, respectively.

Since the address electrodes $J_1, J_2, J_3, \ldots, J_n$ are made of a metal material such as silver or the like and hence have low resistance values, no bus electrode is provided on the address electrodes $J_1, J_2, J_3, \ldots, J_n$.

Moreover, a dielectric layer 40 is formed on an entire surface including the address electrodes $J_1, J_2, J_3, \ldots, J_n$.

A magnesium oxide (MgO) film 41 serving to lower a discharge start voltage is formed as a protective film on a surface of the dielectric layer 40. In this case, in order to prevent the magnesium oxide layer 41 from discharging electricity to the address electrodes $J_1, J_2, J_3, \ldots, J_n$, it is desirable to form the magnesium oxide layer 41 on the surface of the dielectric layer 40 except on the stripe address electrodes $J_1, \ldots, J_n$.

Though not shown, in consideration of decrease of a thickness of a dielectric layer, an insulating layer may be formed on the stripe address electrodes $J_1, J_2, J_3, \ldots, J_n$ without the dielectric layer 40 being formed, the magnesium oxide layer 41 being formed on the surface of the dielectric layer 37.

Figure 10:
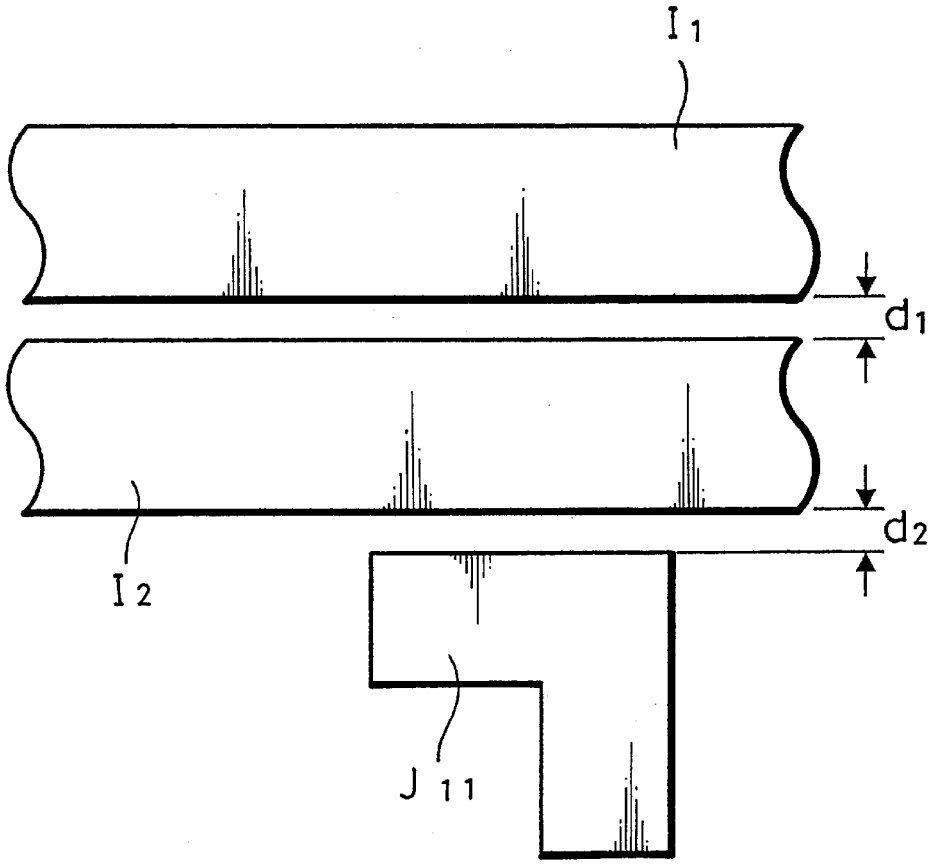
FIG. 10 is a plan view used to explain a distance between a discharge sustain electrode and a discharge start address electrode.

As shown in FIG. 10, a distance $d_1$ between a pair of discharge sustain electrodes and a distance $d_2$ between one discharge sustain electrode thereof and the discharge start address electrode opposed thereto are set substantially equal to each other (i.e., set equal to each other or approximate to each other).

While FIG. 10 shows the distance $d_1$ between a pair of discharge sustain electrodes $I_1$ and $I_2$ and the distance $d_2$ between the one discharge sustain electrode $I_2$ thereof and the discharge start address electrode $J_{11}$, opposed thereto, the distance $d_1$ between a pair of discharge sustain electrodes in other unit discharge regions and the distance $d_2$ between one discharge sustain electrode thereof and the discharge start address electrode opposed thereto in other unit discharge regions are set under the similar conditions.

The distance $d_2$ between one of the pair of discharge sustain electrodes and the discharge start address electrode can be set within the range of ±30% of the distance $d_1$ between the pair of the discharge sustain electrodes.

In this case, as expressed by the following equation (1), according to a Paschen's law, a pressure of filled gas described later on must be set so that a product of a pressure P of the filled gas and the distance d between the discharge electrode should be constant.

$$Pd = \text{constant value} \quad (1)$$

If the pressure P of the filled gas is constant, then the distance $d_2$ can be set within the range of ±30% of a distance determined by a minimum value of a Paschen curve.

If the discharge start voltage is selected to a minimum value of the paschen curve, then the distance $d_1$ between the electrodes and the distance $d_2$ between the electrodes can be set within the tolerance range of ± about several ten % of the distance d determined by this selection. Even if the discharge start voltage is selected to a value other than a minimum value of the paschen curve, then the distance $d_1$ between the electrodes and the distance $d_2$ between the electrodes can be set within the tolerance range of ±about 30% of the distance $d_1$ determined by this selection.

The distance $d_1$ between each pair of discharge sustain electrodes $I_1$ and $I_2$, $I_3$ and $I_4$, . . . , $I_{m-1}$ and $I_m$ can be set to 50 $\mu$m or smaller, e.g., 5 $\mu$m to 20 $\mu$m and further 5 $\mu$ or smaller or 1 $\mu$m or smaller. The distance $d_2$ is determined depending upon the value of the distance $d_1$.

A total film thickness $t_1$ of films serving as a dielectric layer, i.e., the dielectric layers 37 and 40 and the MgO film 41 can be set smaller as compared with the distance $d_1$ between a pair of discharge sustain electrodes formed on the same surface and the distance $d_2$ between one of the pair of the discharge sustain electrodes and the discharge start address electrode formed on the same surface.

Figure 11A:
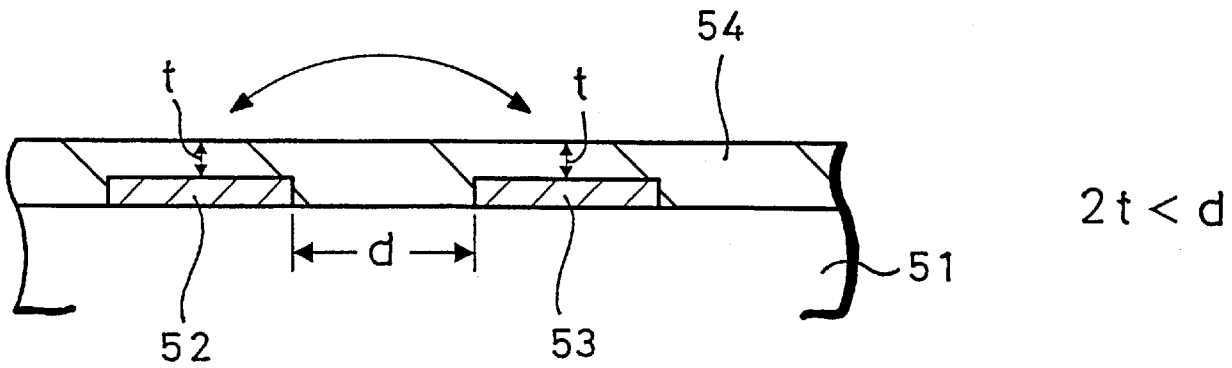
FIGS. 11A and 11B are diagrams used to explain a relationship between the distance between the discharge electrodes and a thickness of a dielectric layer.

Specifically, as shown in FIG. 11A, when a pair of discharge electrodes 52, 52 are formed on a substrate 51 and a dielectric layer 54 is formed on the discharge electrode 52 and 53, if a distance between the discharge electrodes 52 and 53 is d, a thickness of the dielectric layer 54 on each of the discharge electrodes 52, 53 is t and 2t<d is satisfied, then discharge between the discharge electrodes 52 and 53 is produced above the dielectric layer 54.

Figure 11B:
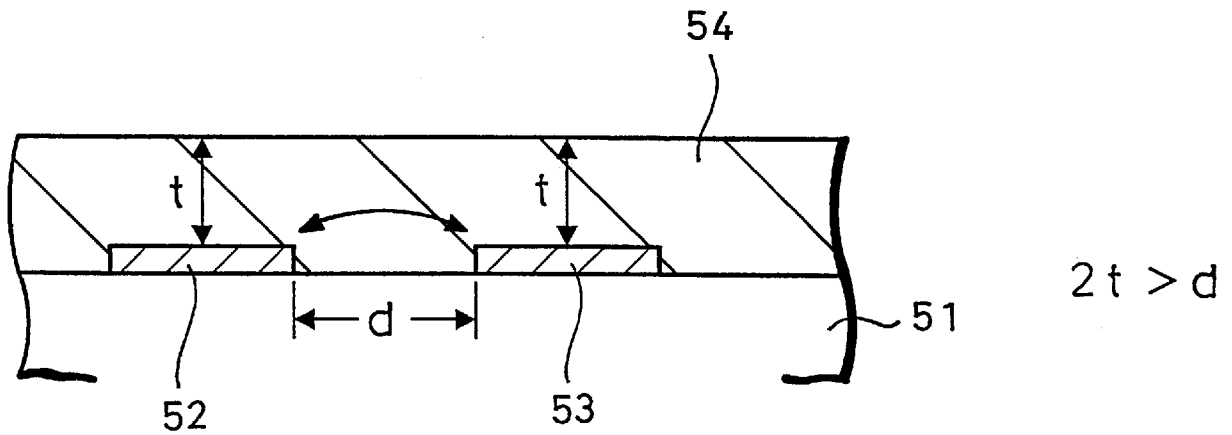

As shown in FIG. 11B, if the thickness of the dielectric layer 54 is large and 2t>d is satisfied, then the discharge between the discharge electrodes 52 and 53 is produced in the dielectric layer 54, which leads to puncture between the discharge electrodes 52 and 53. Therefore, in this embodiment, the total film thickness $t_1$ of the dielectric layers 37 and 40 and the Mgo film 41 is set smaller as compared with the distance $d_2$ and the distance $d_1$, i.e., set so as to satisfy $2t_1<d_2$ and $2t_1<d_1$.

Figure 12:
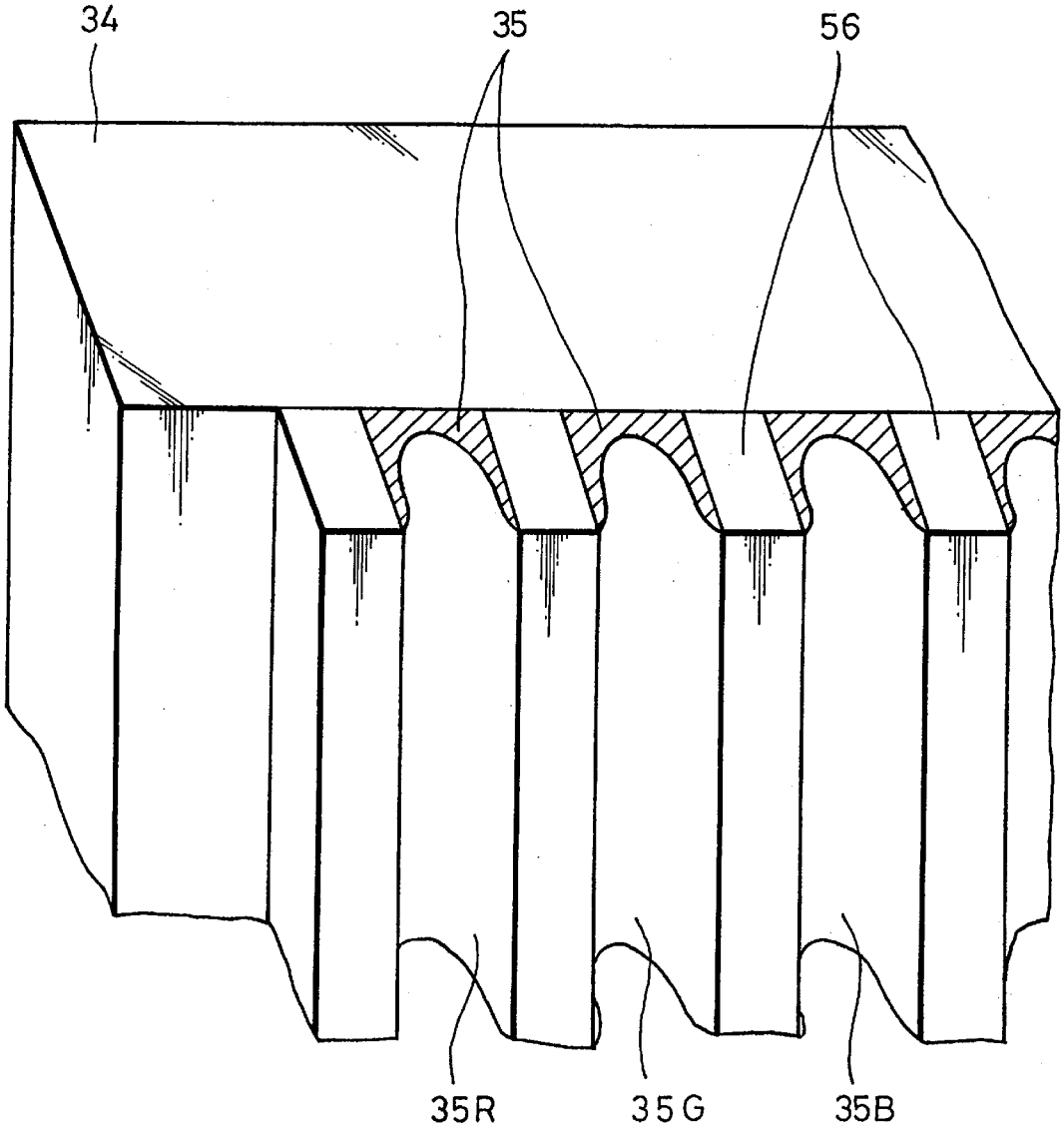
FIG. 12 is a perspective view showing a structure of a phosphor surface according to the first embodiment of the present invention.
Figure 13:
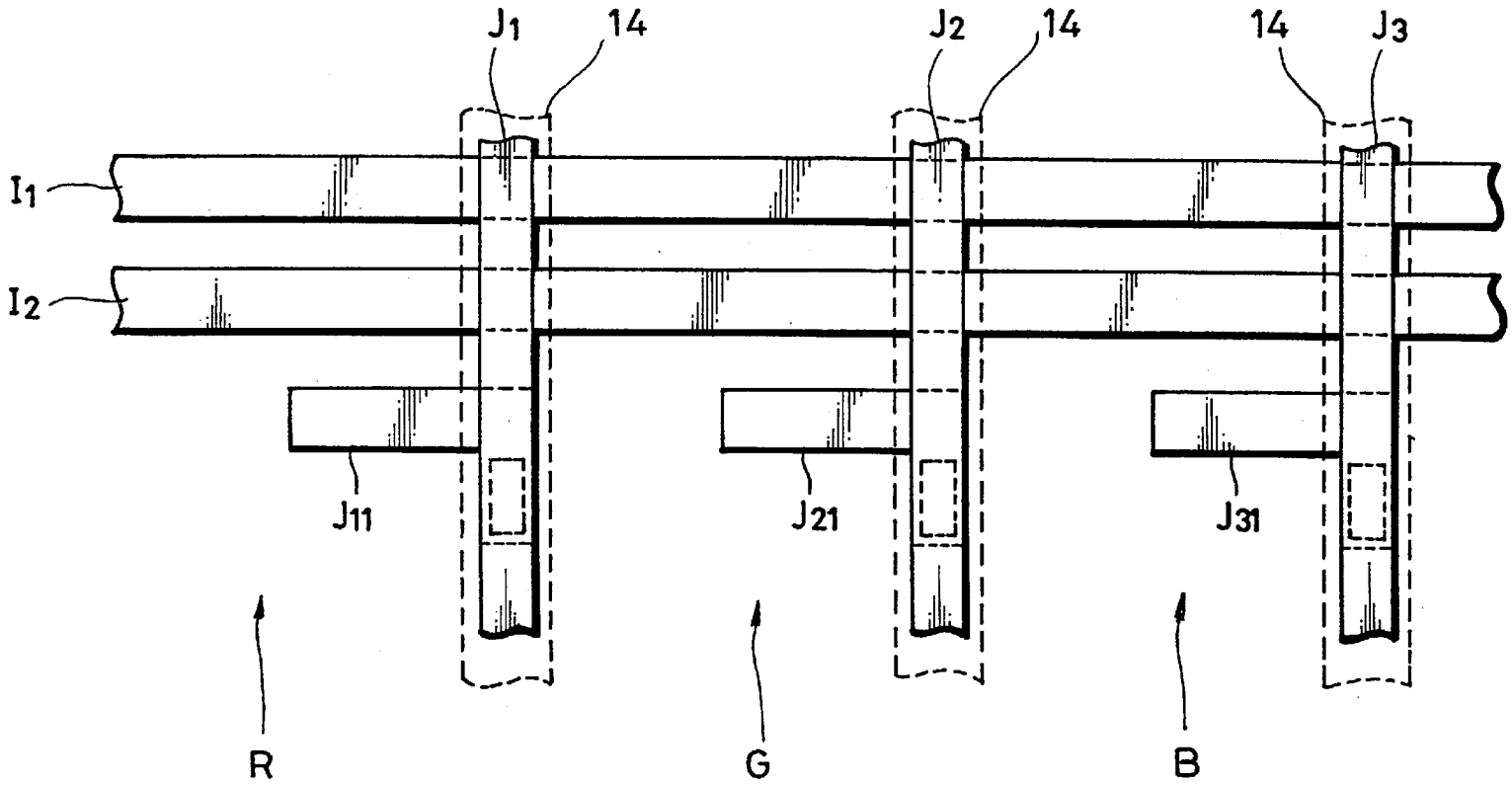
FIG. 13 is a plan view showing a discharge region of one pixel according to the first embodiment of the present invention.

As shown in FIGS. 7 and 12, a plurality of stripe barrier ribs 56 are integrally formed on the upper-surface glass substrate 34 serving as the second substrate is so as to partition respective adjacent columns of the unit discharge regions. The phosphor layer 35 is deposited between the adjacent ribs 56. Specifically, A phosphor layer 35R for red (R), a phosphor layer 35G for green (G), and a phosphor layer 35B for blue (B) are repeatedly formed. As shown in FIGS. 7 and 13, the barrier rib 56 is formed so that its width should be wider than a width of each of the address electrodes $J_1, \ldots, J_n$.

The phosphor substrate 36 having the upper-surface glass substrate 34 and the phosphor layer 35 formed on the upper-surface glass substrate 34 and the electrode substrate 33 having the discharge sustain electrode group, the address electrode group and the discharge start address electrode group formed on the lower-surface glass substrate 32 are sealed with the respective barrier ribs 56 of the phosphor substrate 36 being positioned on the address electrodes $J_1, J_2, \ldots, J_n$ off the electrode substrate 33. Desired gas is filled in a tightly sealed vessel formed of the phosphor substrate 36 and the electrode substrate 33, i.e., in the internal discharge space.

Gas of one kind or more of He, Ne, Ar, Xe, Kr can be employed as gas to be filled. Penning gas formed of mixed gas of argon (Ar)/xenon (Xe) or the like is mainly employed. Ultraviolet rays generated by plasma discharge excites the RGB phosphor layers 35R, 35G, 35B, thereby the RGB phosphor layers 35R, 35G, 35B emitting light of respective colors.

The barrier ribs 56 can have black surfaces for improving contrast presented when the display is carried out.

FIG. 13 shows a color discharge region of one pixel formed of the three-color unit discharge regions for red (R), green (G), and blue (B).

An operation of the above-mentioned display apparatus 31 will be described. When a discharge sustain voltage for sustaining the discharge is applied between the pair of discharge sustain electrodes $I_1$, and $I_2$, for example, and a discharge start voltage for starting the discharge which is higher than the discharge sustain voltage is applied through the address electrode $J_1$ between the one discharge sustain electrode 12 and the discharge start address electrode $J_1$l, the discharge between the one discharge sustain electrode $I_2$ and the discharge start address electrode $J_{11}$, starts and thereafter the discharge between the pair of discharge sustain electrodes $I_1$ and $I_2$ is sustained. The discharge between the discharge sustain electrodes $I_1$ and $I_2$ generates plasma, and then ultraviolet rays generated from the plasma excites the corresponding portions of the phosphor layers 35 (35R, 35G, 35B), thereby the portions emitting light. Accordingly, when the discharge start voltage is selectively and successively applied to the address electrode $J_1$, $J_2$, . . . , Jn and the discharge sustain voltage is successively applied to the pair of discharge sustain electrodes $I_1$ and $I_2$, $I_3$ and $I_4$, . . . , $I_{m-1}$ and $I_m$, a desired color display can be obtained.

Specifically, ultraviolet rays generated by plasma discharge are irradiated on the three-color phosphor layers 35R, 35G, 35B for red (R), green (G), blue (B) each provided between the adjacent barrier ribs 56, 56 in the discharge region of one pixel (see FIGS. 7 and 13), and then the phosphor layers 35R, 35G, 35B emit light of respective colors. Thus, the color display is carried out.

The address electrodes $J_1$, . . . , $J_n$ is applied with a pulse used for emitting light at a pixel of a predetermined address position, which permits commencement of the discharge between the discharge start address electrode $J_{11}$, . . . , $J_{nm}$ of the pixel of this position and the one discharge sustain electrodes $I_2$, $I_4$, . . . , $I_m$ thereof.

A display presented by the display apparatus 31 can be seen from the electrode substrate 33 side or from the phosphor substrate 36 side. Accordingly, at least the substrate through which the display is seen is formed of a transparent substrate.

When a display is seen from the electrode substrate 33 side, it is desirable to form the discharge sustain electrodes $I_1$, $I_2$, . . . , $I_n$ and the discharge start address electrodes $J_{11}$, $J_{12}$, . . . , $J_{nm}$ of a transparent, conductive film. The substrate 34 on the phosphor substrate 36 side needs not to be formed of a transparent substrate. In order to obtain more satisfactory luminance, it is preferable that an opening portion is large as much as possible.

When a display is seen from the phosphor substrate 36 side, the substrate 34 is formed of a transparent substrate. The substrate 32 of the electrode substrate 333 side needs not to be formed of a transparent substrate. It is preferable that the discharge sustain electrodes $I_1$, $I_2$, . . . , $I_n$ and the discharge start address electrodes $J_{11}$, $J_{12}$, . . . , $J_{nm}$ are formed of metal, such as aluminum or the like, which has low resistance and reflects light in order to lower an electrode resistance and obtain satisfactory luminance.

A method of manufacturing the above display apparatus will be described by way of example.

FIGS. 14 to 19 show processes of manufacturing the electrode substrate 33.

Figure 14B:
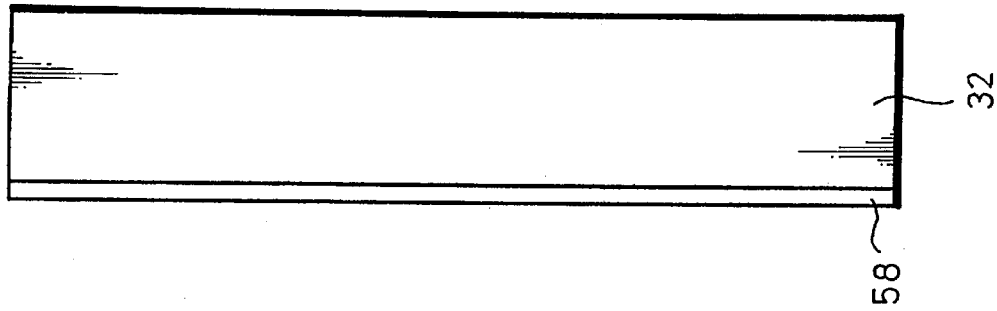
Figure 14A:
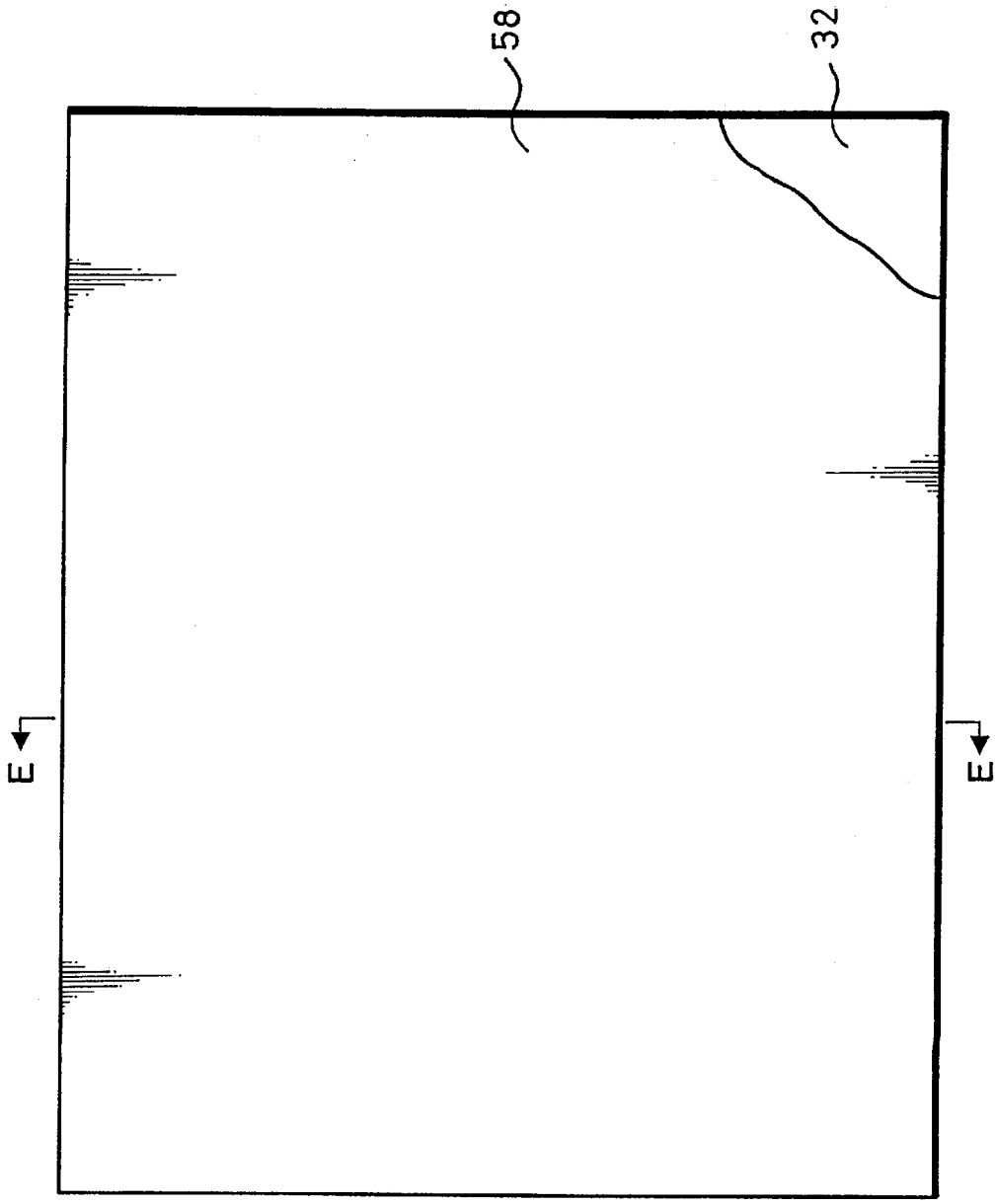

As shown in FIGS. 14A and 14B, a transparent, conductive film 58 such as an ITO ($In_2O_3/SnO_2$), a tin oxide film ($SnO_2$) or the like, e.g., an ITO film in this embodiment is deposited on one surface of the first substrate, e.g., the glass substrate 32.

Figure 15B:
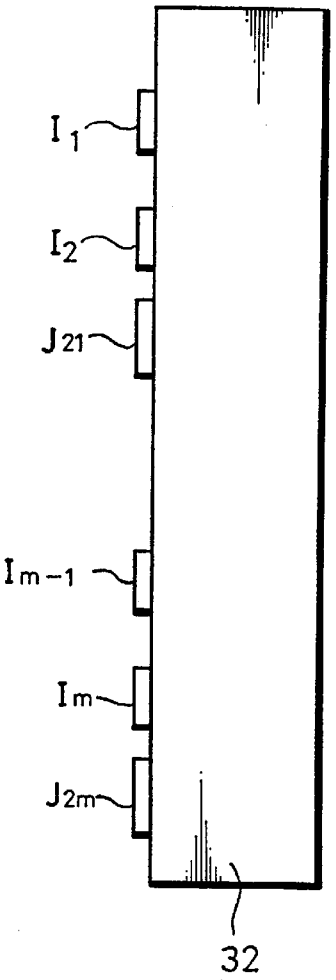
Figure 15A:
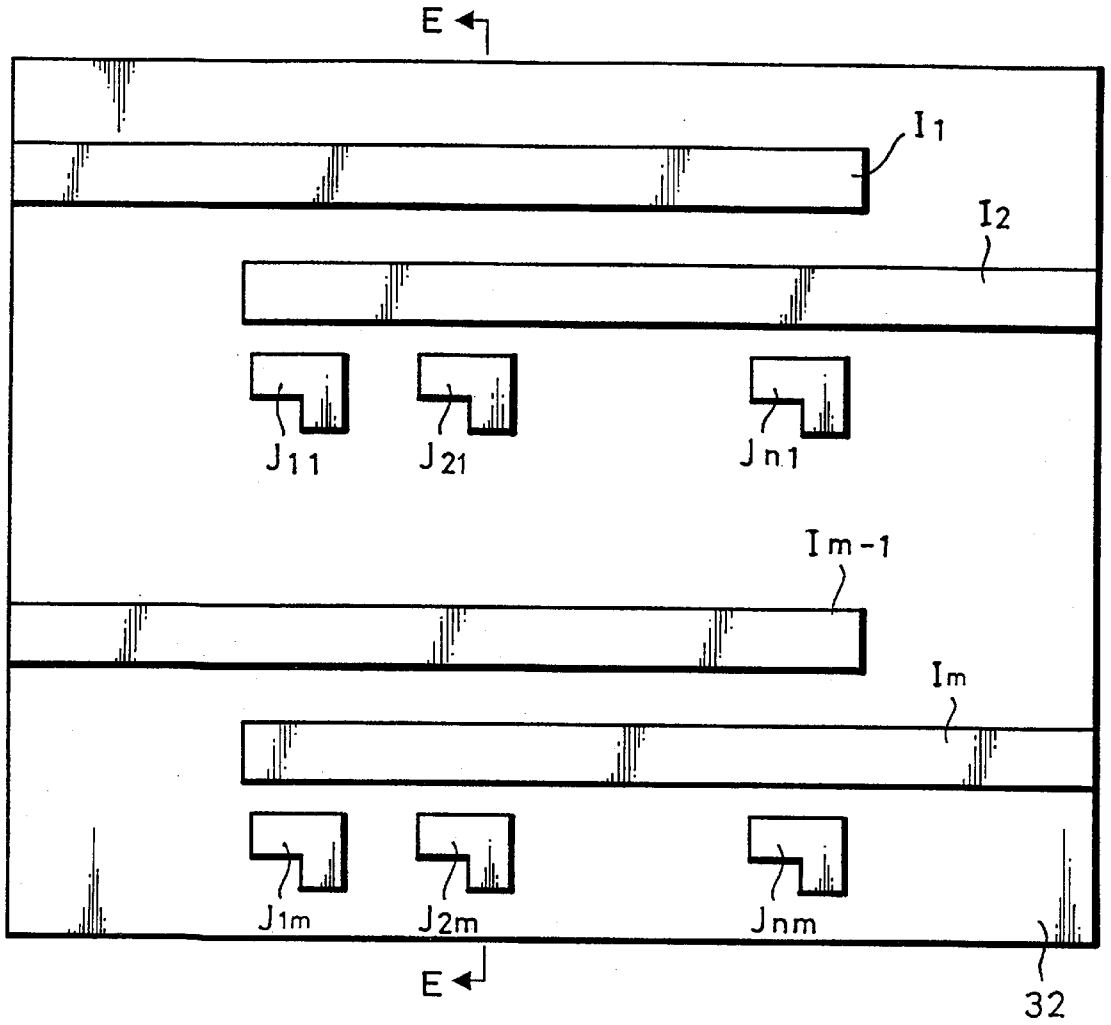

As shown in FIG. 15A, 15B, the transparent and conductive film 58 is subjected to the patterning, thereby the respective pairs of discharge sustain electrodes $I_1$ and $I_2$, $I_3$ and $I_4$, . . . , $I_{m-1}$ and $I_m$ and the discharge start address electrodes $J_{11}$, , $J_{12}$, . . . , $J_{nm}$ being formed.

The above discharge sustain electrodes $I_1$ and $I_2$, $I_3$ and $I_4$, . . . , $I_{m-1}$ and $I_m$ and the above discharge start address electrodes $J_{11}$, $J_{12}$, . . . , $J_{nm}$ formed of the transparent and conductive film 58 are formed by the following etching method or the following lift-off method.

(1) Processes of forming the electrodes by the etching methods includes
  (i) a step of forming the ITO film formed of the transparent and conductive film 58 on an entire surface of the glass substrate 32 (generally the $SnO_2$ film is no used because it is hardly etched),
  (ii) a step of forming a negative pattern of the electrodes on the ITO film with a resist, and
  (iii) a step of removing the ITO film on portions which are not covered with the resist by etching process using hydrochloric acid or the like.

(2) Processes of forming the electrodes by the lift-off methods includes
  (i) a step of forming a negative pattern of the electrodes on the ITO film with a resist,
  (ii) a step of forming the ITO film on an entire surface of the glass substrate 32 including its portion on the negative pattern of the resist by sputtering, evaporation or the like, and
  (iii) a step of removing both the resist and the ITO film on the resist by a resist peeling agent.

Figure 16B:
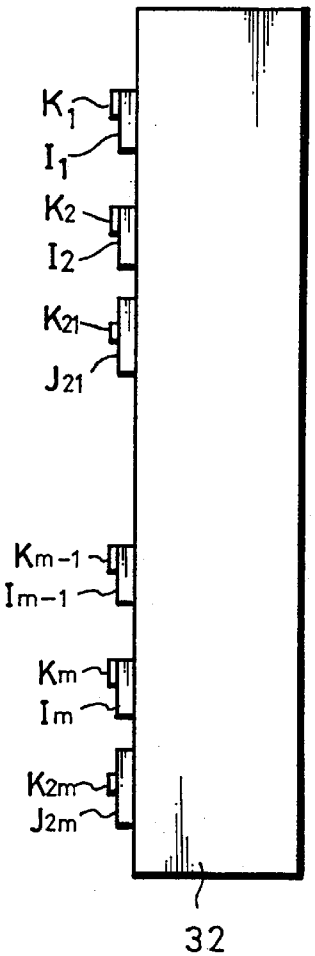
Figure 16A:
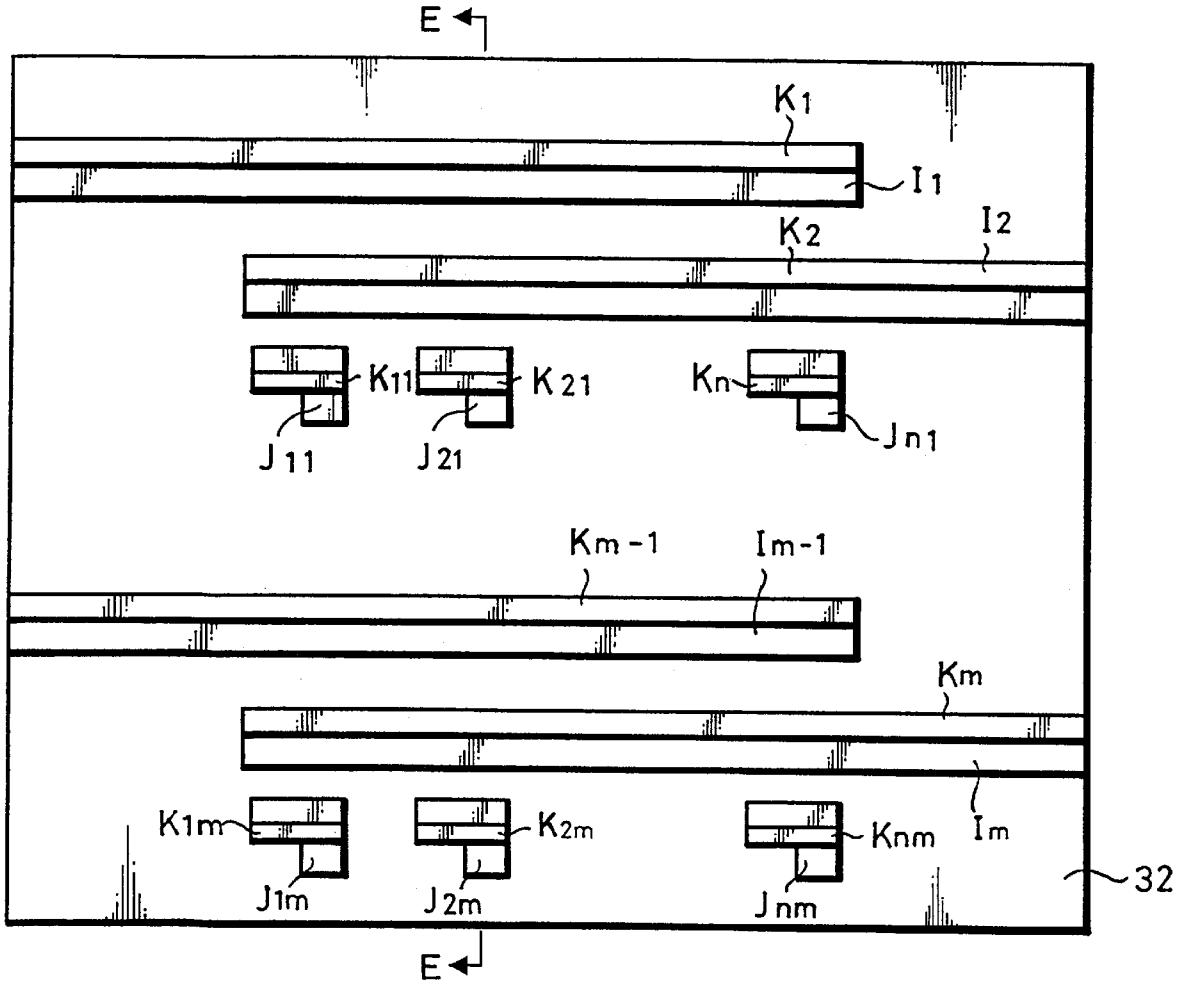

As shown in FIGS. 16A and 16B, on the discharge sustain electrodes $I_1$, $I_2$, . . . , $I_m$ and the discharge start address electrodes $J_{11}$, . . . , $J_{nm}$, low-resistance bus electrodes K ($K_1$, . . . , $K_m$, $K_{11}$, . . . , $K_{nm}$) used for lowering resistances of these electrodes are formed.

The bus electrodes K ($K_1$, . . . , $K_m$, $K_{11}$, . . . , $K_{nm}$) can be formed of low-resistance metal so as to be stripe with having widths smaller than those of the discharge sustain electrodes $I_1$, $I_2$, . . . , $I_m$ and the discharge start address electrodes $J_{11}$, . . . , $J_{nm}$, or can be formed by a screen printing using a conductive paste similarly. A conductive paste used when the bus electrodes K ($K_1$, . . . , $K_m$, $K_{11}$, . . . , $K_{nm}$) are formed by the screen printing is a conductive paste made of silver (Ag), silver-palladium (Ag-Pd), nickel (Ni) or the like.

Figure 20:
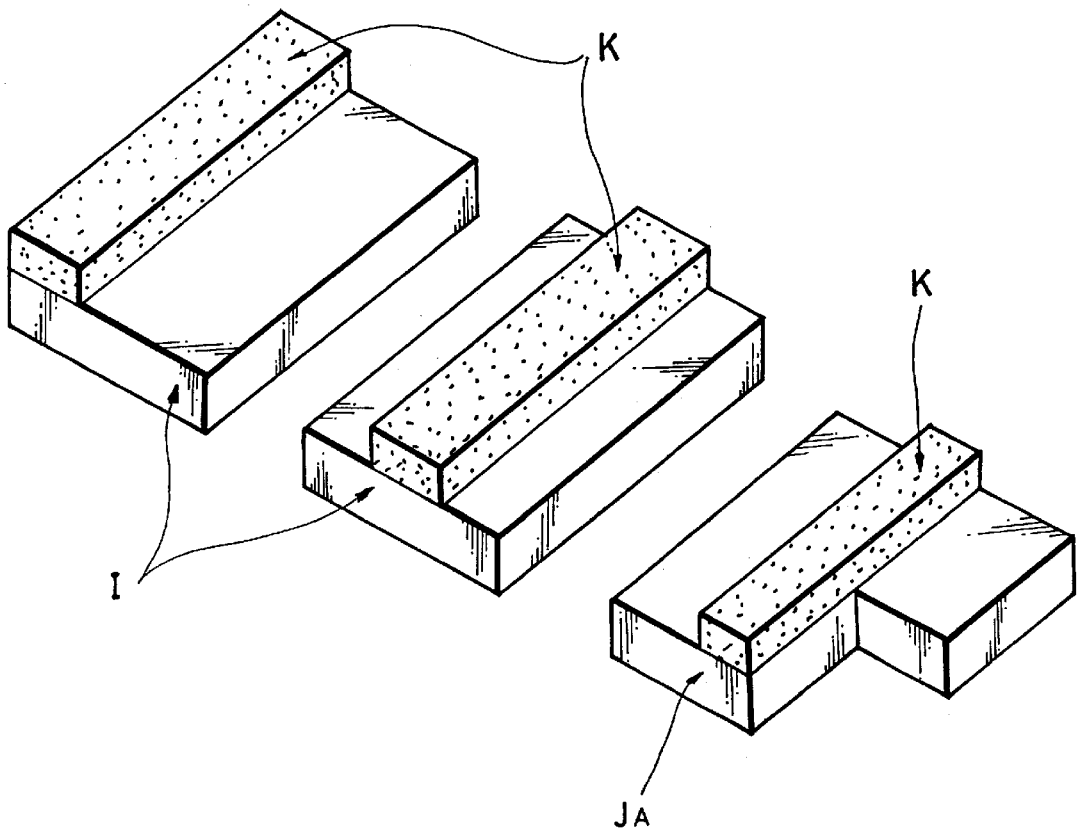
FIG. 20 is a perspective view showing an arrangement of a bus electrode according to the first embodiment of the present invention.

FIG. 20 shows a pattern in which the bus electrodes K ($K_1$, . . . , $K_m$, $K_{11}$, . . . , $K_{nm}$) are formed. The bus electrodes K ($K_1$, . . . , $K_m$, $K_{11}$, . . . , $K_{nm}$ ) are formed with overlapping on one side end portion or a center portion, in the electrode width direction, of the discharge sustain electrodes I and the discharge start address electrodes $J_A$ in the longitudinal direction. Silver Ag or a material having a trilayer structure of copper Cu/chromium Cr/copper Cu may be employed as a material for the bus electrodes K.

Figure 17B:
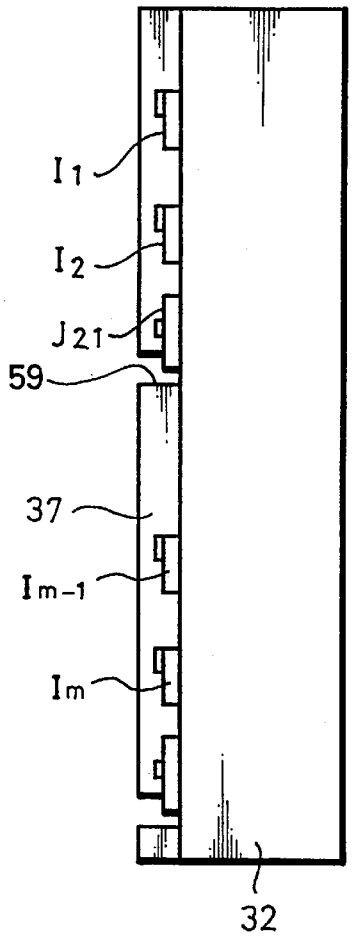
Figure 17A:
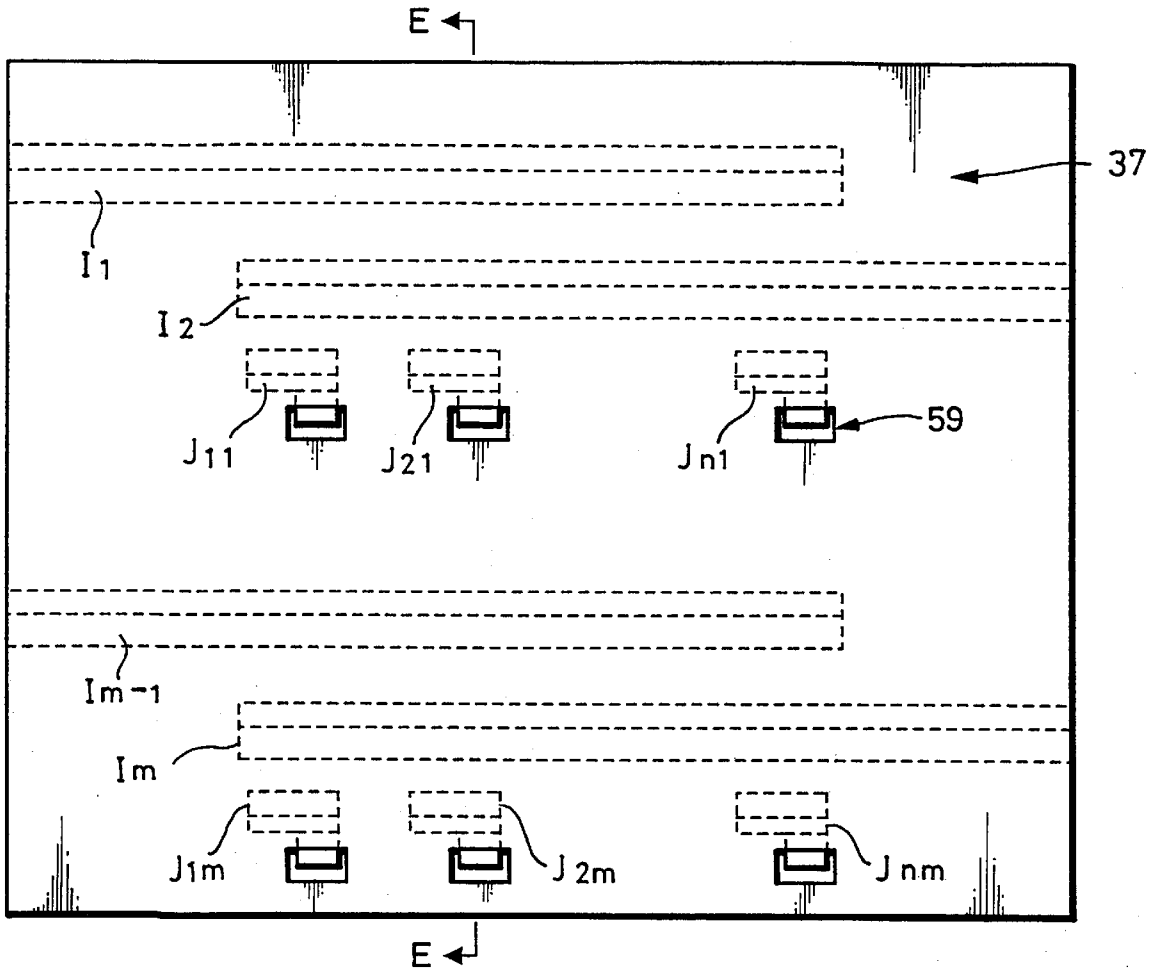

As shown in FIGS. 17A and 17B, the dielectric layer 37 is formed on the substrate 32 and also on the discharge sustain electrodes $I_1$, $I_2$, . . . ,$I_{m-1}$, $I_m$ and the discharge start address electrodes $J_{11}$, . . . , $J_{nm}$ and particularly on a region other than terminal portions.

A resist film having opening portion at its position corresponding to parts of the discharge start address electrodes $J_{11}$, $J_{21}$, . . . , $J_n$, . . . , $J_{nm}$ is deposited on an entire surface including a surface of the dielectric layer 37. Calcium Carbonate $CaCO_3$ having a mean particle size of 20 to 30 $\mu$m are injected with high pressure onto the resist film by sandblasting, thereby contact apertures 59 being formed at positions corresponding to parts of the discharge start address electrodes $J_{11}$, , $J_{21}$ , . . . , $_{n1}$, . . . , $J_{nm}$.

The dielectric layer 37 can be formed of a glass paste. The dielectric layer 37 must be formed of a material which is as transparent as possible and has a high permittivity and which, in view of resistance to high voltage, further prevents a pinhole from being easily produced.

Figure 18B:
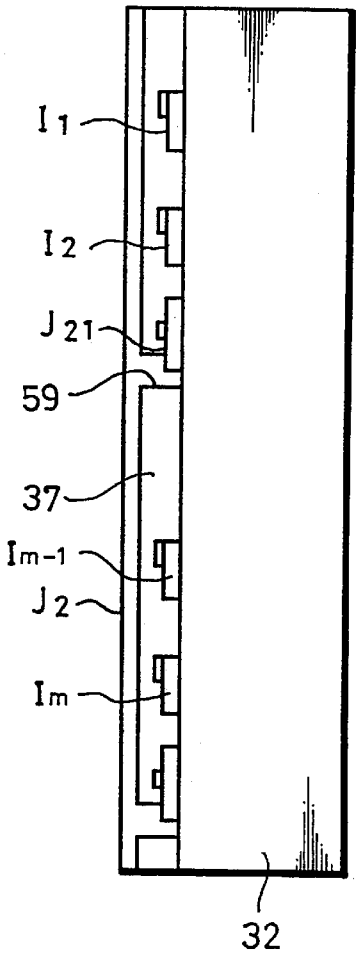
Figure 18A:
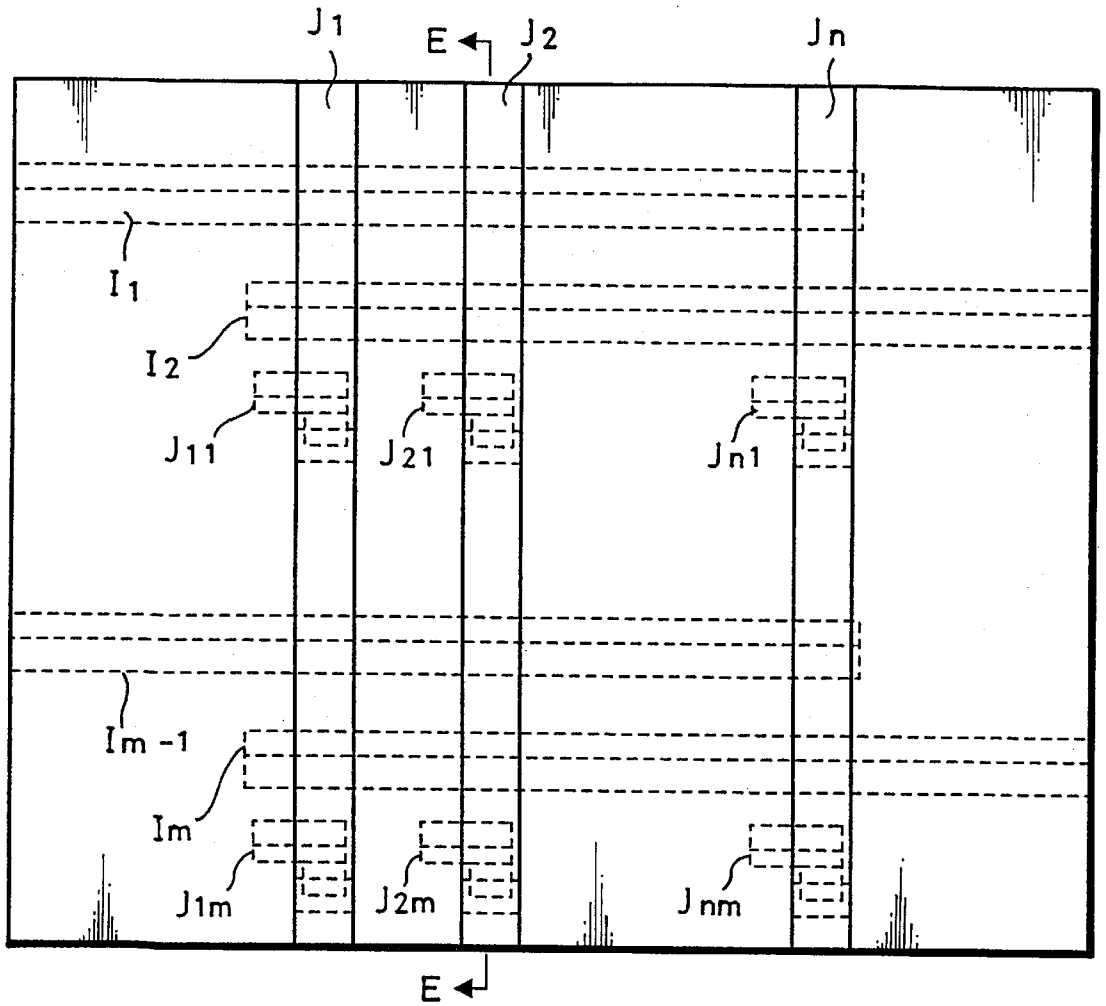

As shown in FIGS. 18A and 18B, the address electrodes $J_1$, . . . , $J_n$ are formed on the dielectric layer 37 so as to be partially inserted through the contract apertures 59. At the same time when the address electrodes $J_1$, . . . , $J_n$ in are formed, the address $J_1$, . . . , $J_n$ in are connected to the corresponding discharge start address electrodes $J_{11}$, $J_{21}$, . . . , $J_{n1}$, . . . , $J_{nm}$ through the contact apertures 59. The address electrodes $J_1$, . . . , $J_n$ can be formed by Al evaporation or the printing using various kinds of conductive pastes used when the above bus electrodes K are formed. Alternatively, the address electrodes $J_1$, . . . , $J_n$ can be formed by a photosensitive silver paste. IN this case, since the address electrodes $J_1$ , . . . , $J_n$ have low resistances, it is unnecessary to provide the bus electrodes.

Figure 19B:
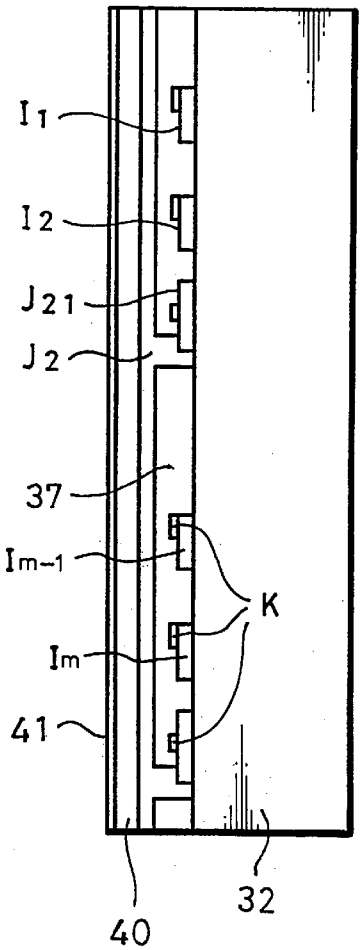
Figure 19A:
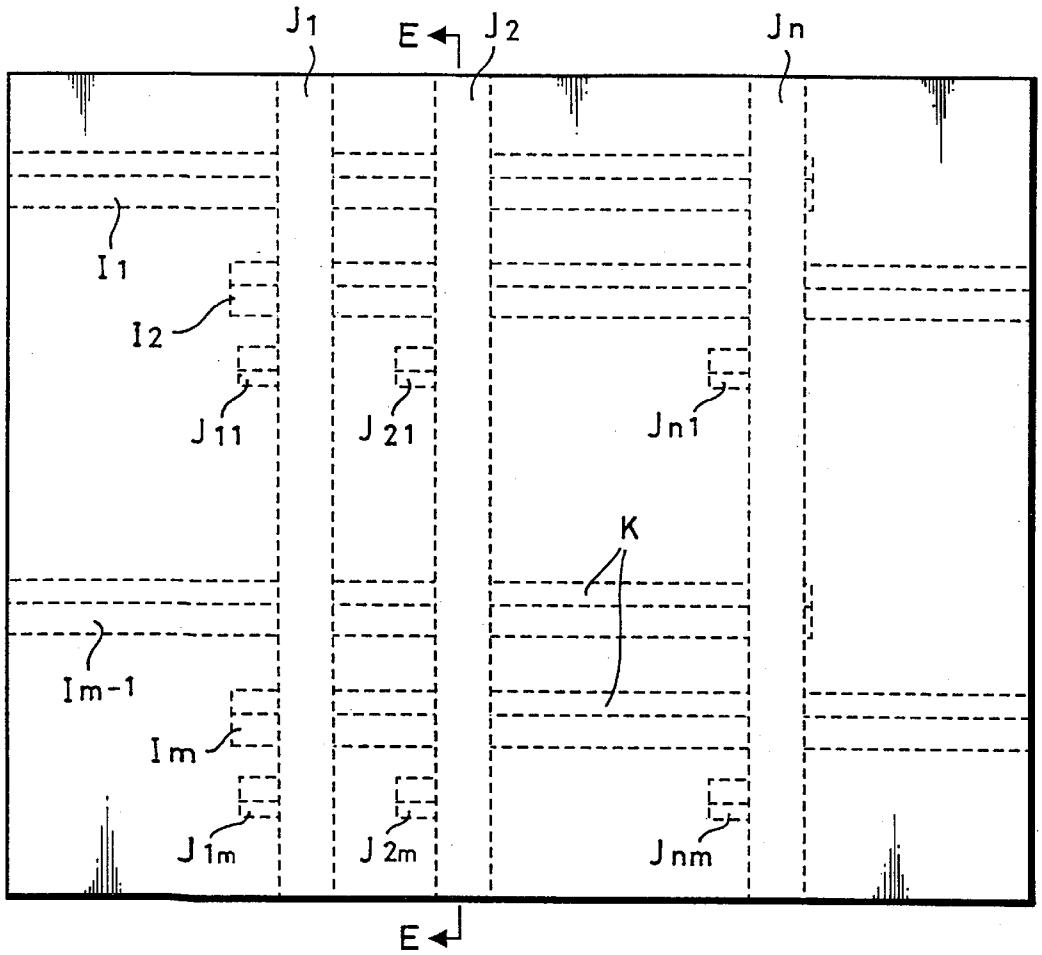

As shown in FIGS. 19A and 19B, the dielectric layer 40 is formed on an entire surface including surfaces of the address electrodes $J_1, \ldots, J_n$. The dielectric layer 40 can be formed of a glass paste similar to that used for the dielectric layer 37. The magnesium oxide (MgO) film 411 is deposited on a surface of the dielectric layer 40.

Though not shown, the MgO film 41 can be formed on the dielectric layer 40 except its portions corresponding to the address electrodes $J_1, \ldots, J_n$.

Thus, the electrode substrate 33 is manufactured.

The phosphor substrate 36 is manufactured as follows.

The stripe barrier ribs 56 are formed of a glass paste on the second substrate, e.g., the glass substrate 34 by screen printing or sandblasting. The barrier ribs 56 separates the unit discharge regions of the discharge sustain electrodes I in the longitudinal direction, thereby preventing crosstalk between adjacent unit discharge regions and holding insulation therebetween. The barrier ribs 56 secures the plasma discharge space by keeping an interval between the first substrate 32 side and the second substrate 34 side. The barrier ribs 56 must be processed with high accuracy.

The corresponding phosphor layers 35R, 35G, 35B for red (R), green (G), and blue (B) are formed between the adjacent barrier ribs 56 by coating. It is possible to employ as a phosphor material a commercially available PDP phosphor which is excited by ultraviolet rays generated by the plasma discharge to thereby emit light.

Thus, the phosphor substrate 36 is manufactured.

The electrode substrate 333 and the phosphor substrate 36 thus manufactured are positioned so that the respective barrier ribs 56 of the phosphor substrate 36 should be matched with positions of the address electrodes $J_1, \ldots, J_n$, and their peripheries except the terminal portions are tightly sealed. Vacuum is produced in the discharge space in the tightly sealed vessel., and then discharge gas such as the above-mentioned Penning gas or the like is filled therein and then a chip-off process is carried out. Then, a target display apparatus 31 is obtained.

According to the above display apparatus 31, since the discharge sustain electrode group I ($I_1, I_2, \ldots, I_m$), the discharge start address electrode group $J_A$ ($J_{11}, J_2, \ldots, J_{nm}$) and the address electrode group J ($J_1, J_{2\ 1}, \ldots, J_n$) are formed on the same substrate, i.e., the first substrate 32 and the phosphor layer 35 is formed on the second substrate 34 opposed to the first substrate 32, even if the distances $d_1$ between the pairs of discharge sustain electrodes $I_1$ and $I_2$, $I_3$ and $I_4, \ldots, I_{m-1}$ and $I_m$ and the distances $d_2$ between the discharge start address electrode $J_{11}, \ldots, J_{nm}$ and the one discharge sustain electrodes $I_2, I_4, \ldots, I_m$ become smaller, it is possible to secure the plasma discharge space by the barrier ribs 56 formed on the side of the substrate 34. Specifically, since the phosphor layer 35 can be formed at a positions away from the plasma, the plasma generated by the discharge is prevented from being brought in contact with the phosphor layer 35. Consequently, the charged particles in the plasma are prevented from impinging on the phosphor layer 35 and the phosphor layer 35 is prevented from being deteriorated. Therefore, it is possible to obtain the high-definition plasma display apparatus of a very thin type. Since the pairs of discharge sustain electrodes I and the discharge start address electrodes $J_A$ are simultaneously formed of the same conductive film on the same surface of the first substrate 32 by etching or lift-off, the distance $d_1$ between each pair of discharge sustain electrodes I and the distance $d_2$ between the discharge start address electrode $J_A$ and the one discharge sustain electrode I can be set precisely.

The discharge sustain electrodes I, the address electrodes J and the discharge start address electrodes $J_A$ forming a part of the address electrodes J are formed on the first substrate 32 side, the barrier ribs 56 and the phosphor layer 35 are formed on the second substrate 34 side, and then both of the substrates 32 and 34 are sealed to thus form the display apparatus 31. It is possible to precisely set positional relationship between electrodes. It is possible to position both the substrates 32 and 34 when they are sealed. The tolerance of an interval of a space can be set larger, which facilitates an electrode forming process, a sealing process and so on. Therefore, a yield of the display apparatus 31 is improved, and the manufacturing costs thereof can be reduced.

Especially, since the respective pairs of discharge sustain electrodes I and the discharge start address electrodes $J_A$ are formed of the same conductive film by patterning and hence the distances $d_1$ and $d_2$ between electrodes can be accurately set, light emission resulting from the discharge is prevented from being fluctuated due to error in assembling the electrode substrate 33 and the phosphor substrate 36.

Specifically, if the electrode substrate 33 and the phosphor substrate 36 are assembled with phosphor substrate 36 being inclined relative to the electrode substrate 33 and the intervals between the electrode and the phosphor layer in the unit discharge regions are not constant, then the distances $d_1$ and $d_2$ between electrodes are set constant in each of the unit discharge regions and hence the discharge condition can be set uniformly. Moreover, transmittance of ultraviolet light in the sealed gas is satisfactory. Therefore, without uneven brightness of the emitted light, it is possible to emit light with uniform brightness on the whole display region. Thus, the display apparatus 31 enjoys a practical advantage that it is easily manufactured.

Since the MgO film 41 serves to lower a work function, the discharge becomes easy if the MgO film 41 is formed on a surface of the dielectric layer 40, and further the discharge voltage can be reduced. When in the display apparatus 31 the MgO film 41 is formed only on the surface of the dielectric layer 40 on the discharge sustain electrodes $I_1, \ldots, I_m$ and the discharge start address electrodes $J_1, \ldots J_{nm}$ except the stripe address electrodes $J_1, \ldots, J_n$, it makes easy to generate the discharge between the discharge start address electrodes $J_{11}, \ldots, J_{nm}$ and the one discharge sustain electrodes $I_2$, $I_4, \ldots, I_m$ and the discharge between the pair of the pair of discharge sustain electrodes $I_1$, and $I_2$, $I_3$ and $I_4, \ldots, I_{m-1}$ and $I_m$, and at the same time it makes difficult to generate the discharge between the stripe address electrodes J and the discharge sustain electrodes I. Therefore, the crosstalk can be prevented.

Since each of the distances $d_1$ and $d_2$ can be set smaller, i.e., can be set to 50 $\mu$m or smaller, and 30 $\mu$m or smaller, e.g., 5 $\mu$m to 20 $\mu$m and further to 5 $\mu$m or smaller, and 1 $\mu$m or smaller, the display apparatus having higher definition can be obtained.

If each of the distances $d_1$ and $d_2$ can be set smaller, i.e., can be set to 50 $\mu$m or smaller, e.g., 5 $\mu$m to 20 $\mu$m and further to 5 $\mu$m or smaller, and 1 $\mu$m or smaller and then the pressure of the filled gas is set larger within the range from 0.8 to 3.0 atmosphere, consequently a large amount of ultraviolet rays are generated, which allows the phosphor layer 35 to emit light brightly.

If the distance $d_2$ between the discharge sustain electrodes I and the discharge start address electrodes $J_A$ is set within the range of ±30% of the distance $d_1$ between the pairs of discharge sustain electrodes, then the discharge start voltage can be smoothly and gently varied in response to the distance $d_2$, which improves a degree of freedom in setting a drive condition.

If both of the distances $d_1$ and $d_2$ between the electrodes are set within the range of ± several tens of % or ±30% , then it is possible to suppress fluctuation of the discharge voltage. Therefore, when the display apparatus 31 is manufactured, it is possible to form the discharge sustain electrodes $I_1, \ldots, I_m$ and the discharge start address electrodes $J_{11}, \ldots, J_{nm}$ with some tolerance.

When the discharge start address electrodes $J_{11}, \ldots, J_{nm}$ are formed so as to be L-shaped, a sufficient electrode length of its portion opposed to each of the one discharge sustain electrodes $I_2, I_4, \ldots, I_m$ can be secured, which facilitates commencement of the discharge between the one discharge sustain electrodes $I_2, I_4, \ldots, I_m$ and them.

Together with the above advantage, the discharge start address electrodes $J_{11}, \ldots, J_{nm}$ and the address electrodes $J_1, \ldots, J_n$ in can easily be connected to each other. Specifically, since the discharge start address electrodes $J_{11}, \ldots, J_{nm}$ are be L-shaped, the tolerance for the positional displacement of the contact aperture 59 in the longitudinal direction of the address electrodes $J_1, \ldots, J_n$, which facilitates connection between the discharge start address electrodes $J_{11}, \ldots J_{nm}$ and the address electrodes $J_1, \ldots, J_n$ and fabrication of the electrodes.

Since the address electrodes $J_1, \ldots, J_n$ are formed on the discharge sustain electrodes $I_1, \ldots, I_m$ through the insulating layer formed of the dielectric layer 37, the discharge sustain electrodes $I_1, \ldots, I_m$ and the address electrodes $J_1, \ldots, J_n$ crossing them are reliably insulated from each other, which prevents both of the electrodes from being short-circuited. Moreover, since the contact apertures 59 are provided through the insulating layer immediately under the address electrodes $J_1, \ldots, J_n$ and the address electrodes $J_1, \ldots, J_n$ and the discharge start address electrodes $J_{11}, \ldots, J_{nm}$ are connected to each other through the contact apertures 59, it is possible to integrally form the address electrodes $J_1, \ldots, J_n$ and the discharge start address electrodes $J_{11}, \ldots, J_{nm}$ with a simple structure and without reduction of an opening area of the unit discharge region.

Since the total thickness $t_1$ of the dielectric layers on the discharge sustain electrodes $I_1, \ldots, I_m$ and the discharge start address electrodes $J_{11}, \ldots, J_{nm}$, i.e., the dielectric layers 37, 40 and the MgO film 41 is set smaller than the distances $d_1$ and $d_2$ between the electrodes, it is possible to produce the discharge above the dielectric layers. Specifically, the discharge is prevented from being produced in the dielectric layers 32, 40 and hence the discharge can be produced above the dielectric layer without occurrence of puncture of insulation between pairs of discharge sustain electrodes or between the one discharge sustain electrode and the discharge start address electrode.

Since the barrier ribs 56 on the second substrate 34 side are provided at positions corresponding to the address electrodes $J_1, \ldots, J_n$ on the first substrate 32 side and further the width of the rib 56 is set wider than the width of each of the address electrodes $J_1, \ldots, J_n$, the opening of the unit discharge region can be made larger and the discharge directly to the address electrodes $J_1, \ldots, J_n$ is hardly generated, which can prevent the crosstalk. The barrier ribs 56 allows the discharge space to be sufficiently secured.

Since the distance $d_1$ between the pair of discharge sustain electrodes and the distance $d_2$ between the one discharge sustain electrode and the discharge start address electrode is set substantially equal to each other, after application of a high voltage commences the discharge between the discharge start address electrodes $J_{11}, \ldots, J_{nm}$ and the one discharge sustain electrodes $I_2, I_4, \ldots, I_m$, the discharge can be sustained between the pair of discharge sustain electrodes with a comparatively low voltage, which leads to a satisfactory display using light emission resulting from the discharge.

Since the plasma discharge space can be secured by the electrode substrate 33 and the phosphor substrate 36 having the barrier ribs 56 and the phosphor layer 35 opposed to the electrode substrate 33, sufficient ultraviolet rays are irradiated. Since the phosphor layer 35 is formed on the whole region between the adjacent barrier ribs 56, the phosphor layer 35 can have a wider area and the high-luminance display can be obtained.

As shown in FIGS. 18A and 18B, through the apertures formed through the dielectric layer 37, the stripe address electrodes $J_1, \ldots, J_n$ and the corresponding discharge start address electrodes $J_{11}, \ldots, J_{nm}$ are connected to each other, respectively. As described above, the contact aperture 59 is formed through a process for forming the dielectric layer 37 by coating, a process for subjecting the resist film to the patterning, and a process for forming an opening by sandblasting with using the patterned resist film as a mask. If the process for forming the aperture has includes more processes, e.g., three processes, then the sizes of the apertures 59 formed by sandblasting are fluctuated, and hence the address electrodes $J_1, \ldots, J_n$ and the discharge start address electrodes $J_{11}, \ldots, J_{nm}$ may be unstably connected.

Figure 21:
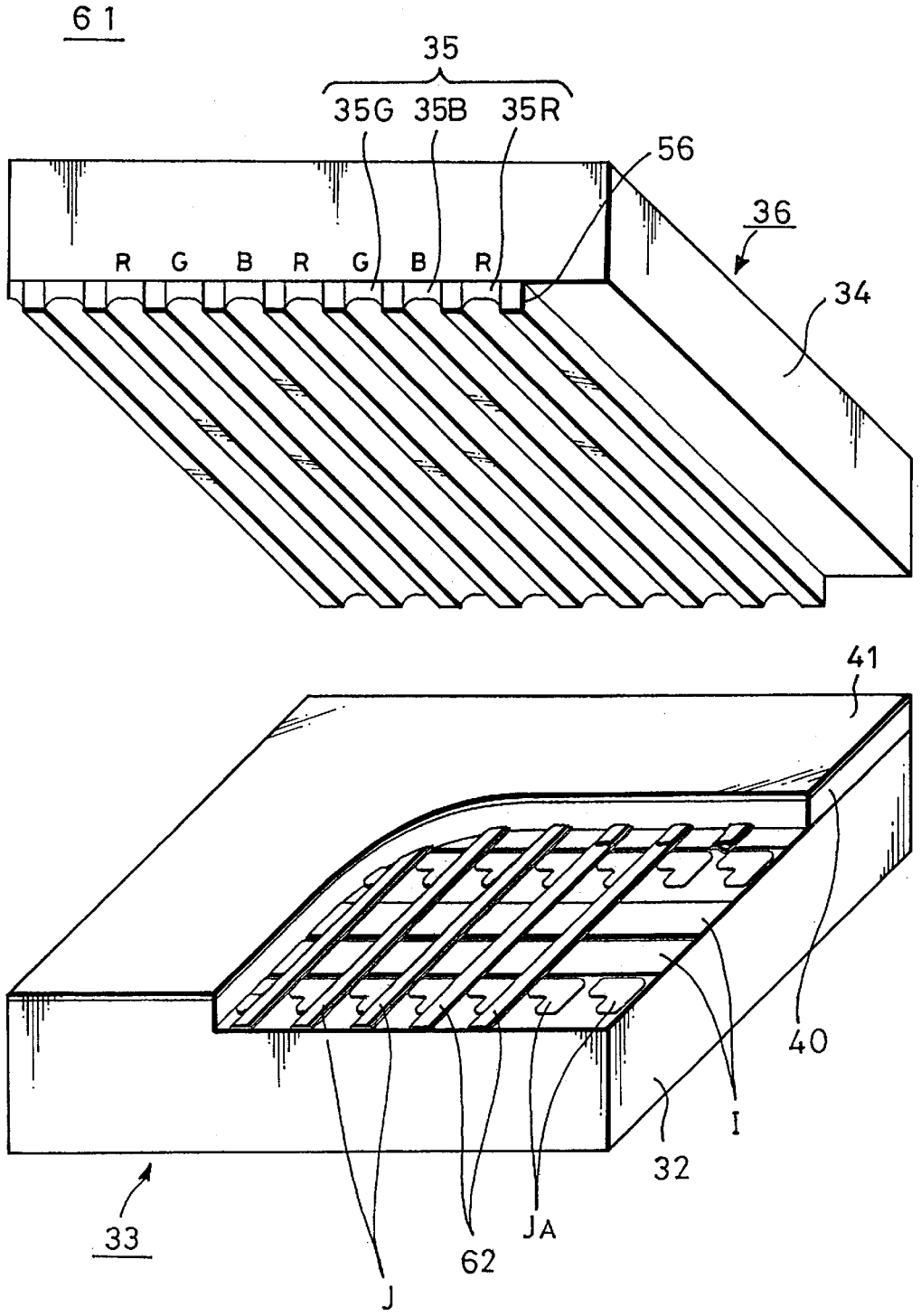
FIG. 21 is a diagram showing an arrangement of a display apparatus according to a second embodiment of the present invention.

FIG. 21 is a diagram showing a display apparatus according to the second embodiment of the present invention for solving the above problem.

A display apparatus 61 has a first substrate, e.g., a glass substrate 32 and has, similarly to the display apparatus 31, a discharge sustain electrode group formed of plural pairs of discharge sustain electrodes $(I_1, I_2), (I_3, I_4), \ldots, (I_{m-1}, I_m)$ and a plurality of L-shaped discharge start address electrodes ($J_{11}$, to $J_{n1}$), ($J_{12}$ to $J_{n2}$), . . . , ($J_{1m}$ to $J_{nm}$) formed between respective pairs of discharge sustain electrodes, i.e., between the discharge sustain electrodes $(I_1, I_2)$ and $(I_3, I_4), \ldots$, the discharge sustain electrodes $(I_{m-3}, I_{m-2})$ and $(I_{m-1}, I_m)$ at a constant interval in the longitudinal direction (X direction) of the discharge sustain electrodes.

The display apparatus 61 has stripe insulating layers 62 formed at positions corresponding to positions between the adjacent discharge start address electrodes, arranged in the direction X, and including portions on the discharge sustain electrodes $I_1, \ldots, I_m$ in the direction (direction Y) crossing the discharge sustain electrodes $I_1, \ldots, I_m$ at a right angle, for example, and address electrodes $J_1, \ldots, J_n$ formed on the corresponding stripe insulating layers 62. Parts of the address electrodes $J_1, \ldots, J_n$ are extended on the discharge start address electrodes $J_{11}, \ldots, J_{nm}$ along side surfaces of the insulating layers 62. These extended portions thereof are connected directly to the discharge start address electrodes $J_{11}, \ldots, J_{nm}$. Further, a dielectric layer 40 and an MgO film serving as a protective film for the dielectric layer 40 are formed on the entire surface including surfaces of the discharge sustain electrodes $I_1, \ldots, I_m$, the discharge start address electrodes $J_{11}, \ldots, J_{nm}$, and the address electrodes $J_1, \ldots, J_n$.

A plurality of stripe barrier ribs 56 extended in the direction Y similar to those of the first embodiment are integrally formed at a constant interval on s second substrate, e.g., a glass substrate 34. Phosphor layers 35, i.e., phosphor layers 35R, 35G and 35B for red (R), green (G), blue (B) are successively formed on portions between respective adjacent barrier ribs 56. Thus, the phosphor substrate 36 is formed.

Both of the substrates 33 and 36 are tightly sealed at their peripheries so that the barrier ribs 56 of the substrate 36 and the address electrodes $J_{11}, \ldots, J_n$ of the substrate 33 should correspond each other. Desired discharge gas is filled in the tightly sealed in the tightly sealing vessel as described above.

While in FIG. 21 the MgO film 41 is formed on the entire surface of the dielectric layer 40, the present invention is not limited thereto and the MgO film 41 can be formed on the entire surface thereof other than its portion on the address electrodes J as described above.

Other arrangements (electrode materials, distance $d_1$ and $d_2$ between electrodes, kind of filled gas, gas pressure, thickness of a dielectric layer, and so on) can be the same as those of the display apparatus 31 according to the first embodiment and operations of the display apparatus 61 are similar to those of the display apparatus 31 according to the first embodiment. Therefore, other arrangements and operations of the display apparatus 61 will not be described in detail.

FIGS. 17 to 22 are diagrams showing processes for manufacturing the electrode substrate 33 of the display apparatus 62.

Figure 22C:
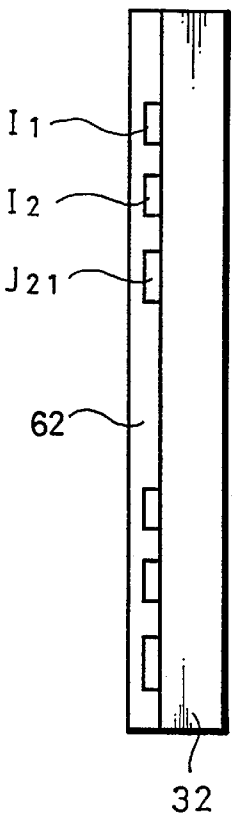
Figure 22A:
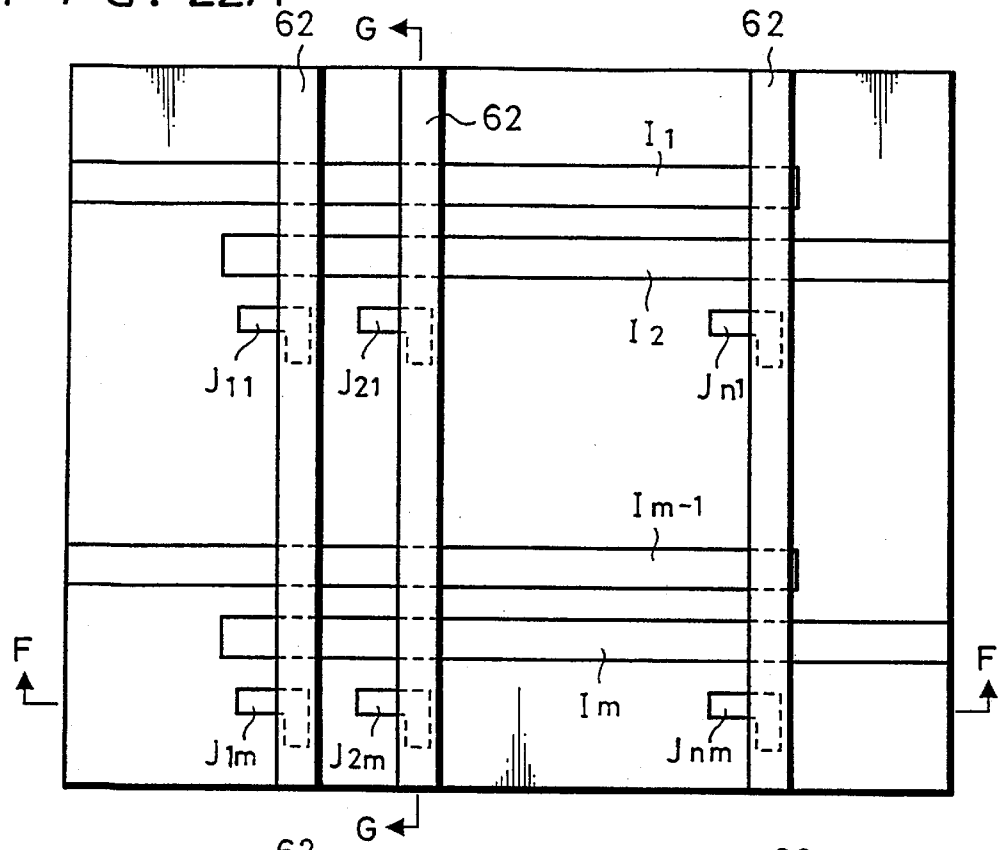
Figure 22B:
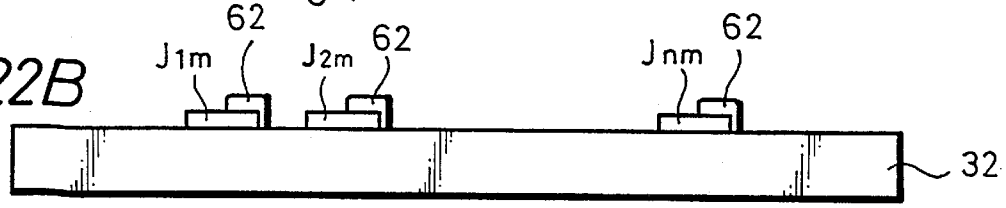

As shown in FIGS. 22A, 22B, and 22C, the discharge sustain electrodes $I_1, \ldots, I_m$ and the L-Shaped discharge start address electrodes $J_{11}, \ldots, J_{nm}$ are formed on one surface of the first substrate, e.g., the glass substrate 32 by the method similar to the above forming method. A plurality of stripe insulating layers 62 are formed at positions corresponding to one piece portions (i.e., one piece portions thereof extended in direction perpendicular to the discharge sustain electrodes I) of the L-shaped discharge start address electrodes $J_{11}, \ldots, J_{nm}$ so as to cross the respective discharge sustain electrodes $I_1, \ldots, I_m$.

Figure 23C:
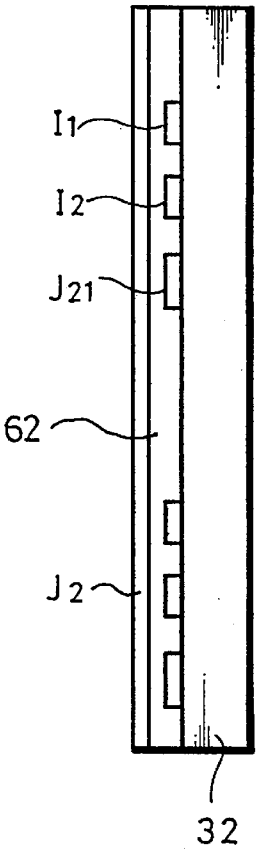
Figure 23A:
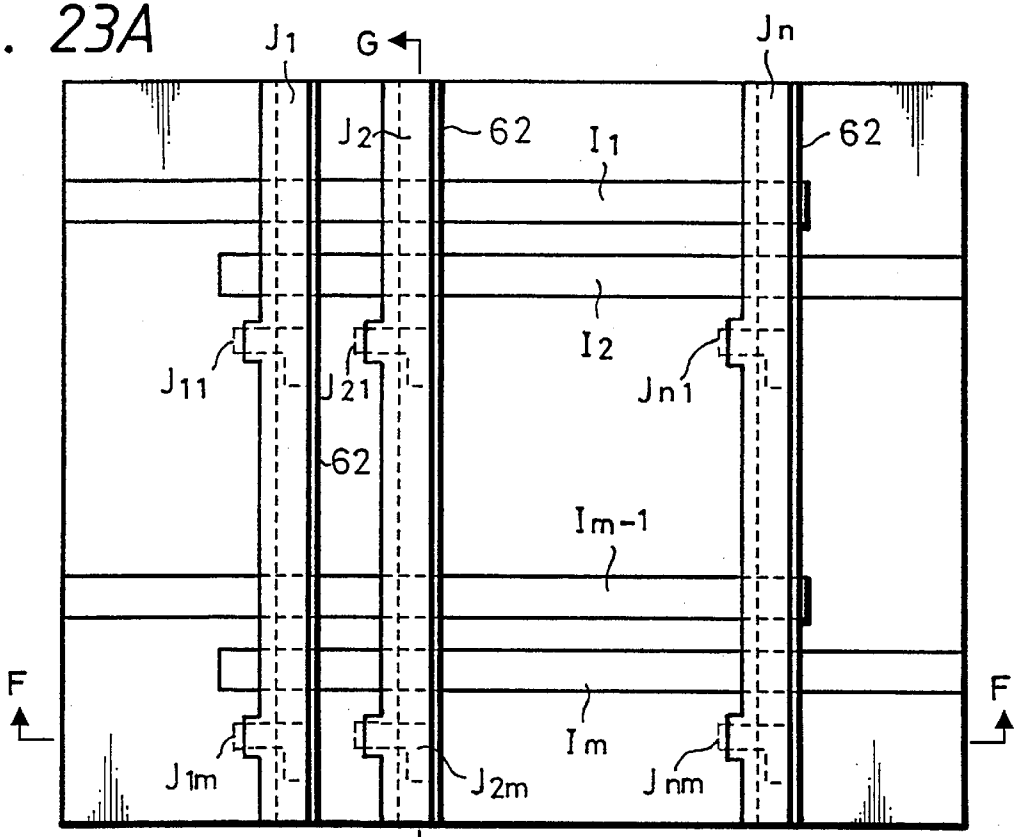
Figure 23B:
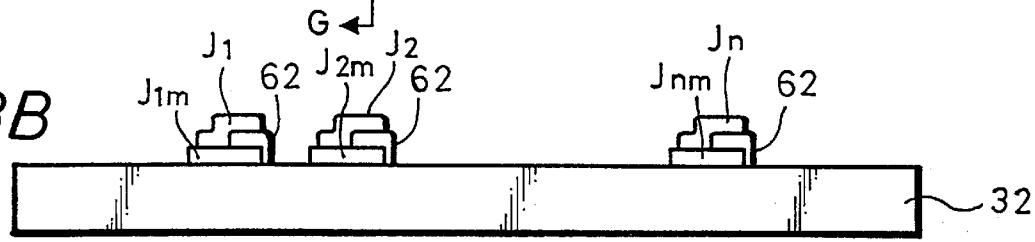

As shown in FIGS. 23A, 23B and 23C, the address electrodes $J_1, \ldots, J_n$ are formed on the respective stripe insulating layers 62. Parts of the address electrodes $J_1, \ldots, J_n$ are extended onto the discharge start address electrodes $J_{11}, \ldots, J_{nm}$ along side surfaces of the insulating layers 62, and theses extended portions of the address electrodes $J_1, \ldots, J_n$ are connected directly to the discharge start address electrodes $J_{11}, \ldots, J_{nm}$. The address electrodes $J_1, \ldots, J_n$ and the extended portions thereof can be simultaneously formed by the lift-off method using an Al evaporated film or by etching.

Figure 24C:
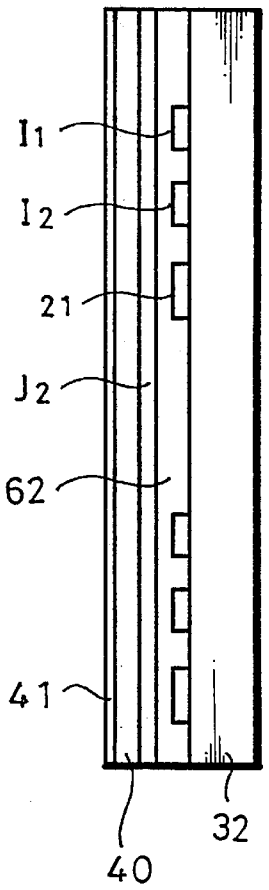
Figure 24A:
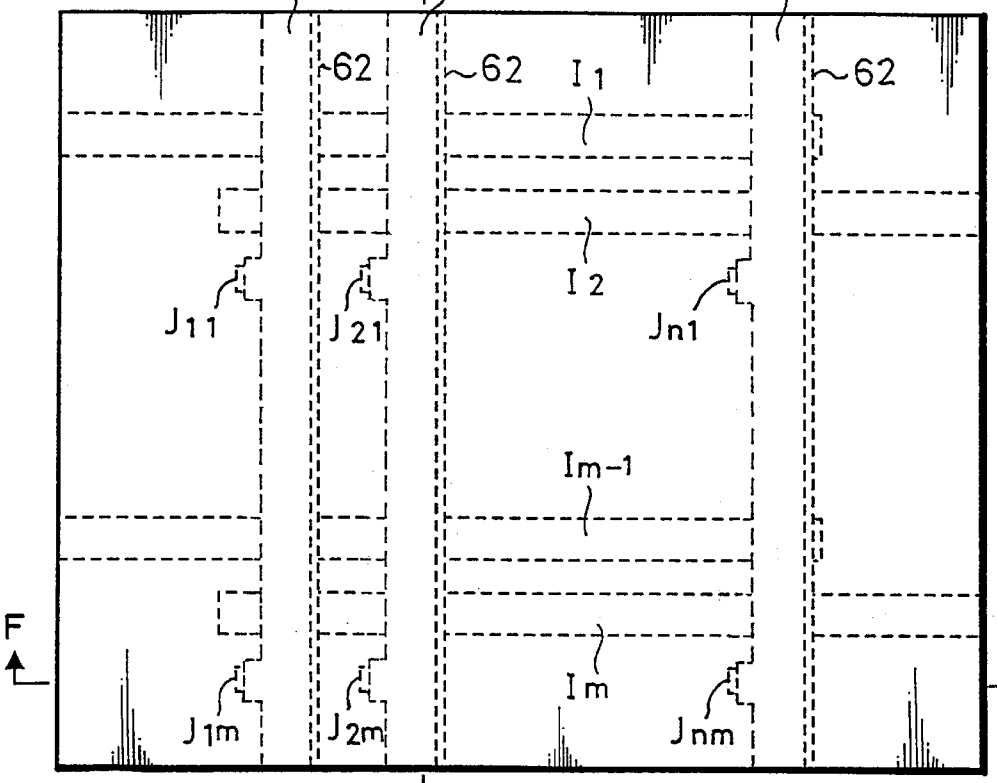
Figure 24B:
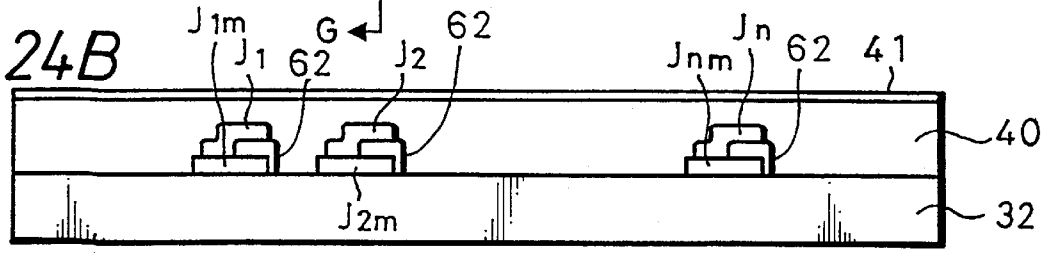

As shown in FIGS. 24A, 24B and 24C, the dielectric layer 40 is formed on the entire surface, and further the Mgo film 41 also serving as the protective film is formed on the dielectric layer 40. Thus, the electrode substrate 33 is formed.

Figure 25A:
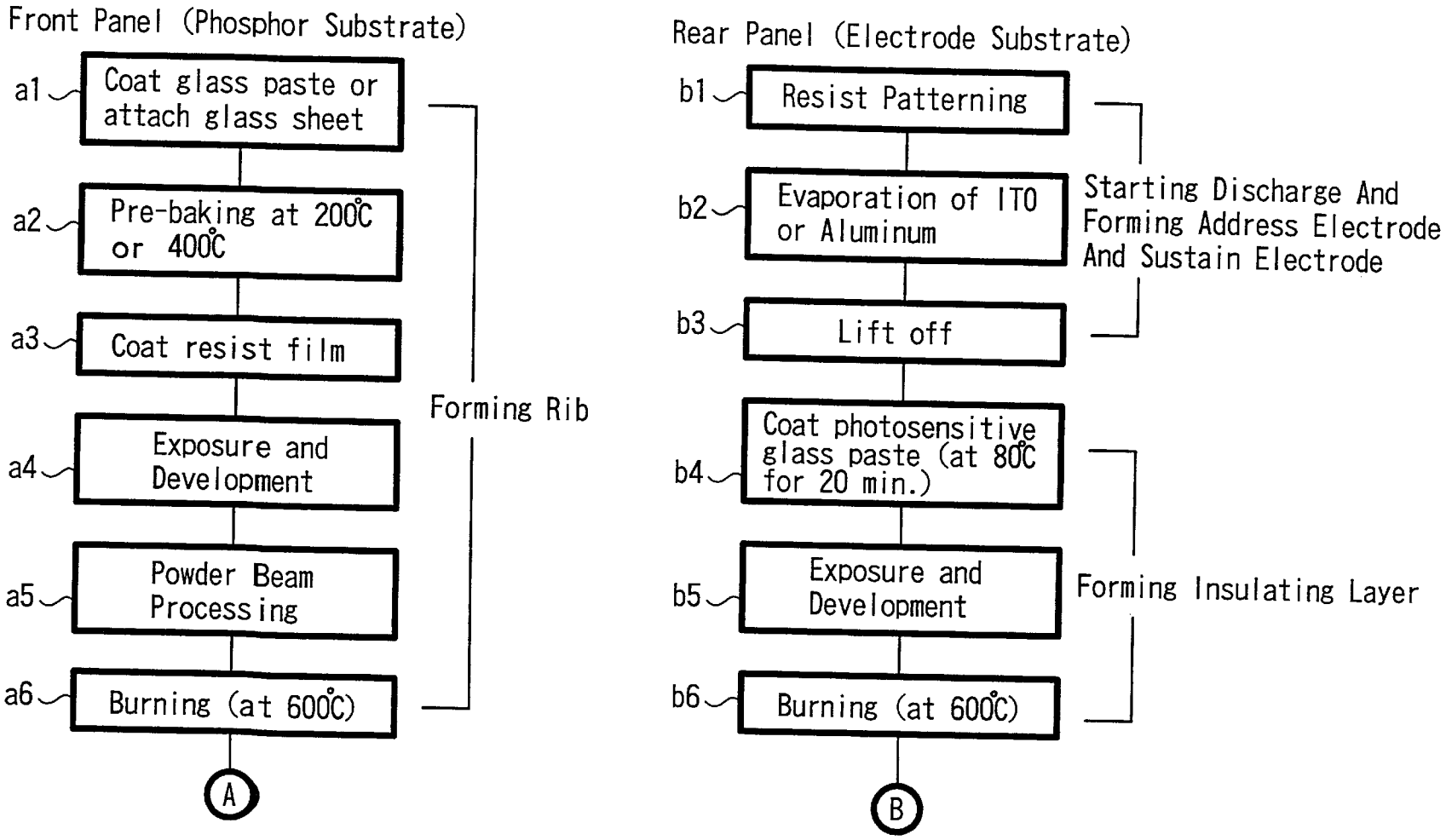
FIGS. 25A and 25B are flowcharts showing processes of manufacturing the display apparatus shown in FIG. 21 according to the second embodiment of the present invention.
Figure 25B:
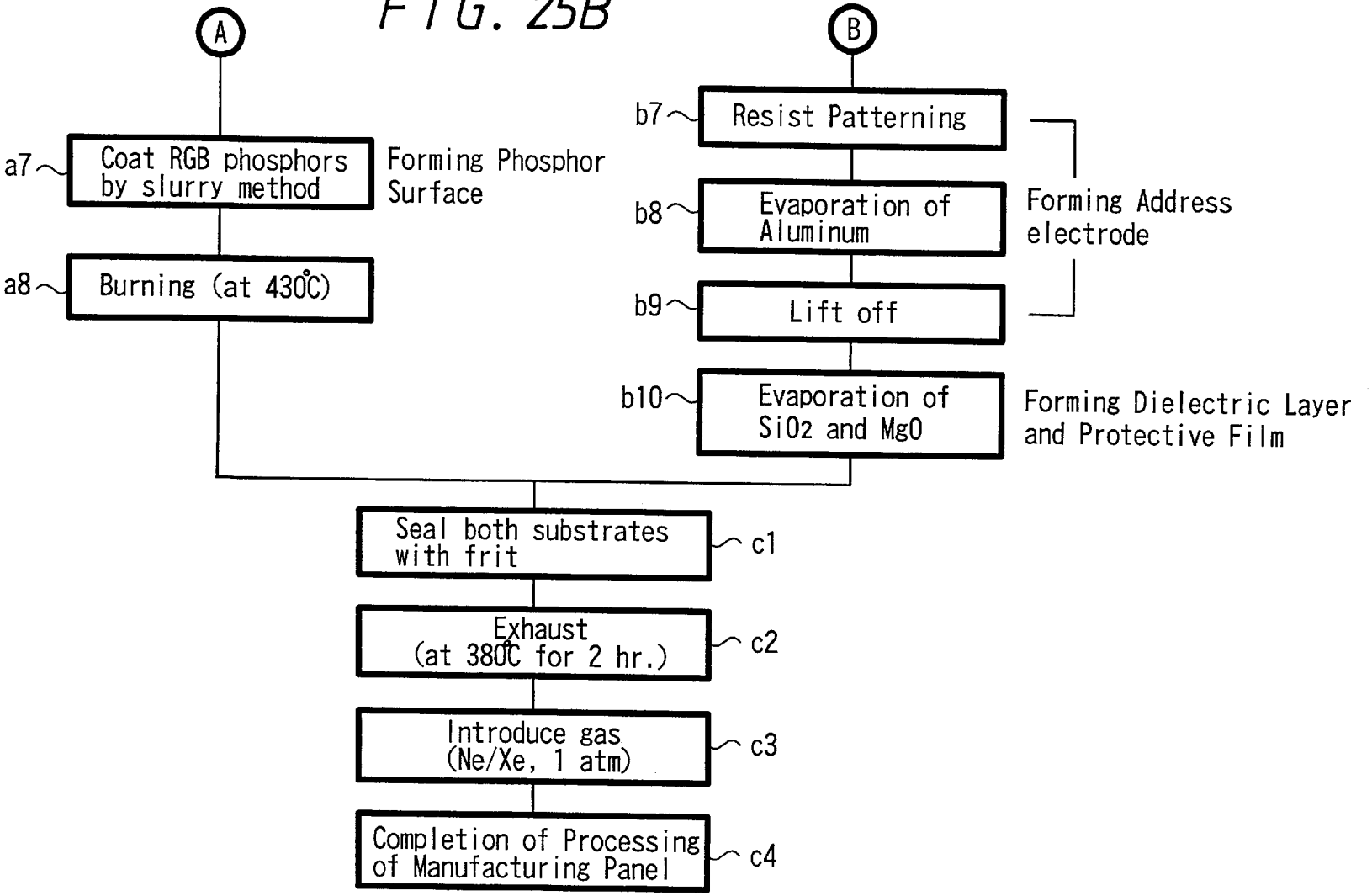

FIGS. 25A and 25B are flowcharts showing a method of manufacturing the above display apparatus 61, by way of example.

The phosphor substrate 36 are manufactured through processes $a_1$ to $a_8$.

In process $a_1$, a glass paste is coated on the glass substrate 34 serving as the second substrate so as to have a predetermined thickness. Alternatively, a glass sheet (e.g., green sheet which is a trade name) having a predetermined thickness is attached. In process $a_2$, the coated glass paste or the attached glass sheet is subjected to a pre-baking processing to form an insulating layer.

In process $a_3$, a resist film is coated on the entire surface. In process $a_4$, the resist film is exposed and developed to form a resist mask on positions where the barrier ribs 56 are to be formed.

In process $a_5$, the above insulating layer is selectively removed by a powder beam process (or by a sandblasting process), and then, in process $a_6$, the insulating layer is burnt at 600° C., for example, to form the barrier ribs 56.

In process $a_7$, respective color phosphors for red (R), green (G) and blue (B) are coated by a slurry method in portions between the adjacent barrier ribs 56, 56. In process as, the coated phosphors are burnt at 430° C., for example. Thus, the phosphor substrate 36 is manufactured.

The electrode substrate 33 is formed through processes $b_1$ to $b_{10}$.

In process $b_1$, a resist film having a predetermined pattern is formed on one surface of the glass substrate 34 serving as the first substrate. In process $b_2$, a transparent and conductive film (e.g., ITO film), for example, or an Al film is formed on the resist film and the glass substrate 34 by sputtering, evaporation or the like. Then, in process $b_3$, the resist film and the transparent and conductive film or the Al film thereon are lifted off by using a resist peeling agent to from the discharge sustain $I_1, \ldots, I_m$ and the discharge start address electrodes $J_{11}, \ldots, J_{nm}$.

In process $b_4$, a photosensitive glass paste is coated on the entire surface at 800° C. for twenty minutes, and then, in process $b_5$, exposed an developed. Then, in process $b_6$, the coated photosensitive glass paste is burnt at 600° C. to form the stripe insulating layers 62 crossing the discharge sustain electrodes $I_1, \ldots, I_m$. In process $b_7$, a resist film having a predetermined pattern is formed. In process $b_8$, an Al evaporated film is formed. In process $b_9$, the resist film and the Al evaporated film thereon are removed by the lift-off process to form address electrodes $J_1, \ldots, J_n$ whose parts are extended along the insulating layers 62 and connected to the discharge start address electrodes $J_{11}, \ldots, J_{nm}$. In process $b_{10}$, the dielectric layer 40 formed of a $SiO_2$ film, for example, and the MgO film 41 are formed by evaporation. Thus, the electrode substrate 33 is manufactured.

In process $c_1$, both of the electrode substrate 33 and the phosphor substrate 36 are assembled and peripheries of contact portions thereof are sealed with a glass frit. Then, in process $c_2$, a tightly sealed vessel formed of both of the substrates 33, 36 are exhausted at 380° C. for two hours, and then, in process $C_3$, Ne/Xe mixed gas is filled therein so that an atmosphere therein should be one atmosphere. In process $C_4$, the chip-off processing is carried out. Then, fabrication of the target display apparatus 61 is completed.

According to the display apparatus 61, since the insulating layers 62 for separating the address electrodes $J_1, \ldots, J_n$ and the discharge sustain electrodes $I_1, \ldots, I_m$ are formed so as to be stripe and the address electrodes $J_1, \ldots, J_n$ and the discharge start address electrodes $J_{11}, \ldots, J_{nm}$ are connected to each other through the extended portions of the former extended along the side surfaces of the insulating layers 62, it is possible to stably and reliably connect the address electrodes $J_1, \ldots, J_n$ and the discharge start address electrodes $J_{11}, \ldots, J_{nm}$ to each other.

In view of fabrication of the display apparatus 61, since the process of forming the contact apertures 59 is not necessary, the manufacturing processes can be simplified, which leads to stable connection therebetween with no fluctuation.

The display apparatus 61 carries out the display by irradiating ultraviolet rays generated by the plasma discharge of the filled gas on the phosphor layers to make the phosphor layers emitting light. In this case, while an image displayed on the display apparatus 61 can be seen from the electrode substrate 33 side or the phosphor substrate 36 side, a part of light emitted with high luminance is irradiated to a rear surface through the substrate 33 or 36 located on the opposite side regardless of whether the image is seen from rom the electrode substrate 33 side or the phosphor substrate 36 side, which leads to disadvantageous decrease of the luminance due to loss of emitted light.

A display apparatus according to a third embodiment of the present invention for solving the above problem will be described.

Figure 26:
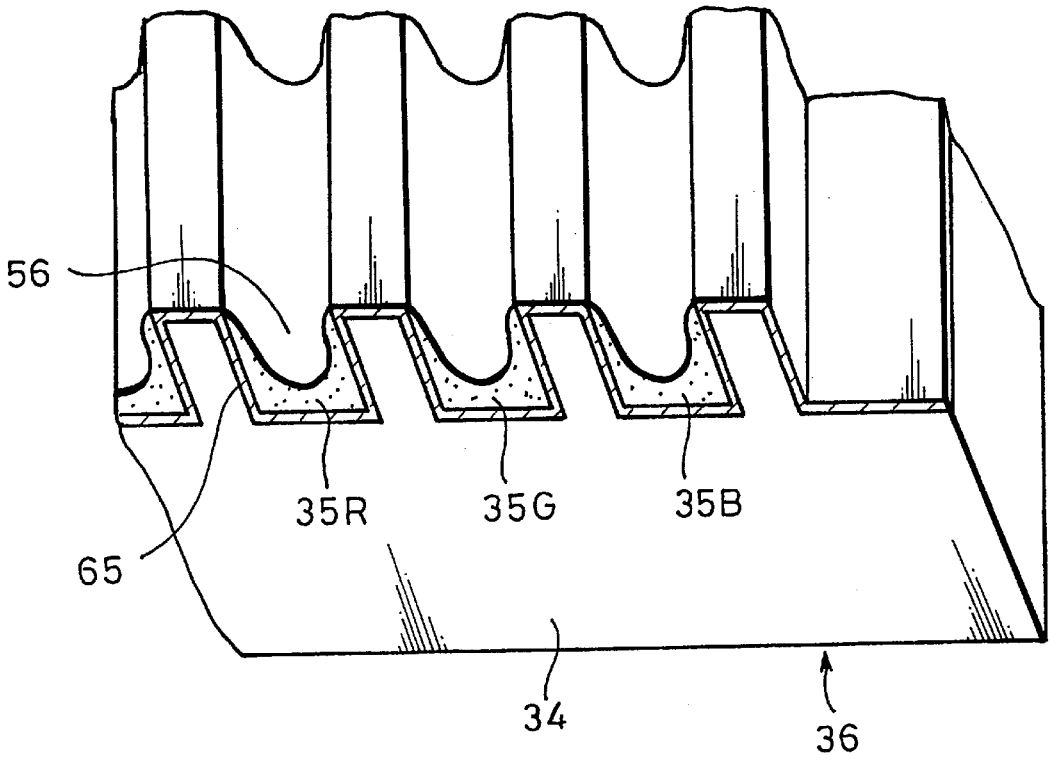
FIG. 26 is a perspective view of a main part of a phosphor substrate of a display apparatus according to a third embodiment of the present invention.
Figure 27:
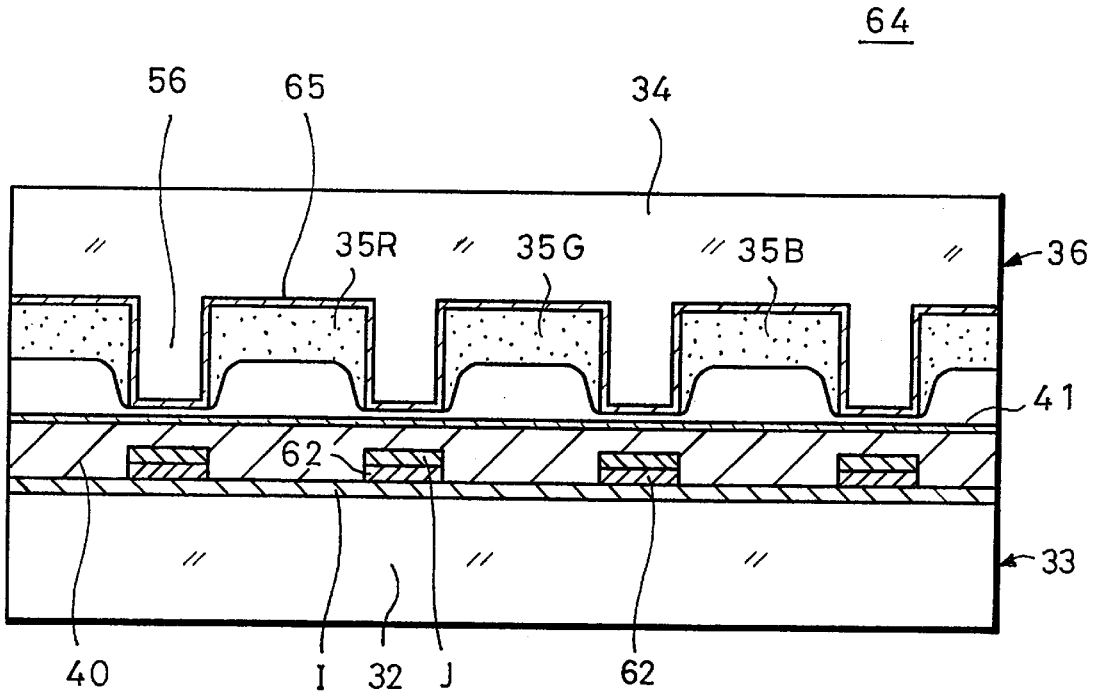
FIG. 27 is a diagram showing a main part of the display apparatus according to the third embodiment of the present invention.

FIGS. 26 and 27 are diagrams showing a display apparatus 64 used when an image is seen from the side of an electrode substrate 33 on which discharge sustain electrodes $I_1, \ldots, I_m$, discharge start address electrodes $J_{11}, \ldots, J_{nm}$ and address electrodes $J_1, \ldots, J_n$.

The display apparatus 64 has a phosphor substrate 36 having a reflective film 65 deposited between a glass substrate 34 serving as a second substrate and having barrier ribs 56 and phosphor layers 35 (35R, 35G, 35B), and is formed by tightly sealing the phosphor substrate 33 and the electrodes 36 having the discharge sustain electrodes $I_1, \ldots, I_m$, the discharge start address electrodes $J_{11}, \ldots, J_{nm}$ and the address electrodes $J_1, \ldots, J_n$ formed thereon.

As shown in FIG. 26, the reflective film 65 can be formed by, after the barrier ribs 56 are formed on the glass substrate 34, forming a film of a high-reflectivity material such as aluminum (Al), nickel (Ni), silver (Ag) or the like, e.g., aluminum in this third embodiment on the entire surface including an inner surface of the substrate 34 and inner surfaces of the barrier ribs 56 so as to have a thickness of about 1000 Å to 5000 Å more preferably 1500 Å to 3000 Å. After the reflective film 65 is formed, the phosphor layers 35 (35R, 35G, 35B) are formed in portions between the adjacent barrier ribs 56.

In this embodiment, electrodes are formed on the side of a glass substrate 32 serving as a first substrate with an arrangement similar to that shown in FIG. 21. In this case, the discharge sustain electrodes $I_1, \ldots, I_m$ and the address electrodes $J_1, \ldots, J_n$ are formed of transparent and conductive films, e.g., ITO films.

The reflective film 65 is formed between the processes $a_6$ and $a_7$ of the manufacturing processes shown in FIGS. 25A and 25B.

Other arrangement of the display apparatus 61 and operations thereof can be similar to those of the display apparatus 31, and hence need not to be described in detail.

According to the display apparatus 64, the phosphor layers 35, (35R, 35G, 35B) are excited by the discharge between the pairs of the discharge sustain electrodes $I_1$ and $I_2, \ldots, I_{m-1}$ and $I_m$ to emit light. Rays of light emitted toward the phosphor substrate 36 side, of the emitted light, are reflected by the reflective film 65 and then directed toward the electrode substrate 33. Therefore, it is possible to prevent loss of light traveled toward the phosphor substrate 36 side, which allows a user to see a displayed image with improved luminance from the electrode substrate 33 side.

Figure 28:
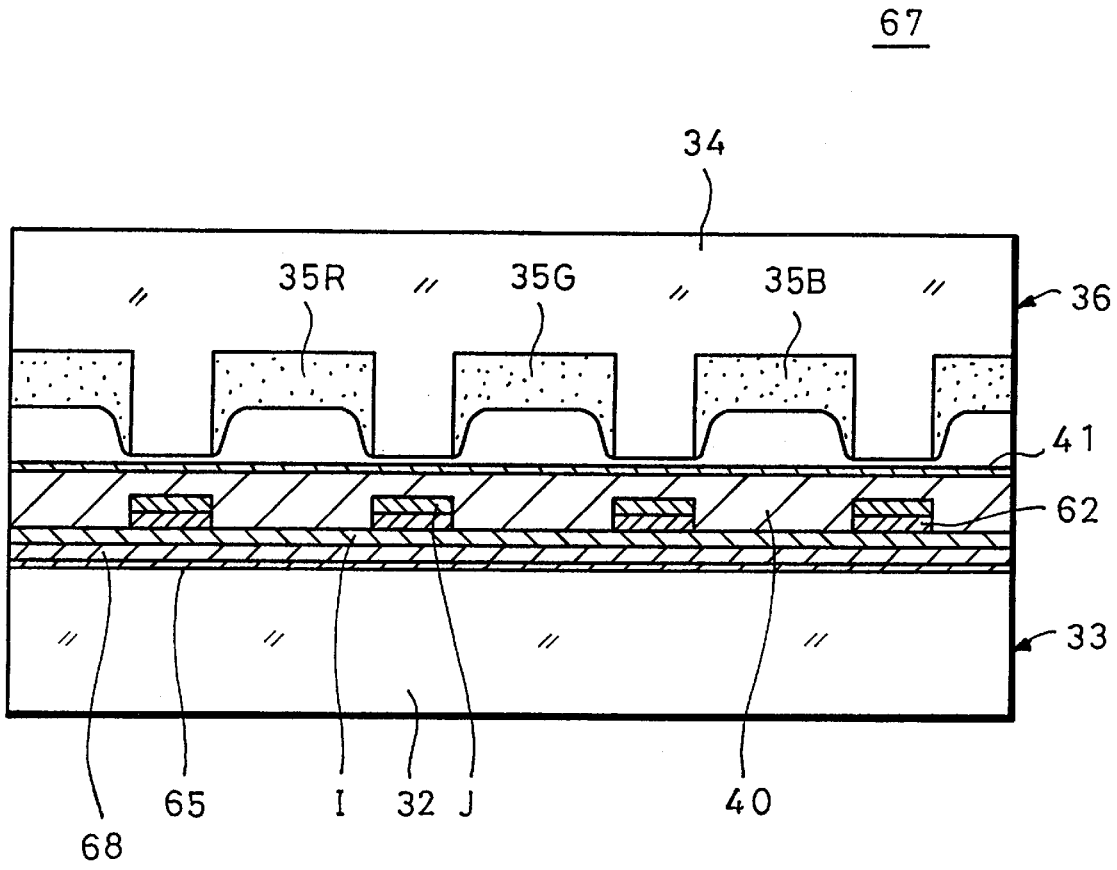
FIG. 28 is a diagram showing a main part of a display apparatus according to a fourth embodiment of the present invention.

FIG. 28 is a diagram showing a display apparatus 67 according to a fourth embodiment of the present invention used when a user sees a displayed image from the side of a second substrate 34 on which phosphor layers 35 are formed.

The display apparatus 67 has an electrode substrate 33 having a reflective film 65 similar to that of the third embodiment formed on an entire surface of a glass substrate 32 serving as a first substrate, an insulating layer 68 formed on the reflective film 65, discharge sustain electrodes $I_1, \ldots, I_m$ and address electrodes $J_1, \ldots, J_n$ having arrangements similar to those of the third embodiment and formed on the insulating layer 68, insulating layers 62 formed thereon, discharge start address electrodes $J_{11}, \ldots, J_{nm}$ formed on the insulating layers 62, a dielectric layer 40 formed thereon, and an Mgo film 411 formed on the dielectric layer 40. The display apparatus 67 has an phosphor substrate 36 having barrier ribs 56 and phosphor layers 35 (35R, 35G, 35B) formed by coating in portions between adjacent barrier ribs 56. The display apparatus 67 is formed by tightly sealing the phosphor substrate 36 and the electrode substrate 33.

In this case, the discharge sustain electrodes $I_1, \ldots, I_m$ and the discharge start address electrodes $J_{11}, \ldots, J_{nm}$ can be formed of aluminum films. They can be formed of transparent and conductive films.

The reflective film 65 is formed before the process $b_1$ of the manufacturing processes shown in FIGS. 25A AND 25B.

According to the display apparatus 67, the phosphor layers 35, (35R, 35G, 35B) are excited by the discharge between the pairs of the discharge sustain electrodes $I_1$ and $I_2, \ldots, I_{m-1}$ and $I_m$ to emit light. Rays of light emitted toward the electrode substrate 33 side, of the emitted light, are reflected by the reflective film 65 and then directed toward the phosphor substrate 36. Therefore, it is possible to prevent loss of light traveled toward the electrode substrate 33 side, which allows a user to see a displayed image with improved luminance from the phosphor substrate 36 side.

When the display apparatus 61 shown in FIG>21 is manufactured, the discharge sustain electrodes $I_1, \ldots, I_m$ and the discharge start address electrodes $J_{11}, \ldots, J_{nm}$ are formed on the same substrate 32, and then the stripe insulating layers 62 are formed by burning glass paste. Thereafter, the address electrodes $J_1, \ldots, J_n$ are formed on the insulating layers 62. However, in consideration of a possibility that the insulating layers 62 are porous and hence sufficient insulation cannot be obtained, it is necessary to more reliably insulate the discharge sustain electrodes I ($I_1, \ldots, I_m$) and the address electrodes J ($J_1, \ldots, J_n$) from each other.

Since the insulating layer 62 is formed by burning at about 600° C., a burning temperature at this time may disadvantageously permit electrode terminal portions to be oxidized.

Even if the discharge sustain electrodes I ($I_1, \ldots, I_m$), the address electrodes J ($J_1, \ldots, J_n$) and the like are formed of transparent and conductive films such as ITO films or the like, it can be considered that the ITO films at the terminal portions of the discharge sustain electrodes I ($I_1, \ldots, I_m$) are oxidized to thereby lower conductivity thereof.

Moreover, it can be considered that when the electrode substrate 33 and the phosphor substrate 36 are sealed with a glass frit and the glass frit is burnt, the electrode terminal portions are oxidized.

A display apparatus according to a fifth embodiment of the present invention for solving the above problem will be described.

FIGS. 29 to 33 are diagrams showing successive processes of manufacturing a display apparatus 71 according to the fifth embodiment.

Figure 29C:
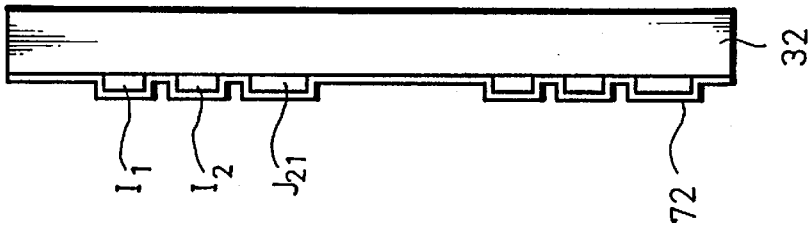
Figure 29A:
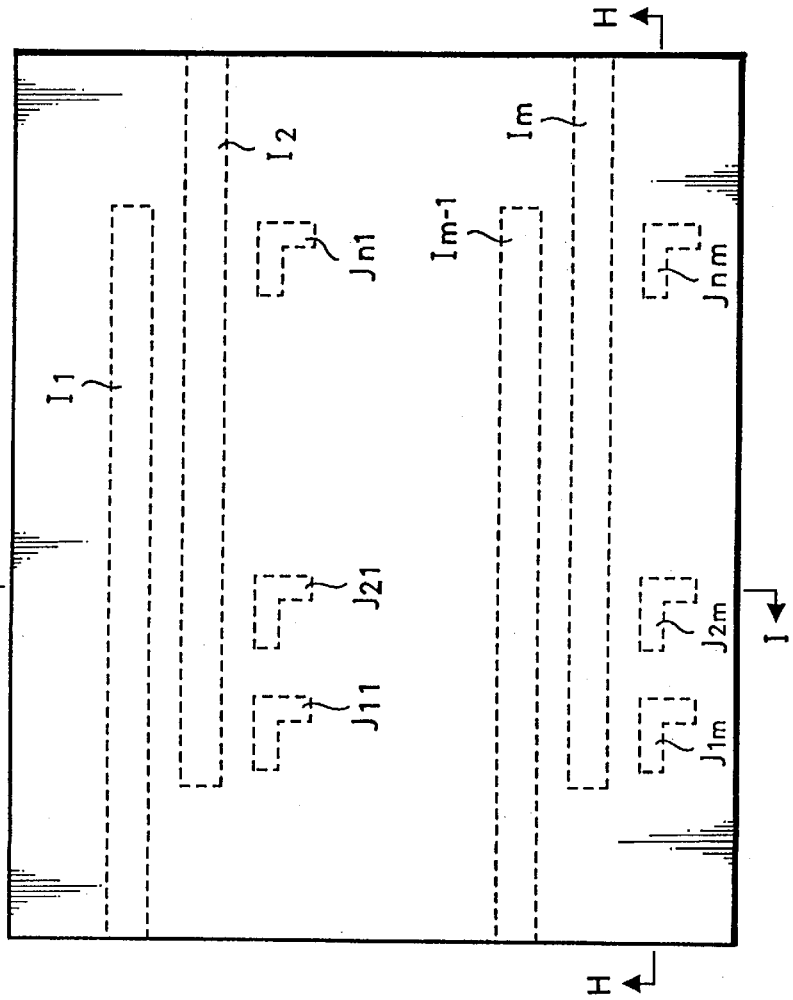
Figure 29B:
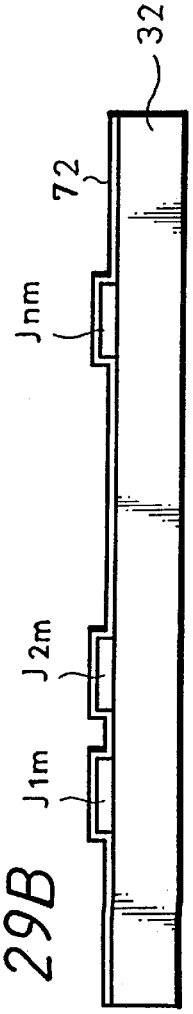

As shown in FIGS. 29A, 29B and 29C, discharge sustain electrodes $I_1, \ldots, I_m$ and L-shaped address electrodes $J_{11}, \ldots, J_{nm}$ are formed on one surface of a glass substrate serving as a first substrate similarly as described above. The discharge sustain electrodes $I_1, \ldots, I_m$ and the address electrodes $J_{11}, \ldots, J_{nm}$ are formed of transparent and conductive films such as ITO films or the like, or metal films such as aluminum (Al), chromium (Cr), gold (Au), silver (Ag), a dilayer film having a structure (Al/Cr) formed of an upper layer made of Cr and a lower layer made of Al, a trilayer film having a structure (Cr/Al/Cr) formed of a middle layer made of Al and upper and lower layers made of Cr to sandwich the middle layer, or the like. In this fifth embodiment, they are formed of aluminum films.

An insulating film 72 is deposited on an entire surface including the discharge sustain electrodes $I_1, \ldots, I_m$, so-called terminal portions at end portions of the discharge sustain electrodes $I_1, \ldots, I_m$ and the discharge start address electrodes $J_{11}, \ldots, J_{nm}$. The insulating film 72 is a film having excellent insulation. An insulating film formed by chemical vapor deposition (CVD) can be employed. Specifically, a $SiO_2$ film is formed by CVD. A film thickness of the insulating film 72 can be set within the range from 10 μm to 100 μm. When the insulating film 72 is formed by screen printing, if the thickness is smaller than 10 μm, then minute pores are produced, which presents large possibility of short-circuit and hence leads to insufficient insulation. If on the other hand the film thickness is larger then 100 μ, then the insulating film must formed by coating plural layers, which increases the manufacturing processes and aggravates transparency of the insulating film 72 to thereby lower luminance.

Figure 30C:
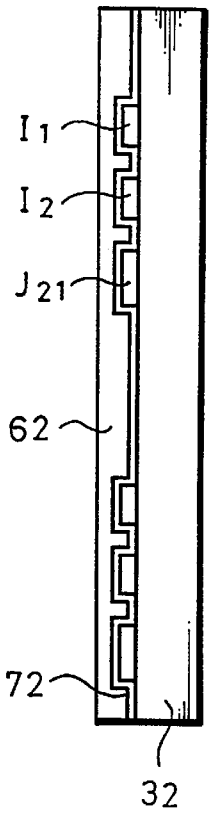
Figure 30A:
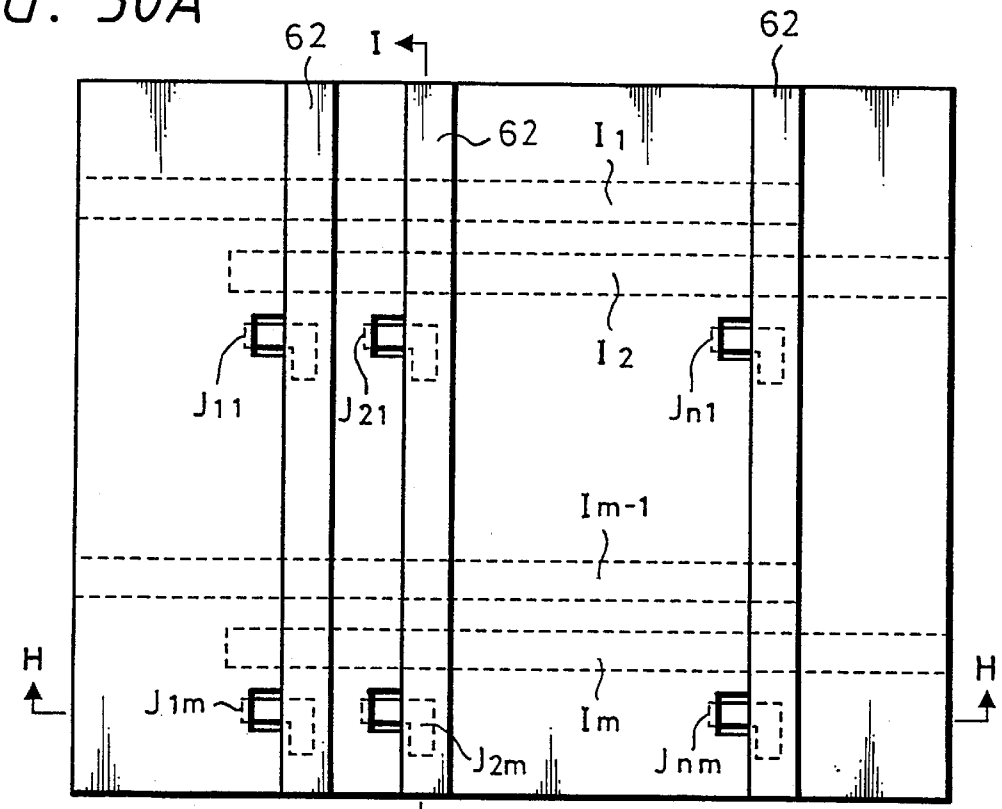
Figure 30B:
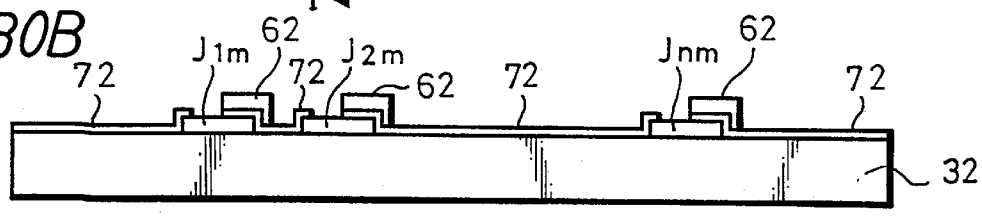

As shown in FIGS. 30A, 30B and 30C, the contact apertures 73 used for connecting the discharge start address electrodes $J_{11}, \ldots, J_{nm}$ and the address electrodes $J_1, \ldots, J_n$ formed later on to each other are formed on the insulating film 72.

Stripe insulating layers 62 are formed on positions where the address electrode $J_{11}, \ldots, J_n$ are to be formed. THe insulating layers 62 can be formed by coating a glass paste in a stripe pattern to then burn the glass paste, similarly to the second embodiment.

Figure 31C:
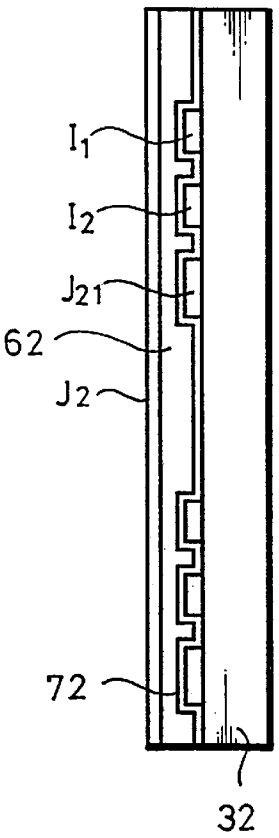
Figure 31A:
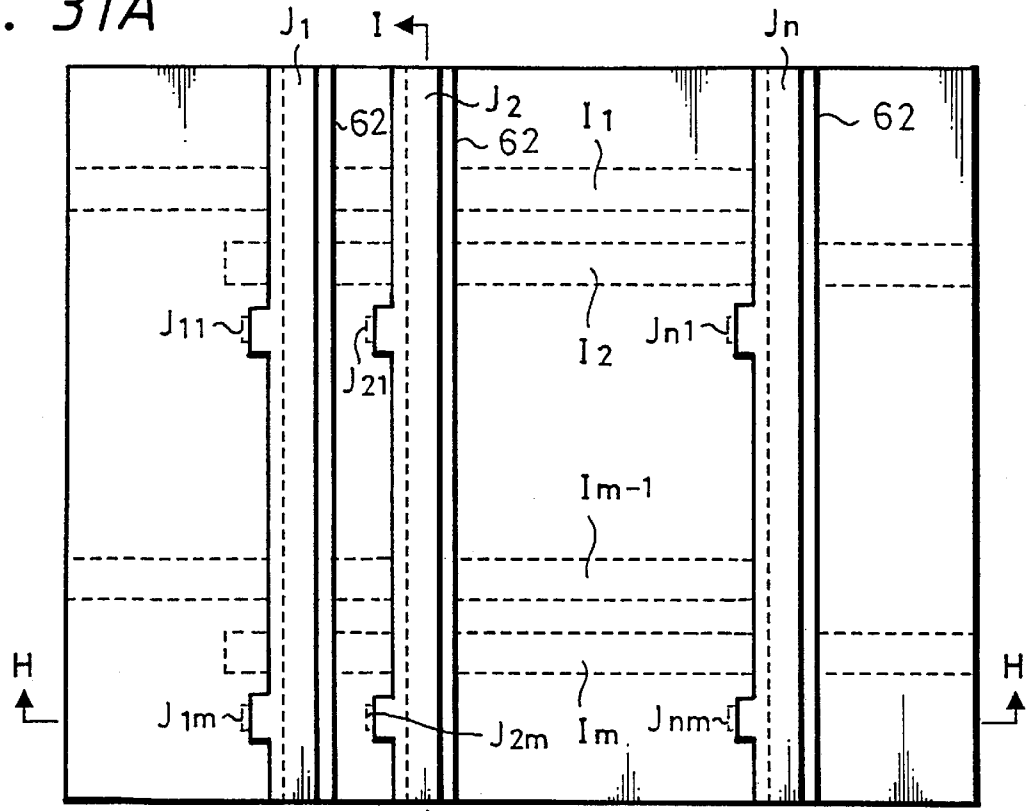
Figure 31B:
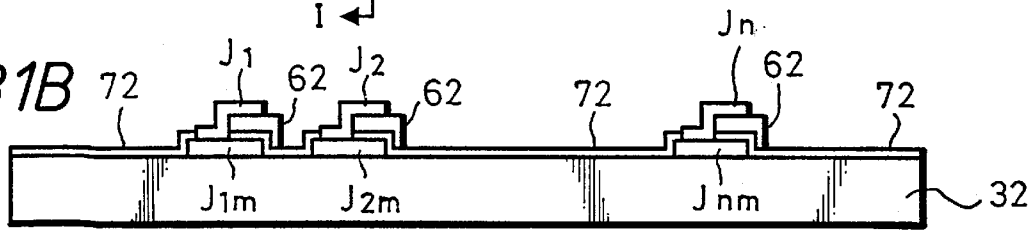

As shown in FIGS. 31A, 31B and 31C, the address electrodes $J_1, \ldots, J_n$ formed of an aluminum evaporated film are formed on the respective insulating layers 62, and at the same time, the address electrodes $J_1, \ldots, J_n$ and the discharge start address electrodes $J_{11}, \ldots, J_{nm}$ are connected to each other through the contact apertures 73.

Figure 32C:
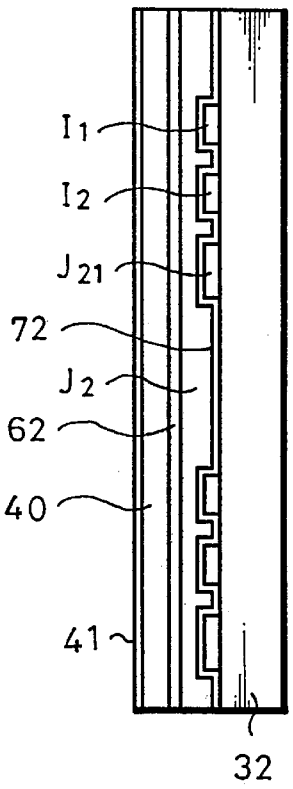
Figure 32A:
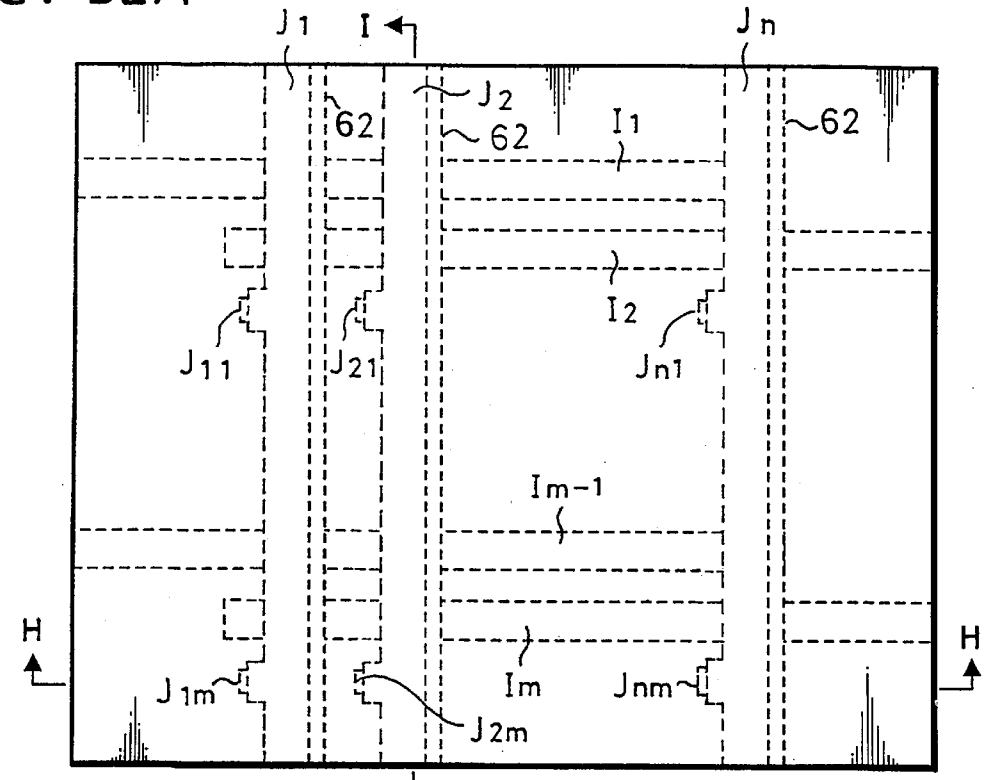
Figure 32B:
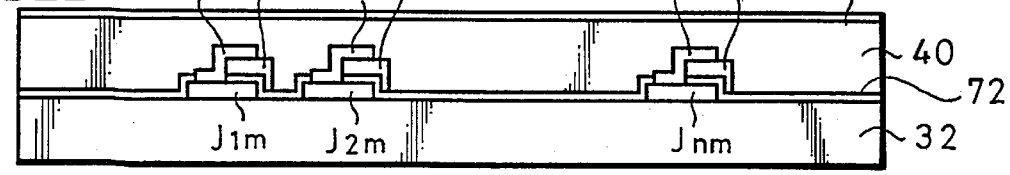

As shown in FIGS. 32A, 32B and 32C, a dielectric layer 40 is formed on a display area except terminal portions at end portions of the discharge sustain electrodes $I_1$1 , . . . , $I_m$, and further an Mgo film 41 serving as a protective film is formed thereon. Thus, the electrode substrate 33 is formed.

Though not shown, barrier ribs 56 are formed on a glass substrate 34 serving as a second substrate, and phosphor layers 35 (35R, 35G, 35B) are formed at positions between the adjacent barrier ribs 56. Thus, the phosphor substrate 36 is formed.

The electrode substrate 33 and the phosphor substrate 36 are assembled and sealed with a glass frit so that the terminal portions 74 of the discharge sustain electrodes $I_1, \ldots, I_m$ and the terminal portions of the address electrodes $J_1, \ldots, J_n$ should be opposed to an outside.

Figure 33A:
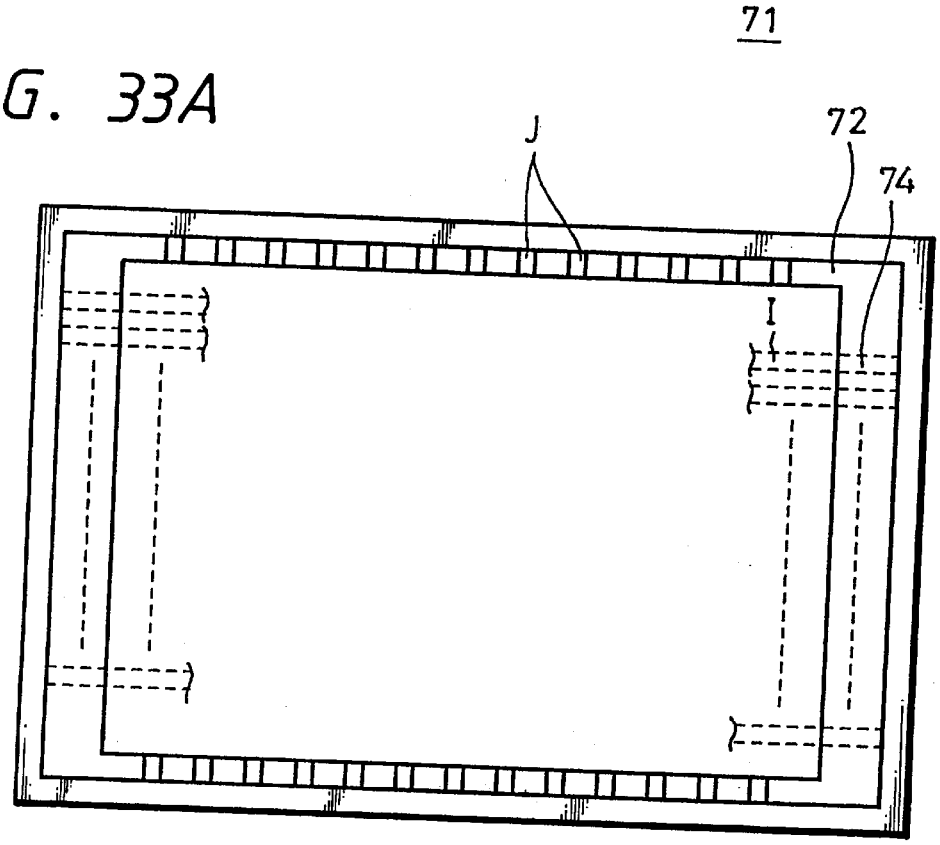
FIGS. 33A and 33B are a plan view and a partially cross-sectional, side view of the display apparatus according to the fifth embodiment of the present invention, respectively.
Figure 33B:
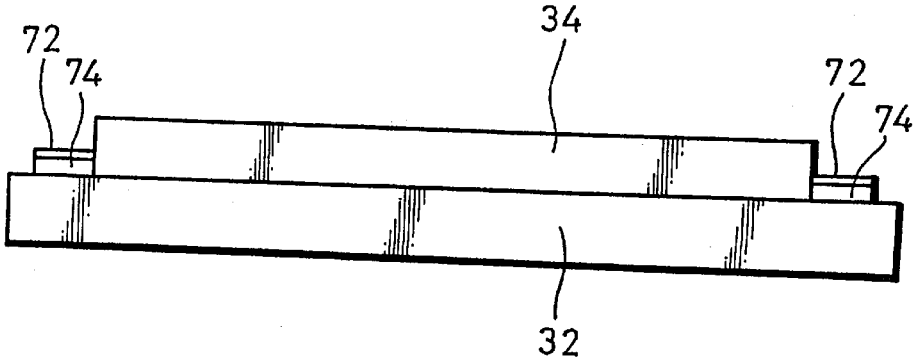
Figure 34A:
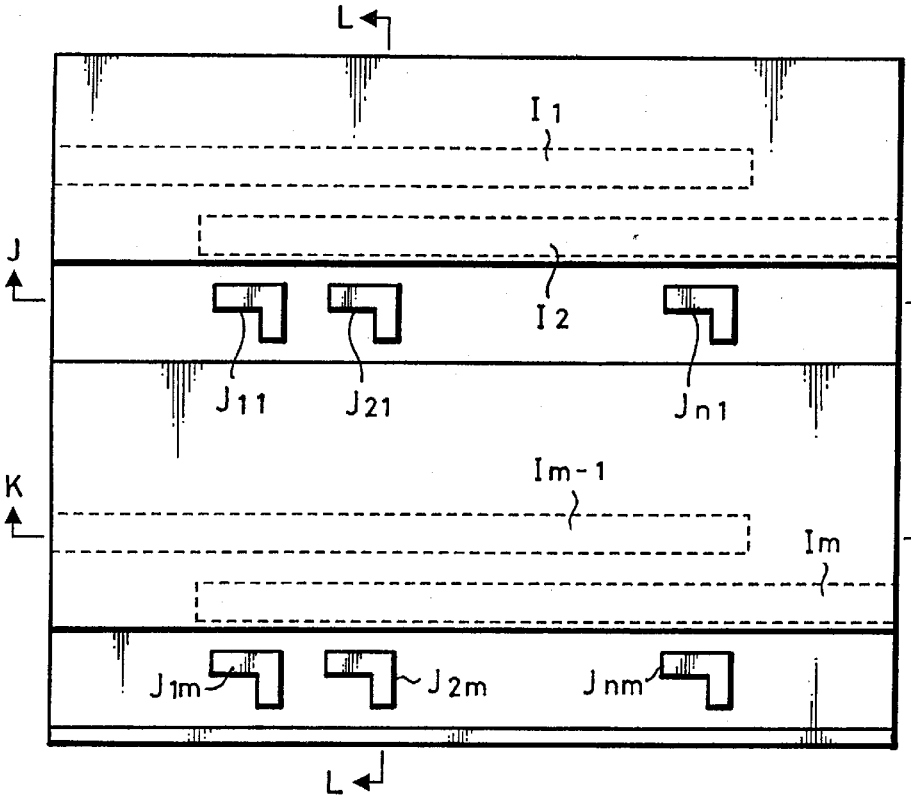
Figure 34D:
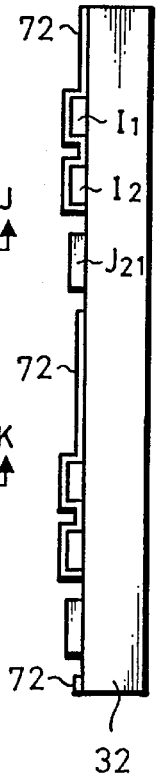
Figure 34B:
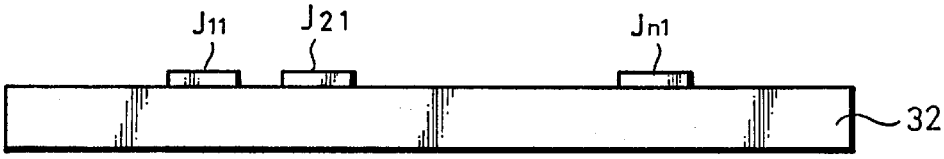
Figure 34C:
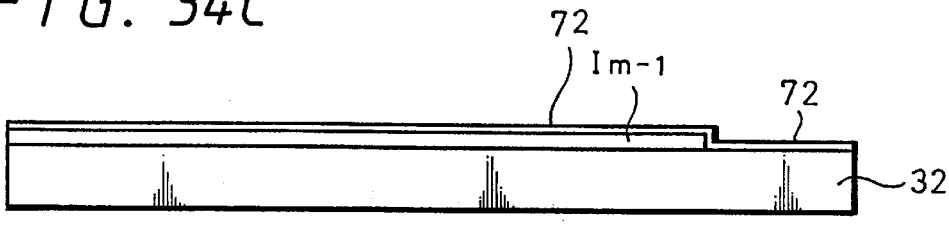
Figure 35A:
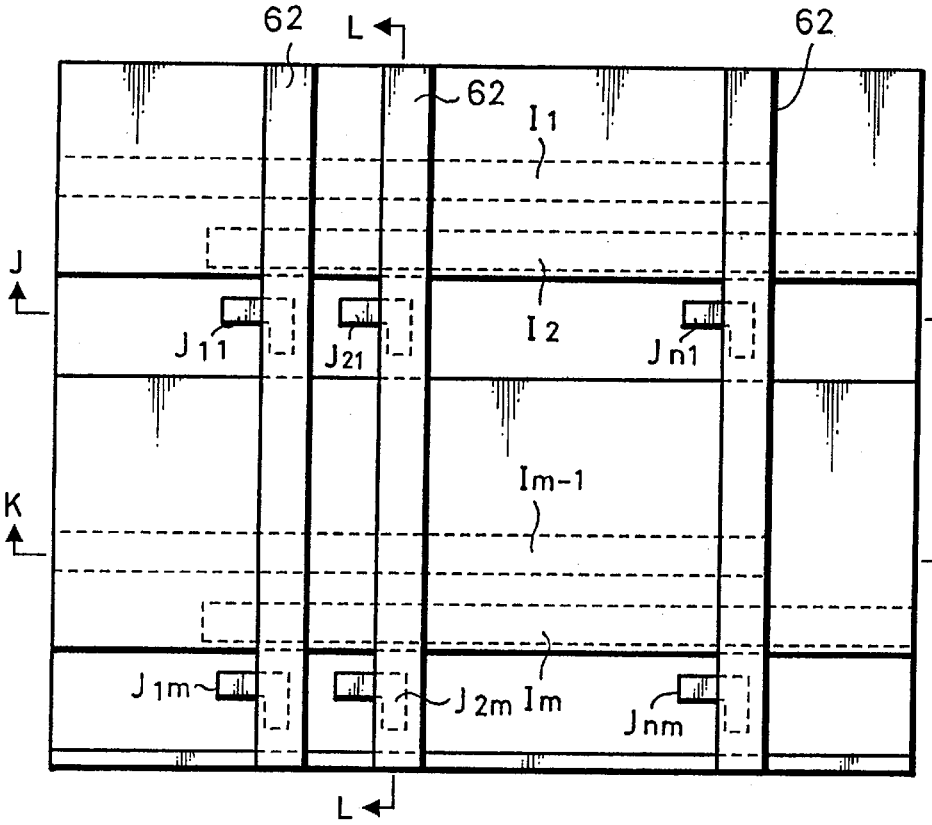
Figure 35D:
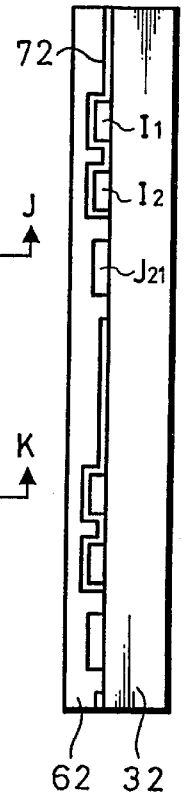
Figure 35B:
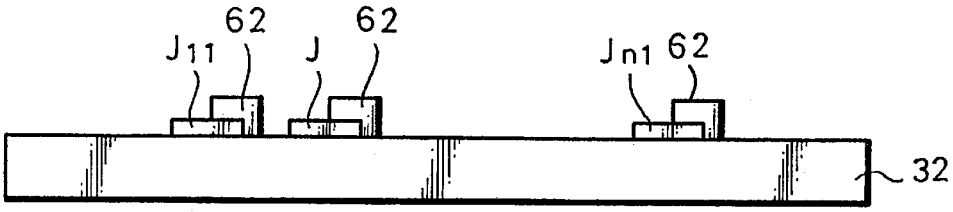
Figure 35C:
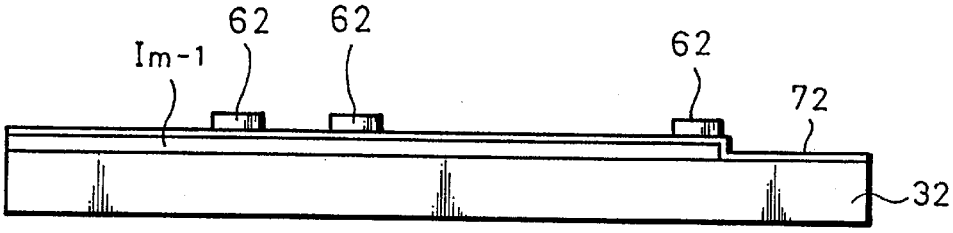
Figure 36A:
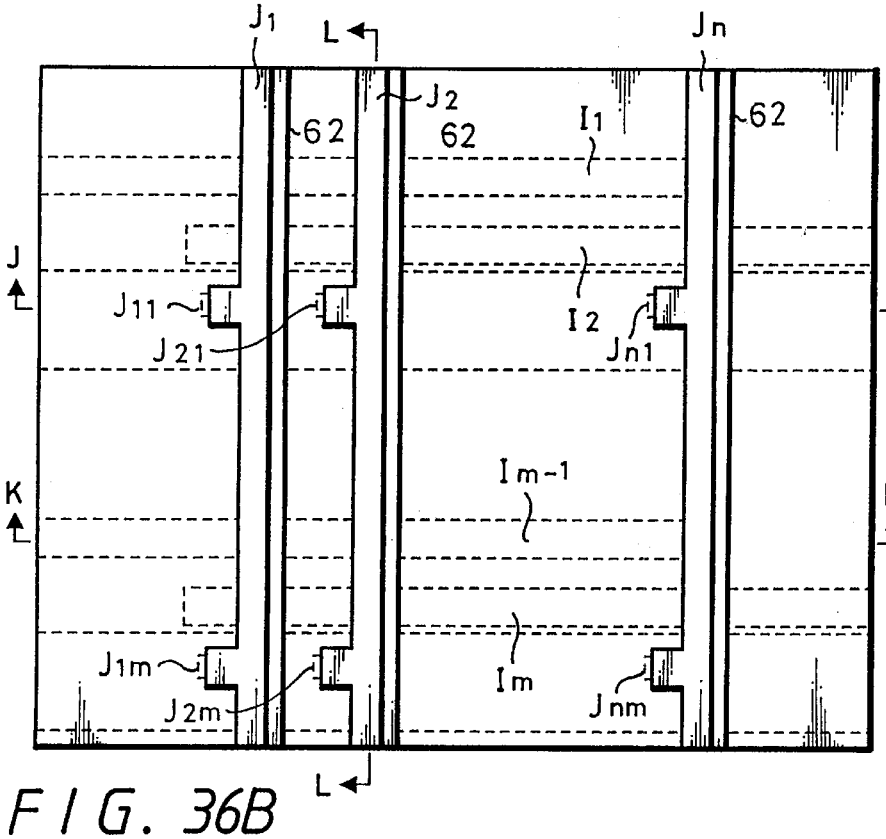
Figure 36D:
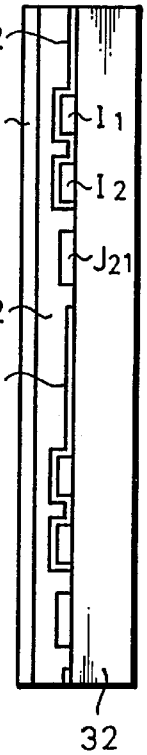
Figure 36B:
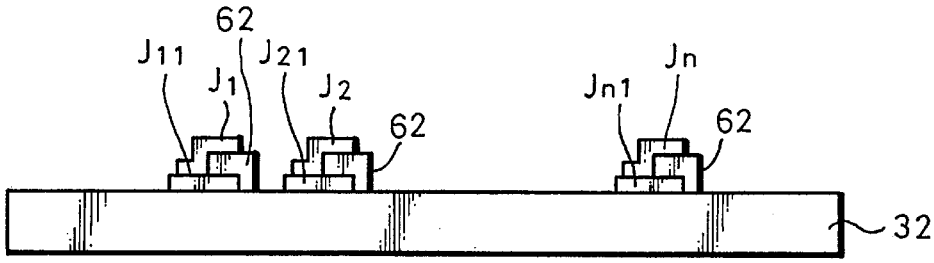
Figure 36C:
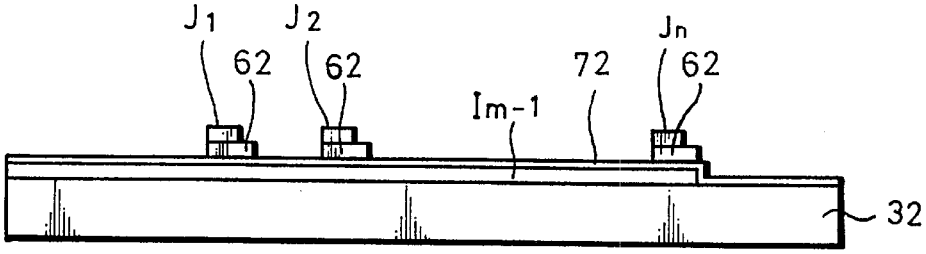
Figure 37A:
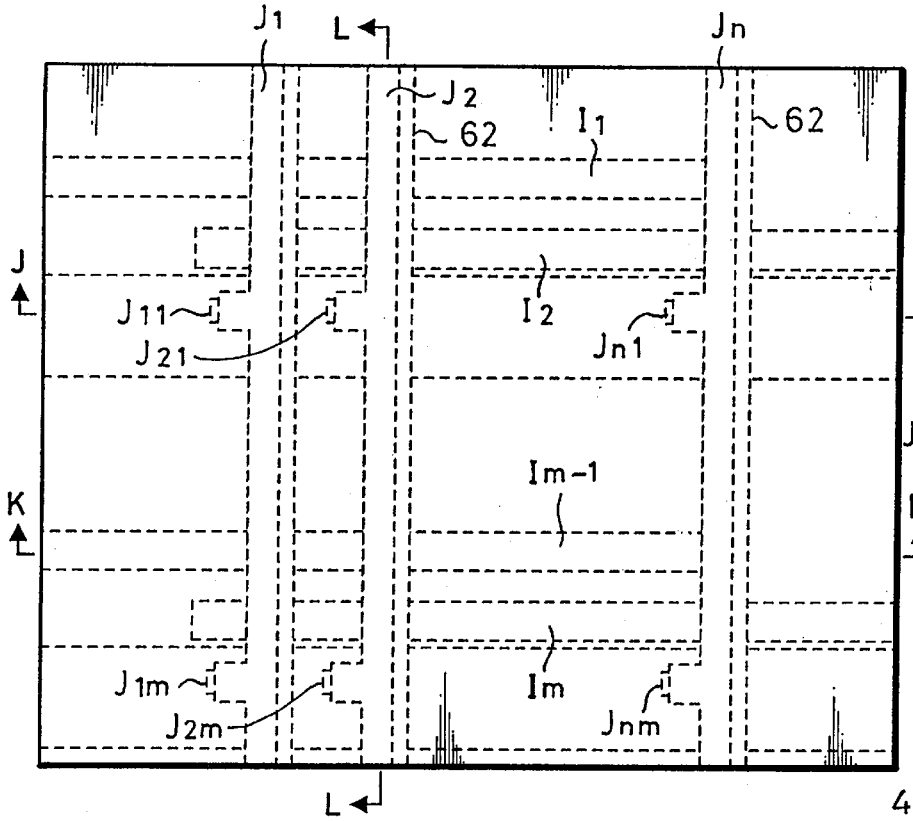
Figure 37D:
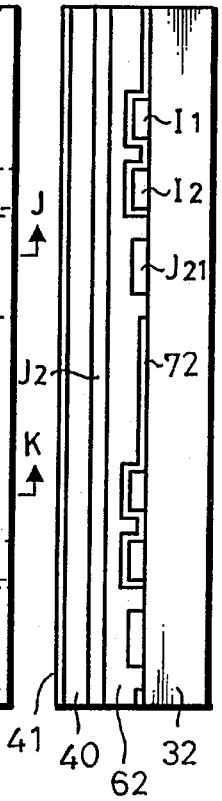
Figure 37B:
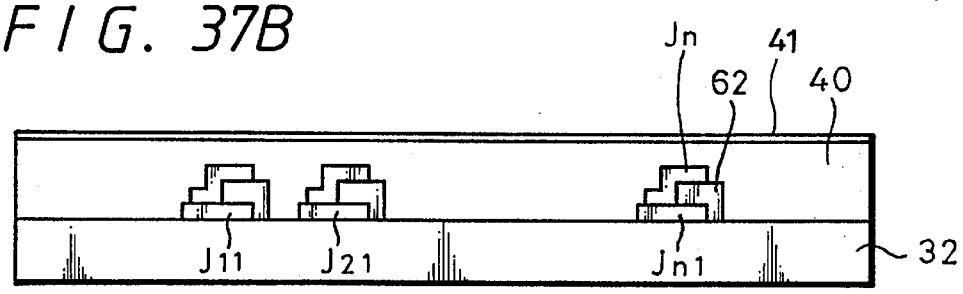
Figure 37C:
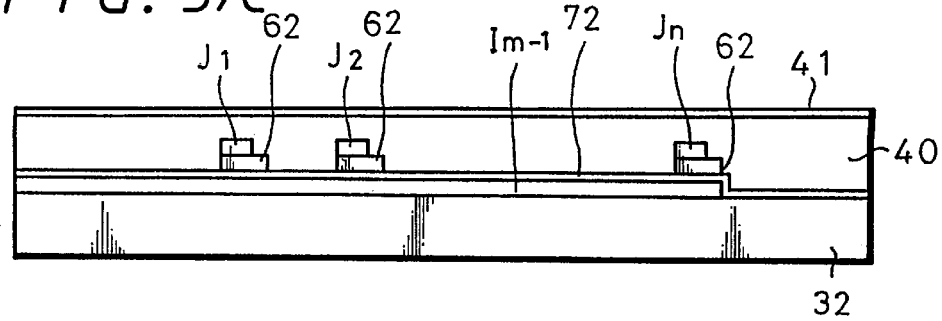

Thus, as shown in FIGS. 33A and 33B, the target display apparatus 71 in which the thin insulating film 72 is uniformly formed on the surfaces of the discharge sustain electrodes $I_1, \ldots, I_m$ and the discharge start address electrodes $J_{11}, \ldots J_{nm}$ and the surface of terminal portions 74 of the discharge sustain electrodes $I_1, \ldots, I_m$ can be obtained.

Other arrangements of the display apparatus 71 and operations thereof are similar to those of the display apparatus 31, and hence need not to be described in detail.

Since it is needless to say that when the display apparatus 71 is electrically driven, the display apparatus 71 is driven by application of an AC voltage thereto, even if the thin insulating film 72 is formed on the terminal portions 74, then the discharge sustain electrodes $I_1, \ldots I_m$ are applied with a drive voltage.

According to the display apparatus 71, since the insulating film 72 having satisfactory insulation is formed on the surfaces of the discharge sustain electrodes $I_1, \ldots, I_m$ and the discharge start address electrodes $J_{11}, \ldots, J_{nm}$, even if the insulating layers 62 formed immediately under the address electrodes $J_1, \ldots, J_n$ have deteriorated insulation, then it is possible to improve insulation between the discharge sustain electrodes $I_1, \ldots, I_m$ and the address electrodes $J_{11}, \ldots, J_n$. Since the insulating layer 72 is formed on the surfaces of the terminal portions of the discharge sustain electrodes $I_1, \ldots, I_m$, it is possible to prevent the terminal portions 74 from being oxidized or sublimated in the burning process upon forming the insulating layers 62 or the like and further in the process of sealing both of the electrodes 33 and 36 with a glass frit.

FIGS. 34 to 38 are diagrams showing successive processes of manufacturing a display apparatus 76 according to a sixth embodiment of the present invention.

As shown in FIGS. 34A, 34B, 34C, 34D, discharge sustain electrodes $I_1, \ldots, I_m$ and discharge start address electrodes $J_{11}, \ldots, J_{nm}$ are formed on one surface of a glass substrate serving as a first substrate similarly as described above. The discharge sustain electrodes $I_1, \ldots, I_m$ and the discharge start address electrodes $J_{11}, \ldots, J_{nm}$ can be formed of aluminum films in this sixth embodiment. Stripe insulating films 72 similar to that employed in the fifth embodiment are deposited so as to cover the respective pairs of discharge sustain electrodes $I_1, \ldots, I_m$ and their terminal portions 74 except the discharge start address electrodes $J_{11}, \ldots, J_{nm}$ .

As shown in FIG. 35A, 35B, 35C, 35D, stripe insulating layers 62 are formed on portions where the address electrodes $J_1, \ldots, J_n$ in are to be formed. The insulating layers 62 can be formed by coating a glass paste in a stripe pattern similarly as described above to burn it.

The insulating layers 62 can be formed by a heating process under a processing condition that the exposed discharge start address electrodes $J_{11}, \ldots, J_{nm}$ are prevented from being oxidized or sublimated, e.g., a heating processing in a high vacuum atmosphere of $1>10^{-5}$ Torr or higher.

As shown in FIGS. 36A , 36B, 36C and 36D, address electrodes $J_1, \ldots, J_n$ formed of aluminum evaporated films are formed on the respective insulating layers 62, and simultaneously extended portions of the address electrodes $J_1, \ldots, J_n$ are connected directly to the discharge start address electrodes $J_{11}, \ldots, J_{nm}$ along side surfaces of the insulating layers 62, thereby the discharge start address electrodes $J_{11}, \ldots, J_{nm}$ and the address electrodes $J_1, \ldots, J_n$ being electrically connected to each other.

As shown in FIGS. 37A, 37B, 37C and 37D, a dielectric layer 40 is formed on a display area except so-called terminal portions at end portions of the discharge sustain electrodes $I_1, \ldots, I_m$, and further an Mgo film 4 serving as a protective film is formed thereon. Thus, the electrode substrate 33 is formed.

Figure 42:
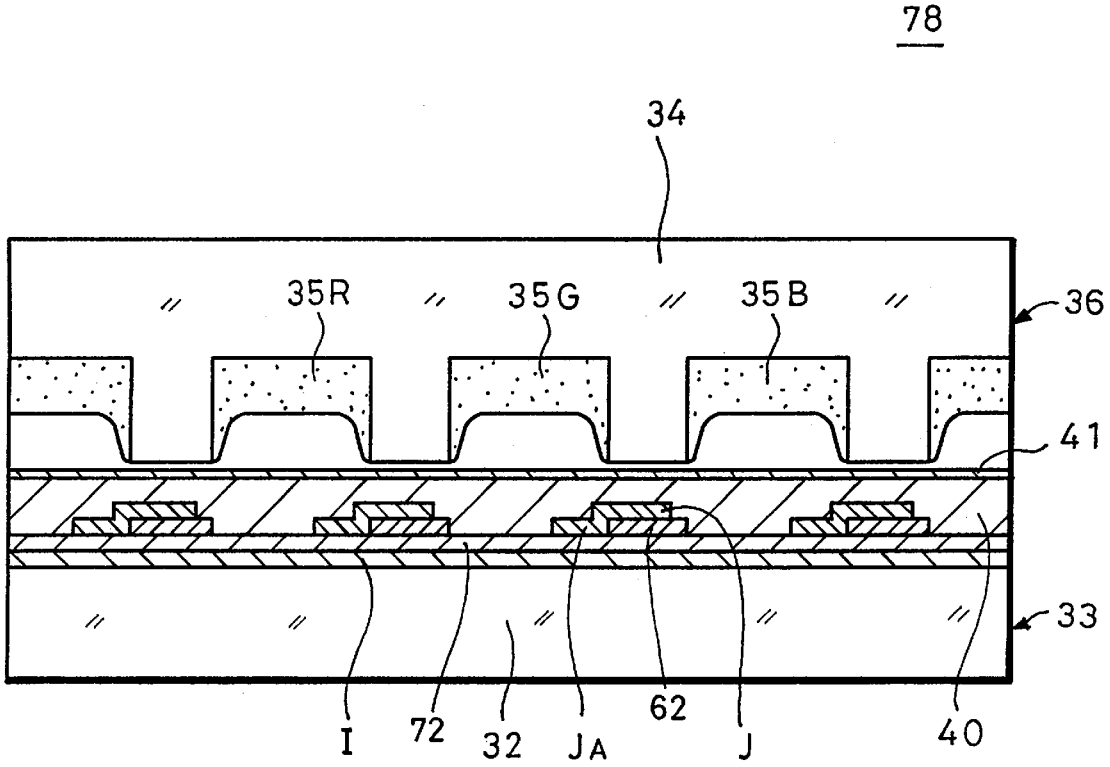
FIG. 42 is a diagram showing an arrangement of a main part of the display apparatus according to the seventh embodiment of the present invention.

As shown in FIG. 42, barrier ribs 56 are formed on a glass substrate 34 serving as a second substrate, and phosphor layers 35 (35R, 35G, 35B) are formed on portions between the adjacent barrier ribs 56. Thus, the phosphor substrate 33 is sealed with a glass frit.

The electrode substrate 33 and the phosphor substrate 36 are sealed with a glass frit so that terminal portions 74 of the discharge sustain electrodes $I_1, \ldots, I_m$ and terminal portions of the address electrodes $J_1, \ldots, J_n$ should be opposed to an outside.

Figure 38A:
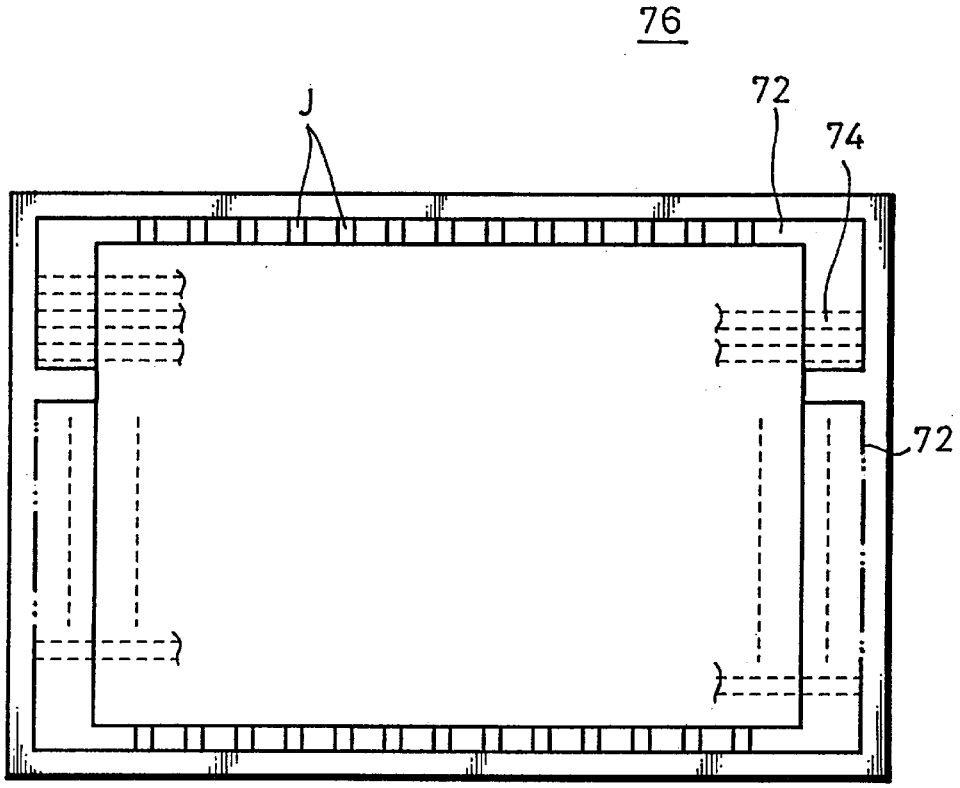
FIGS. 38A and 38B are a plan view and a partially cross-sectional, side view of the display apparatus according to the sixth embodiment of the present invention, respectively.
Figure 38B:
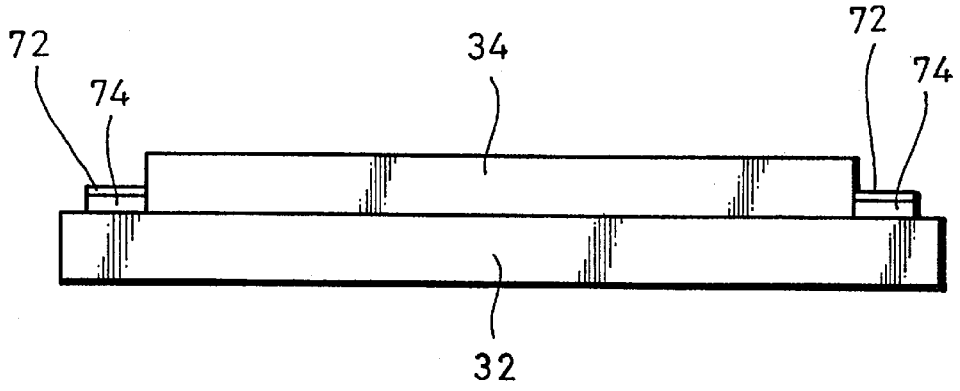

Thus, as shown in FIG. 38A and 38B, the target display apparatus 76 in which the thin insulating films 72 are uniformly formed on the discharge sustain electrodes $I_1, \ldots, I_m$ and their terminal portions 74 can be obtained.

Other arrangements of the display apparatus 76 and operations thereof are similar to those of the display apparatus 31, and hence needs not to be described in detail.

According to the display apparatus 76, since the insulating films 72 having satisfactory insulation are formed on the surfaces of the discharge sustain electrodes $I_1, \ldots, I_m$ similarly as described above, it is possible to improve insulation between the discharge sustain electrodes $I_1, \ldots, I_m$ and the address electrodes $J_1, \ldots, J_n$. Since the insulating films 72 are formed on the surfaces of the terminal portions 74 of the discharge sustain electrodes $I_1, \ldots, I_m$, it is possible to prevent the terminal portions 74 from being oxidized or sublimated in the burning process upon forming the insulating layers 62 and further in the process sealing both of the substrates 33, 36 with a frit.

According to the display apparatus 76, since the insulating films 72 are formed only on the pairs of discharge sustain electrodes $I_m$ and $I_2, \ldots, I_{m-1}$ and $I_m$ and is not formed on the discharge start address electrodes $J_{11}, \ldots, J_{nm}$, the process of forming the contact aperture 73 as shown in FIG. 30 becomes unnecessary, which simplifies the manufacturing processes and stabilizes the connection between the address electrodes $J_1, \ldots, J_n$ and the discharge start address electrodes $J_{11}, \ldots, J_{nm}$.

If only improvement of insulation between the discharge sustain electrodes $I_1, \ldots, I_m$ and the address electrodes $J_1, \ldots, J_n$ is desired, then the insulating films 72 can be formed only on the display area except the terminal portions 74. In this case, atmosphere upon forming the insulating layers 62 or sealing the substrates 33 and 36 with a frit may be adjusted, or a means for preventing only the terminal portions 74 from being oxidized may be provided.

The insulating films on the terminal portions 74 may be left even after fabrication of the insulating layers 62 is completed or may be removed after fabrication of the insulating layers 62 is completed.

While the dielectric layer 40 and the MgO film 41 are formed as shown in FIGS. 32A to 32C, the MgO film 41 may be formed directly on the insulating films 72 employed as a dielectric layer instead of using the dielectric layer 40.

A display apparatus according to a seventh embodiment of the present invention which allows its arrangement and manufacturing processes to be simplified will be described.

FIGS. 39 to 42 are diagrams showing successive processes of manufacturing such display apparatus 78.

Figure 39A:
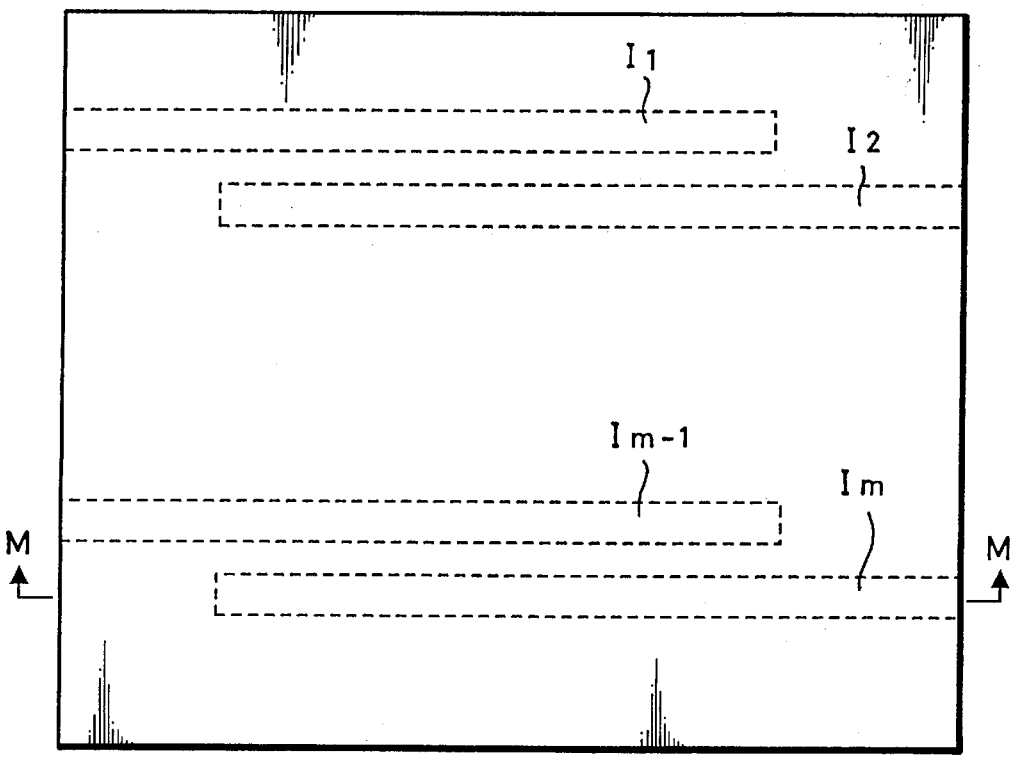
Figure 39B:
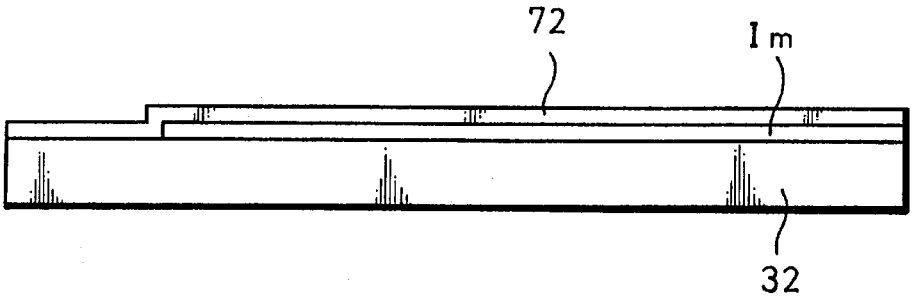

As shown in FIGS. 39A and 39B, discharge sustain electrodes $I_1, \ldots, I_m$ are formed on one surface of a glass substrate 32 serving as a first substrate. The discharge sustain electrodes $I_1, \ldots, I_m$ can be formed by the same method as described above. Similarly as described above, the discharge sustain electrodes $I_1, \ldots, I_m$ can be formed of transparent and conductive films such as ITO films or the like, metal films made of aluminum (Al), chromium (Cr), gold (Au) or silver (Ag), or metal films, metal films having a dilayer structure formed of Al and Cr, metal films having a trilayer structure formed of Cr/Al/Cr. In this seventh embodiment, the discharge sustain electrodes $I_1, \ldots, I_m$ are formed of aluminum films.

A thin insulating film 72 similar to that described above is deposited on an entire surface of the substrate 32 including surfaces of the discharge sustain electrodes $I_1, \ldots, I_m$.

Figure 40A:
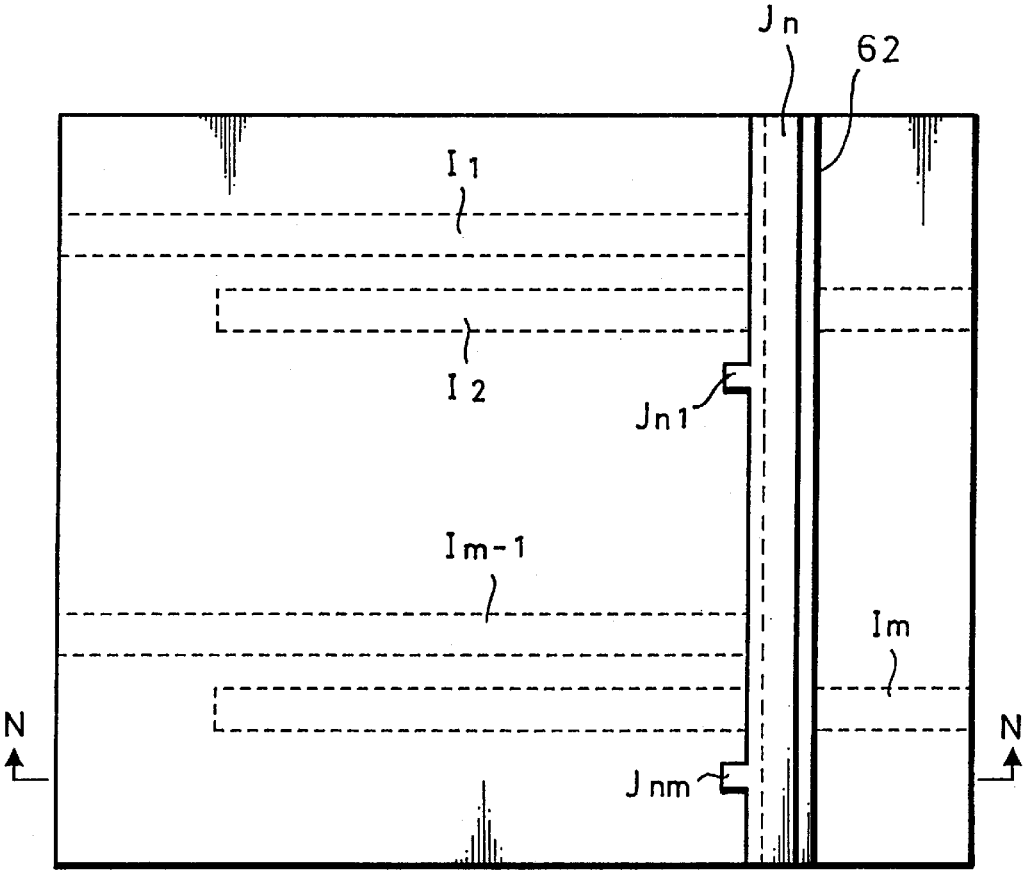
Figure 40B:
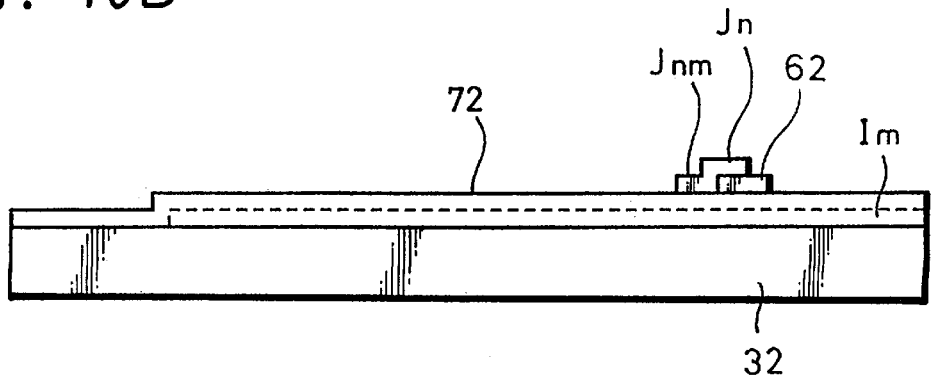

As shown in FIGS. 40A and 40B, stripe insulating layers 62 are formed on positions, where address electrodes $J_1, \ldots, J_n$ are to be formed, so as to cross the discharge sustain electrodes $I_1, \ldots, I_m$ perpendicularly thereto.

The address electrodes $J_1, \ldots, J_n$ and discharge start address electrodes $J_{11}, \ldots J_{nm}$ continuously formed integrally therewith are simultaneously formed on the insulating layers 62 and also on a part of the insulating film 72. The address electrodes $J_1, \ldots, J_n$ and the discharge start address electrodes $J_{11}, \ldots J_{nm}$ can be formed by lift-off process or by etching.

Figure 41A:
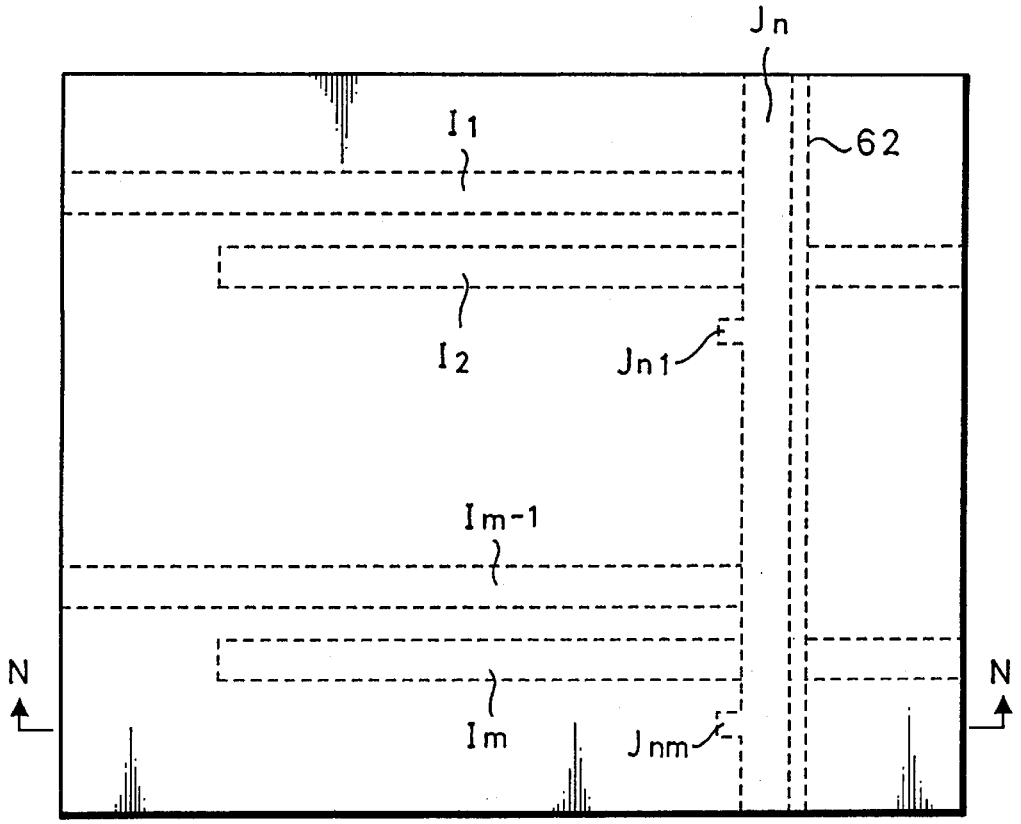
Figure 41B:
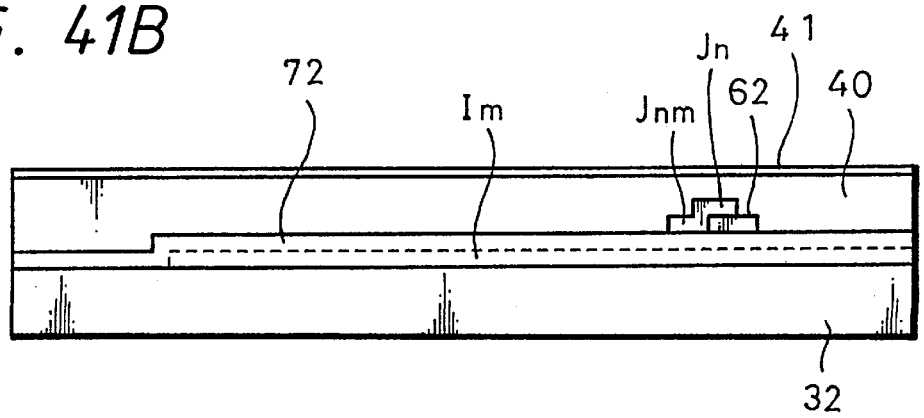

As shown in FIGS. 41A and 41B, a dielectric layer 40 is formed on an entire surface on a display area except terminal portions (not shown) of the discharge sustain electrodes $I_1, \ldots, I_m$, and further an MgO film 41 serving as a protective film for the dielectric layer 40 is formed thereon. Thus, the electrode substrate 333 is formed.

Though not shown, barrier ribs 56 are formed on a glass substrate 34 serving as a second substrate, and phosphor layers 35 (35R, 35G, 35B) are formed at positions between the adjacent barrier ribs 56. Thus, the phosphor substrate 36 is formed.

The electrode substrate 33 and the phosphor substrate 36 are assembled and sealed with a glass frit so that the terminal portions 74 of the discharge sustain electrodes $I_1, \ldots I_m$ and the terminal portions of the address electrodes $J_1, \ldots, J_n$ in should be opposed to an outside.

Thus, as shown in FIGS. 42, the target display apparatus 78 in which the thin insulating film 72 is uniformly formed on the surfaces of the discharge sustain electrodes $I_1, \ldots, I_m$ and the address electrodes $J_1, \ldots, J_n$ and in which the address electrodes $J_1, \ldots, J_n$ and the discharge start address electrodes $J_{11}, \ldots, J_{nm}$ are integrally formed of the same conductive material can be obtained.

Other arrangements of the display apparatus 71 and operations thereof are similar to those of the display apparatus 31, and hence need not to be described in detail.

According to the display apparatus 78, the address electrodes $J_1, \ldots, J_n$ and the discharge start address electrodes $J_{11}, \ldots, J_{nm}$ are not individually but integrally formed, the arrangement of the electrodes can be simplified.

Since the insulating film 72 having satisfactory insulation is provided on the surface of the discharge sustain electrodes $I_1, \ldots, I_m$, it is possible to improve insulation between the discharge sustain electrodes $I_1, \ldots, I_m$ and the address electrodes $J_1, \ldots, J_n$.

Since the insulating film 72 is formed on the surfaces of the terminal portions of the discharge sustain electrodes $I_1, \ldots, I_m$, it is possible to prevent the terminal portions from being oxidized or sublimated in the burning process upon forming the insulating layers 62 and in the process of sealing both of the substrate 33, 36 with a glass frit.

When the display apparatus 78 is manufactured, the complicated processes of forming contact apertures through the insulating film 72 to connect the discharge start address electrodes and the address electrodes to each other become unnecessary, which can simplify the manufacturing processes.

While in the seventh embodiment shown in FIGS. 39 to 42 the insulating film 72 is formed on the entire surface including the surfaces of the discharge sustain electrodes $I_1, \ldots, I_m$, the present invention is not limited thereto. Though not shown, the following arrangement can be employed. Specifically, after the discharge sustain electrodes $I_1, \ldots, I_m$ is formed without the insulating film 72 being formed, the insulating layers 62 crossing directly the discharge sustain electrodes $I_1, \ldots, I_m$ are formed and then the address electrodes $J_1, \ldots, J_n$ and the discharge start address electrodes $J_{11}, \ldots, J_{nm}$ are simultaneously formed on the insulating layer 62 and also on a part of the surface of the glass substrate 32. In this case, since the address electrodes $J_1, \ldots, J_n$ and the discharge start address electrodes $J_{11}, \ldots, J_{nm}$ are simultaneously formed, the arrangement of the display apparatus and the manufacturing method thereof can be simplified.

While in the above first to seventh embodiments the present invention is applied to a display apparatus for displaying an image by exciting phosphor layers to make them emitting light. The present invention is not limited thereto and can be applied to a display apparatus which displays an image by light emission resulting from the plasma discharge without phosphor layers being formed.

According to the display apparatus of the present invention, since the discharge sustain electrode group and the address electrode group are formed on the same one substrate of the AC drive type display apparatus utilizing the plasma display, even if the distance between the address electrode and the discharge sustain electrode becomes smaller, it is possible to keep the plasma discharge space. Therefore, it is possible to make the display apparatus extremely thin and to permit the pixels thereof to have higher definition.

Since the discharge sustain electrode group and the address electrode group are formed on the same one substrate and the phosphor layer is formed on the other substrate opposed to the one substrate, even if the distance between the electrodes becomes smaller, it is possible to keep the plasma discharge space and to excite the phosphor layer by ultraviolet rays resulting from the plasma to make the phosphor layer emitting light.

Since the plasma generated by the discharge is prevented from being brought in contact with the phosphor layer, the phosphor layer is prevented from being deteriorated by the plasma. Therefore, it is possible to make the display apparatus extremely thin and to permit the pixels thereof to have higher definition.

Since the discharge sustain electrode group and the address electrode group are formed on the same one substrate it is possible to set the distance between the pair of discharge sustain electrodes and the distance between the one of the pair of discharge sustain electrodes and the discharge start address electrode forming a part of the address electrode, with satisfactory accuracy.

As a result, the process of forming the electrodes and the process for sealing the one substrate and the other substrate opposed thereto can be carried out with some tolerance. Therefore, a yield of the display apparatus utilizing the plasma discharge is improved, which can reduce the manufacturing costs thereof.

Since the discharge sustain electrode group and the address electrode group cross each other and the insulating layer is formed between the discharge sustain electrode group and the address electrode group, the discharge sustain electrode group and the address electrode group are prevented from being short-circuited each other.

If the discharge start address electrodes is formed in every unit discharge region, the barrier ribs are formed on the other substrate to form the phosphor layers in the portions between the adjacent barrier ribs, and the one substrate and the other substrate are sealed so that the barrier ribs and the address electrodes should be matched with each other, respectively, then the opening portion of the unit discharge region can be made larger and electricity is hardly discharge directly to the address electrodes. Consequently, it is possible to prevent the crosstalk. Since the barrier ribs permits the discharge space to be sufficiently kept and permits the phosphor layer to be formed in the whole surface of the portion between the adjacent barrier ribs, it is possible to make the area of the phosphor layer wider. Consequently, the above effects presents a high-luminance display.

If the distance between the first and second discharge sustain electrodes forming a pair of discharge sustain electrode group is set to 50 $\mu$m or smaller, it is possible to obtain a high-definition display apparatus.

Since the distance between the first and second discharge sustain electrodes forming a pair of discharge sustain electrode group is set substantially equal to the distance between the discharge start address electrode and the discharge sustain electrode, application of a high voltage permits commencement of the discharge between the discharge start address electrode and the discharge sustain electrode and after the start of the discharge, application of a comparatively low voltage permits the discharge between the pair of discharge sustain electrodes to be sustained, which leads to a satisfactory image display obtained by light emission resulting from the discharge.

If the distance between the discharge sustain electrode and the discharge start address electrode is set within the range of ±30% of the distance of the first and second discharge sustain electrodes forming one pair of the discharge sustain electrode group, then the discharge start voltage can be gently varied in response to the distance between the discharge sustain electrode and the discharge start address electrode, which improves a degree of freedom in setting a drive condition.

Since the gas of one kind or larger of He, Ne, Ar, Xe and Kr is filled so that a pressure of the filled gas should be 0.8 to 3.0 atmosphere, it is possible to emit light more brightly. Especially, in the display apparatus for exciting the phosphor layer to make it emitting light, consequently a large amount of ultraviolet rays are generated, which allows the phosphor layer to emit light more brightly.

If the discharge start address electrodes are formed so as to be L-shaped, it is possible to keep sufficiently the length of a portion thereof opposed to the discharge sustain electrode, which facilitates commencement of the discharge.

Simultaneously, the tolerance for displacement occurring when the discharge start address electrode and the address electrode are connected to each other, which facilitates the connection of the discharge start address electrode and the address electrode.

If the address electrode and the discharge start address electrode are connected each other through the aperture formed through the insulating layer, then insulation between the address electrode and the discharge start address electrode can be kept, which enables connection between the address electrode and the discharge start address electrode reliably.

If the magnesium oxide layer is formed on the surface of the dielectric layer on the discharge start address electrode and the discharge sustain electrode except the address electrode, then the discharge between the discharge start address electrode and the discharge sustain electrode and the discharge between the first and second discharge sustain electrodes forming the pair can be facilitated and the discharge voltage can be lowered. At the same time, the discharge between the address electrode and the discharge sustain electrode is made difficult, thereby the crosstalk therebetween being prevented.

Since the thickness of the dielectric layer on the discharge start address electrode and the discharge sustain electrode is set smaller than the distance between the electrodes, the discharge can be carried out above the dielectric layer. Specifically, the discharge in the dielectric layer can be prevented, and puncture of insulation between the electrodes in the dielectric layer can be prevented.

If the address electrode group crossing the discharge sustain electrode group is formed through the insulating layer and the extended portions of the respective address electrodes are connected directly to the discharge start address electrodes along the side surfaces of the insulating layers, then the address electrodes and the discharge start address electrodes can be connected to each other stably and reliably. Since the contact aperture needs not to be formed upon fabrication of the display apparatus, it is possible to simplify the manufacturing processes thereof.

If the reflective film is provided on the side of the other substrate, then the rays of light emitted toward the second substrate side, of the emitted light, are reflected by the reflective film. Therefore, when a user sees a displayed image from the side of the one substrate where the electrodes are formed, it is possible to prevent the loss of light and to improve the luminance.

If the reflective film is provided on the side of the one substrate, then the rays of light emitted toward the one substrate side, of the emitted light, are reflected by the reflective film. Therefore, when a user sees a displayed image from the side of the second substrate where the electrodes are formed, it is possible to prevent the loss of light and to improve the luminance.

Since the discharge sustain electrode and the terminal portions of the discharge sustain electrode are covered directly with the insulating film, even if the insulation of the insulating layer provided immediately under the address electrode is deteriorated, then it is possible to keep the satisfactory insulation between the address electrode and the discharge sustain electrode. It is possible to prevent the discharge sustain electrode, the terminal portion thereof and the discharge start address electrode from being oxidized or sublimated upon heat treatment in the manufacturing processes. Therefore, it is possible to obtain the highly reliable display apparatus.

Since the film thickness of the insulating film is set to 10 $\mu$m to 100 $\mu$m, the insulation as the insulating film can be secured. The number of the processes required for forming the insulating film can be reduced, and the transparency of the insulating film can be secured.

If the insulating film is employed as the dielectric layer, a dielectric layer needs not to be formed newly, and the thickness of the dielectric layer can be reduced.

Since the address electrode group crossing the discharge sustain electrode group through the insulating layer and the discharge start address electrode group are integrally and simultaneously formed, it is possible to simplify the arrangement of the electrodes.

Since the insulating film is formed so as to cover the discharge sustain electrode group and the address electrode group crossing the discharge sustain electrode group and the discharge start address electrode group are integrally and simultaneously formed, it is possible to simplify the arrangement of the electrodes.

Moreover, since the insulating film can keep satisfactory insulation between the address electrode and the discharge sustain electrode even if the insulation of the insulating layer provided immediately under the address electrode is deteriorated.

The discharge sustain electrode and its terminal portion can be prevented from being oxidized or sublimated upon the heat treatment carried out when the insulating layer is formed.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A display apparatus of an AC drive type utilizing plasma discharge, comprising:

a discharge sustain electrode group formed of a plurality of discharge sustain electrodes on one substrate;

an address electrode group formed of a plurality of address electrodes on said one substrate;

a discharge start address electrode group, formed of a plurality of discharge start address electrodes, connected to and forming a part of said address electrode group; and a dielectric layer formed on at least said discharge sustain electrode group and said discharge start address electrode group.

2. A display apparatus according to claim 1, wherein a phosphor layer is formed on a second substrate opposed to said one substrate.

3. A display apparatus according to claim 1, wherein said discharge sustain electrode group and said address electrode group are formed so as to cross each other and an insulating layer is formed between said discharge sustain electrode group and said address electrode group.

4. A display apparatus according to claim 2, wherein said discharge sustain electrode group and said address electrode group are formed so as to cross each other and an insulating layer is formed between said discharge sustain electrode group and said address electrode group.

5. A display apparatus according to claim 2, which further comprises:

a plurality of unit discharge regions, each of which has one of said plurality of discharge start address electrodes formed therein; and a plurality of barrier ribs, formed on said second substrate with said phosphor layer formed between said barrier ribs, wherein each of said barrier ribs is disposed above a respective one of said address electrodes.

6. A display apparatus according to claim 1, wherein a distance between a pair of first and second discharge sustain electrodes of said discharge sustain electrode group is set to 50 $\mu$m or smaller.

7. A display apparatus according to claim 2, wherein a distance between a pair of first and second discharge sustain electrodes of said discharge sustain electrode group is set to 50 $\mu$m or smaller.

8. A display apparatus according to claim 1, wherein said distance between a pair of first and second discharge sustain electrodes of said discharge sustain electrode group, and a distance between a discharge start address electrode and a discharge sustain electrode, are set substantially equal to each other.

9. A display apparatus according to claim 2, wherein said distance between a pair of first and second discharge sustain electrodes or said discharge sustain electrode group, and a distance between a discharge start address electrode and a discharge sustain electrode, are set substantially equal to each other.

10. A display apparatus according to claim 1, wherein said distance between a discharge start address electrode and a first discharge sustain electrode is set within the range of ±30% of a distance between a pair of discharge sustain electrodes of said discharge sustain electrode group.

11. A display apparatus according to claim 2, wherein said distance between a discharge start address electrode and a first discharge sustain electrode is set within the range ±30% of a distance between a pair of discharge sustain electrodes of said discharge sustain electrode group.

12. A display apparatus according to claim 1, wherein gas of one kind or more of Be , Ne, Ar, Xe, Kr is filled so that a pressure of filled gas should be 0.8 to 3.0 atmosphere.

13. A display apparatus according to claim 2, wherein gas of one kind or more of He, Ne, Ar, Xe, Kr is filled so that a pressure of filled gas should be 0.8 to 3.0 atmosphere.

14. A display apparatus according to claim 3, wherein a discharge start address electrode is formed so as to be L-shaped.

15. A display apparatus according to claim 4, wherein a discharge start address electrode is formed so as to be L-shaped.

16. A display apparatus according to claim 3, wherein an address electrode and a discharge start address electrode are connected to each other through an aperture provided through said insulating layer.

17. A display apparatus according to claim 4, wherein an address electrode and a discharge start address electrode and said discharge start address electrode are connected to each other through an aperture provided through said insulating layer.

18. A display apparatus according to claim 1, wherein a magnesium oxide layer is formed on a surface of said dielectric layer that is formed on said discharge start address electrode group and said discharge sustain electrode group, except portions of said dielectric layer that are disposed above said plurality of address electrodes.

19. A display apparatus according to claim 2, wherein a magnesium oxide layer is formed on a surface of said dielectric layer on said discharge start address electrode and said discharge sustain electrode except said address electrode.

20. A display apparatus according to claim 1, wherein a thickness of said dielectric layer on said discharge sustain electrode and said discharge start address electrode is thinner than a distance between electrodes.

21. A display apparatus according to claim 2, wherein a thickness of said dielectric layer on said discharge sustain electrode and said discharge start address electrode is thinner than a distance between electrodes.

22. A display apparatus according to claim 1, wherein said address electrode group crossing said discharge sustain electrode group is formed through an insulating layer, an extended portion of each of said address electrodes is connected directly to each of said discharge start address electrodes along a side surface of said insulating layer.

23. A display apparatus according to claim 2, wherein said address electrode group crossing said discharge sustain electrode group is formed through an insulating layer, an extended portion of each of said address electrodes is connected directly to each other of said discharge start address electrodes.

24. A display apparatus according to claim 1, further comprising:

a reflective film on a side of said other substrate.

25. A display apparatus according to claim 2, further comprising:

a reflective film on a side of said other substrate.

26. A display apparatus according to claim 1, further comprising:

a reflective film on a side of said one substrate.

27. A display apparatus according to claim 1, further comprising:

a reflective film on a side of said one substrate.

28. A display apparatus according to claim 1, wherein said discharge sustain electrode and a terminal portion of said discharge sustain electrode are covered directly with an insulating layer.

29. A display apparatus according to claim 2, wherein said discharge sustain electrode and a terminal portion of said discharge sustain electrode are covered directly with an insulating layer.

30. A display apparatus according to claim 3, wherein terminal portions of said plurality of discharge sustain electrodes and said plurality of discharge start address electrodes are covered directly with an insulating layer.

31. A display apparatus according to claim 4, wherein terminal portions of said plurality of discharge sustain electrodes and said plurality of discharge start address electrodes are covered directly with an insulating layer.

32. A display apparatus according to claim 28, wherein a thickness of said insulating layer is 10 $\mu$m to 100 $\mu$m.

33. A display apparatus according to claim 30, wherein a thickness of said insulating layer is 10 $\mu$m to 100 $\mu$m.

34. A display apparatus according to claim 29, wherein a thickness of said insulating layer is 10 $\mu$m to 100 $\mu$m.

35. A display apparatus according to claim 31, wherein a thickness of said insulating layer is 10 $\mu$m to 100 $\mu$m.

36. A display apparatus according to claim 30, wherein said insulating layer also serves as said dielectric layer.

37. A display apparatus according to claim 31, wherein said insulating layer also serves as said dielectric layer.

38. A display apparatus according to claim 1, wherein said address electrode group is formed through an insulating layer, and crosses said discharge sustain electrode group, and said discharge start address electrode group and said address electrode group are continuously formed simultaneously.

39. A display apparatus according to claim 1, wherein an insulating film covers said discharge sustain electrode group, said address electrode group crosses said discharge sustain electrode group, and said discharge start address electrode group and said address electrode group continuously formed simultaneously.

40. A display apparatus according to claim 1, wherein said address electrode group is formed through an insulating layer, and crosses said discharge sustain electrode group, and said discharge start address electrode group and said address electrode group are continuously formed simultaneously.

41. A display apparatus according to claim 1, wherein an insulating film covers said discharge sustain electrode group, said address electrode group crosses said discharge sustain electrode group, and said discharge start address electrode group and said address electrode group continuously formed simultaneously.

* * * * *